US011731828B2

(12) United States Patent
Dinh

(10) Patent No.: US 11,731,828 B2
(45) Date of Patent: Aug. 22, 2023

(54) HAND-OPERATED BOTTLE AND CONTAINER DISPENSING ASSISTANCE DEVICE AND METHOD

(71) Applicant: Tri Trong Dinh, Muscatine, IA (US)

(72) Inventor: Tri Trong Dinh, Muscatine, IA (US)

( * ) Notice: Subject to any disclaimer, the term of this patent is extended or adjusted under 35 U.S.C. 154(b) by 0 days.

(21) Appl. No.: 17/447,141

(22) Filed: Sep. 8, 2021

(65) Prior Publication Data

US 2023/0076652 A1 Mar. 9, 2023

(51) Int. Cl.
*B65D 83/20* (2006.01)

(52) U.S. Cl.
CPC ..... *B65D 83/203* (2013.01)

(58) Field of Classification Search
CPC .. B65D 83/201; B65D 83/202; B65D 83/203; B65D 83/206
See application file for complete search history.

(56) References Cited

U.S. PATENT DOCUMENTS 2,720,422 A 10/1955 Mercur
2,803,383 A * 8/1957 Dickman ..... B65D 83/202 222/323
2,820,578 A * 1/1958 Dickman ..... B65D 83/202 222/323
2,830,742 A * 4/1958 Gibbons ..... B65D 83/203 222/323
2,877,934 A * 3/1959 Wallace ..... B65D 83/202 222/472
2,893,606 A 7/1959 Hawkins
3,017,056 A 1/1962 Bishop
3,045,878 A * 7/1962 Blanford ..... B65D 83/202 222/402.15
3,112,849 A * 12/1963 Wallace ..... B65D 83/202 220/759
3,229,859 A 1/1966 Controy et al.
3,276,699 A * 10/1966 Graveley ..... B65D 83/202 239/338
3,510,028 A 5/1970 Batistelli
3,716,195 A 2/1973 Silva
3,861,566 A 1/1975 Wentzell
(Continued)

FOREIGN PATENT DOCUMENTS

DE 29812175 U1 * 12/1998 ..... B05B 15/0443
GB 2348929 A * 10/2000 ..... B65D 83/202

*Primary Examiner* — Donnell A Long
(74) *Attorney, Agent, or Firm* — McKee, Voorhees & Sease, PLC

(57) ABSTRACT

An apparatus, method, and system that uses a lever action hand grip that can include an adjustable receiver for a variety of diameters, form factors, and other variables for different containers of liquids or aerosols that are desired to be dispensed. A linkage connects the lever action hand-grip to a working end. The working end moves in arcuate fashion in response to pivoting of the lever. The proportional working end motion path can serve to both push down an aerosol spray head to dispense, or laterally push or pump other types of dispensing heads. Optionally, the linkage can have at least one, and sometimes two or three, different adjustments for such things as size and location of a dispensing head for a variety of dispensing containers and types, range of motion, type of interface at the working end, and specifically what type of working end relative to a dispensing head of a container or bottle.

17 Claims, 41 Drawing Sheets

(56) References Cited

U.S. PATENT DOCUMENTS

| | | | | | |
|---|---|---|---|---|---|
| 4,023,711 | A | | 5/1977 | Sena | |
| 4,040,543 | A | * | 8/1977 | Guillen | B65D 83/202 222/402.15 |
| 4,579,258 | A | * | 4/1986 | Brown | B65D 83/202 222/323 |
| 4,660,745 | A | | 4/1987 | Hess, Jr. | |
| 5,152,461 | A | | 10/1992 | Proctor | |
| 5,318,208 | A | * | 6/1994 | van der Wal | B65D 83/202 251/129.21 |
| 5,368,202 | A | | 11/1994 | Smrt | |
| 5,518,148 | A | | 5/1996 | Smrt | |
| 5,904,273 | A | * | 5/1999 | Aspacher | B65D 83/202 222/402.15 |
| 7,040,510 | B1 | | 5/2006 | Hester | |
| 7,314,149 | B1 | | 1/2008 | White | |
| 7,717,300 | B1 | | 5/2010 | Yarrusso, Jr. | |
| 8,444,020 | B1 | | 5/2013 | Kenny | |
| 10,226,037 | B2 | | 3/2019 | States, III et al. | |
| 2006/0255067 | A1 | * | 11/2006 | Guiseppe | B65D 83/203 222/174 |

* cited by examiner

[EXTERIOR VIEW]

[INTERIOR VIEW]

[INTERIOR VIEW]

HAND-OPERATED BOTTLE AND CONTAINER DISPENSING ASSISTANCE DEVICE AND METHOD

I. BACKGROUND OF THE INVENTION

A. Field of the Invention

This invention relates to an apparatus and method to assist the dispensing of contents of a variety of containers by simple lever action of a user's hand. It can assist in helping provide leverage and control of a variety of aerosol or spray pump containers.

B. Problems in the Art

A variety of attempts have been made to provide hand-operated dispensing assistance for containers. This includes aerosol spray containers and spray pump containers. Examples of some of these attempts include:

| U.S. Pat. No. or Publication # | First Inventor | Issue or Publication Date |
|---|---|---|
| 2,720,422 | Mercur | Oct. 11, 1955 |
| 2,893,606 | Hawkins | Jul. 7, 1959 |
| 3,017,056 | Bishop | Jan. 16, 1962 |
| 3,229,859 | Conroy | Jan. 18, 1966 |
| 3,510,028 | Batistelli | May 5, 1970 |
| 3,716,195 | Silva | Feb. 13, 1973 |
| 3,861,566 | Wentzell | Jan. 21, 1975 |
| 4,023,711 | Sena | May 17, 1977 |
| 4,660,745 | Hess, Jr. | Apr. 28, 1987 |
| 5,152,461 | Proctor | Oct. 6, 1992 |
| 5,368,202 | Smrt | Nov. 29, 1994 |
| 5,518,148 | Smrt | May 21, 1996 |
| 7,040,510 | Hester | May 9, 2006 |
| 7,314,149 | White | Jan. 1, 2008 |
| 7,717,300 | Yarrusso, Jr. | May 18, 2010 |
| 8,444,020 | Kenny | May 21, 2013 |
| 10/226,037 | States, III et al. | Mar. 12, 2019 |

The inventor has found there are problems and deficiencies with many of these attempts. For example, many are dedicated to one type of dispensing container (e.g., pressurized or aerosol spray containers but not hand pump bottles, or vice versa). Many utilize linear action as the actuating force for the spray nozzle or outlet, which can limit their use. Some translate linear action into action in a different direction, but this also can limit their use. It is difficult to apply to a wide variety of dispensing containers.

For example, a typical aerosol container principally relies on up and down motion to spray. The same is true for a pump action manual dispenser. On the other hand, some aerosols like whipped cream want transverse or side motion to displace the nozzle from an axial position to a tilted position to dispense. Some pump action spray heads have horizontal instead of vertical movement to actuate the spray.

The prior art attempts are typically dedicated to one type of dispensing mechanism. Even if they can receive a range of sizes of containers, the range is usually quite limited. Thus, they are not able to operate a wide variety of containers that are typical in most homes. As is well known, household containers come in a variety of sizes, shapes, dispensing mechanisms, and geometric relationships between the dispensing head and the body of the containers. Many attempts at providing a hand-operated assistance for containers have no way to be mounted to a wide variety of different sized, shaped, or actuated containers. This makes it difficult for one such apparatus to be usable with a wide variety of such containers.

Therefore, the inventor has identified areas for room for improvement. In particular, the inventor has identified the need for a single lever action hand-operated actuation device that can effectively be used with a wide variety of containers, and which can be quickly and easily adjusted for mounting and operation on that wide variety of containers.

II. SUMMARY OF THE INVENTION

A. Objects, Features and Advantages of the Invention

The present invention has as a principal object, aspect, feature, or advantage to provide apparatus, methods, and systems to improve over or solve problems and deficiencies in the state-of-the-art.

Other objects, features and advantages to the invention include apparatus, methods, and systems that include one or more of:

a. Hand lever action for improved force generation.
b. Translation of pivotable lever action into arcuate motion of a distal working end to service both aerosols and hand pump dispensing heads with the same motion.
c. The option of adjustability of both lever range of motion and positioning of the working end relative to a wide variety of containers and dispensing heads.

These and other objects, features and advantages of the invention will become apparent with reference to the accompanying specification and claims.

B. Aspects of the Invention

A primary aspect of the present invention is an apparatus that has a lever action hand grip that can include an adjustable receiver for a variety of diameters, form factors, and other variables for different containers of liquids or aerosols that are desired to be dispensed. A linkage connects the lever action hand-grip to a working end. The working end moves in arcuate fashion in response to pivoting of the lever. The working end range of motion can serve to both push down an aerosol spray head to dispense, or laterally push or pump other types of dispensing heads. Optionally, the linkage can have at least one, and sometimes two or three, different adjustments for such things as size and location of a dispensing head for a variety of dispensing containers and types, range of motion, type of interface at the working end, and specifically what type of working end relative to a dispensing head of a container or bottle. As such, this aspect of the invention is counterintuitive in that it uses arcuate or curved path working end range of motion in response to lever action at the user's hand, as opposed to linear motion.

Another aspect of the invention is a method of assistance in dispensing contents of a wide variety of dispensing containers and heads. Lever action at the hand translates to arcuate or curved path motion of a working end relative the dispensing head. Optionally, the working end can be adjusted in height, reach, or in other ways to accommodate different types and sizes of dispensing containers.

A further aspect of the invention is a kit comprising an apparatus with lever-actuated hand grip and an adjustable container receiver. Interchangeable parts in the kit can allow for different applications to different containers and style of dispensing.

III. BRIEF DESCRIPTION OF THE DRAWINGS

Figure 1:
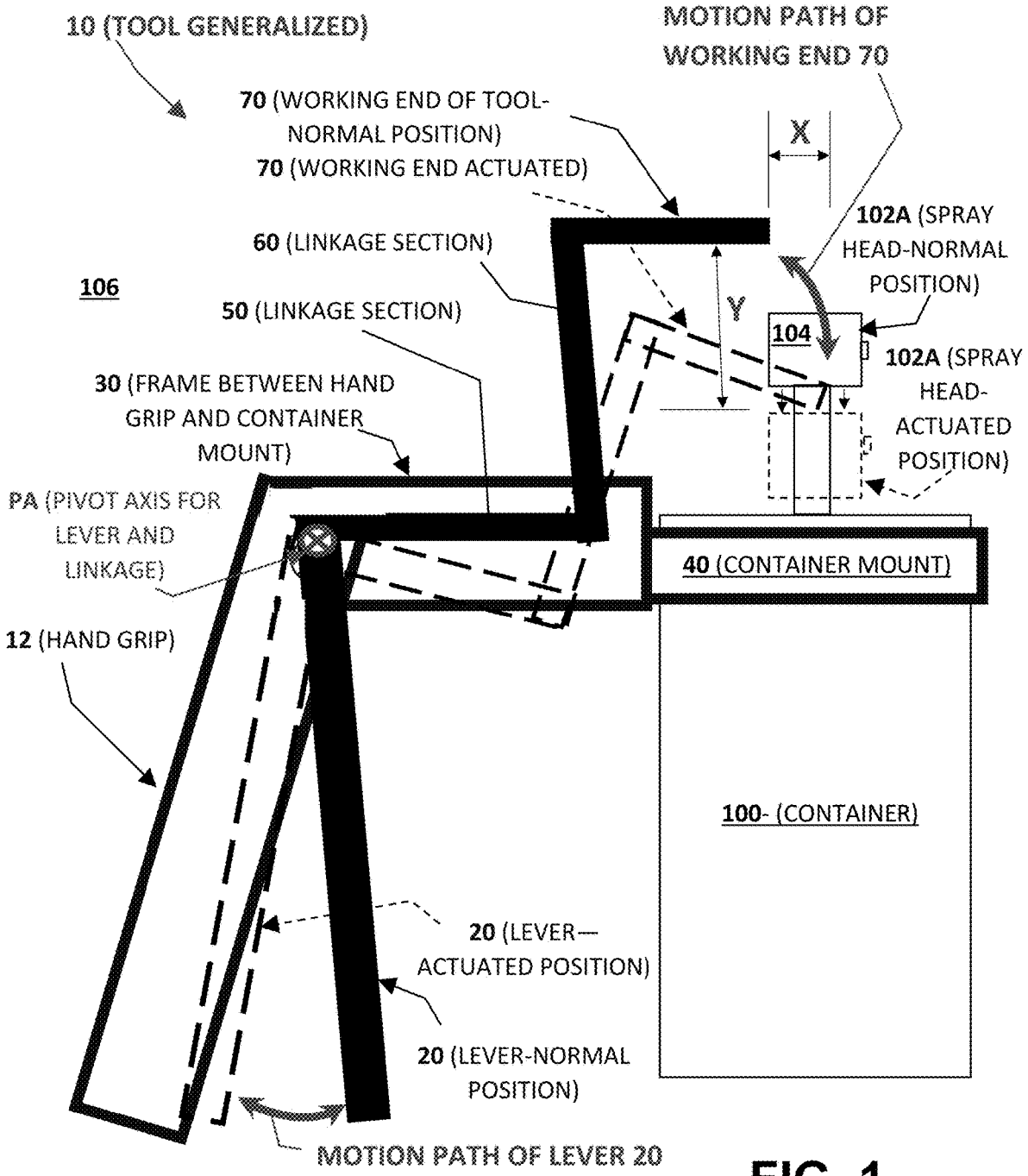
FIGS. 1-3 are a highly diagrammatic illustrations of a generalized embodiment of a tool according to aspects of the invention, and its operation relative a variety of different spray heads for spray containers.
Figure 2:
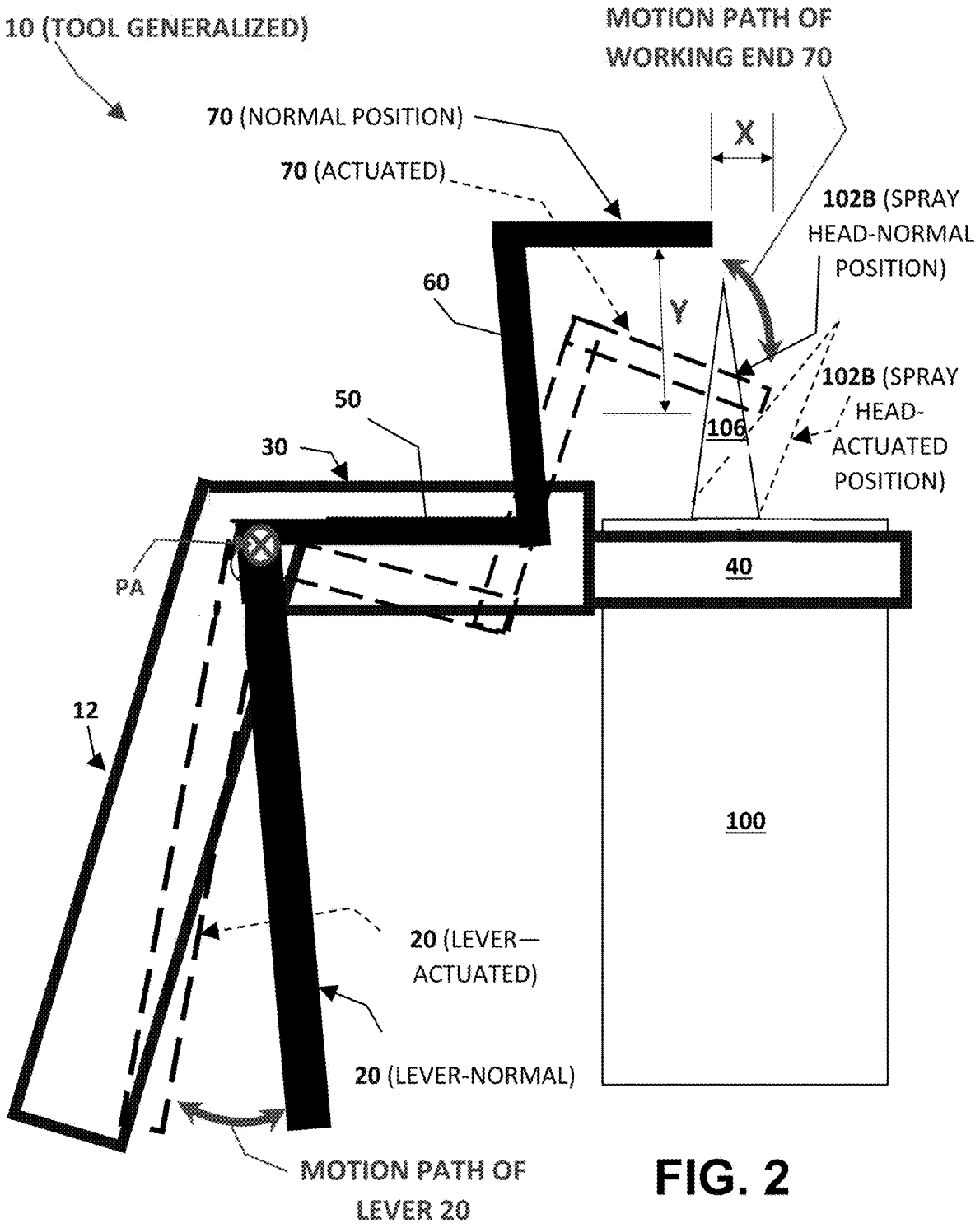
Figure 3:
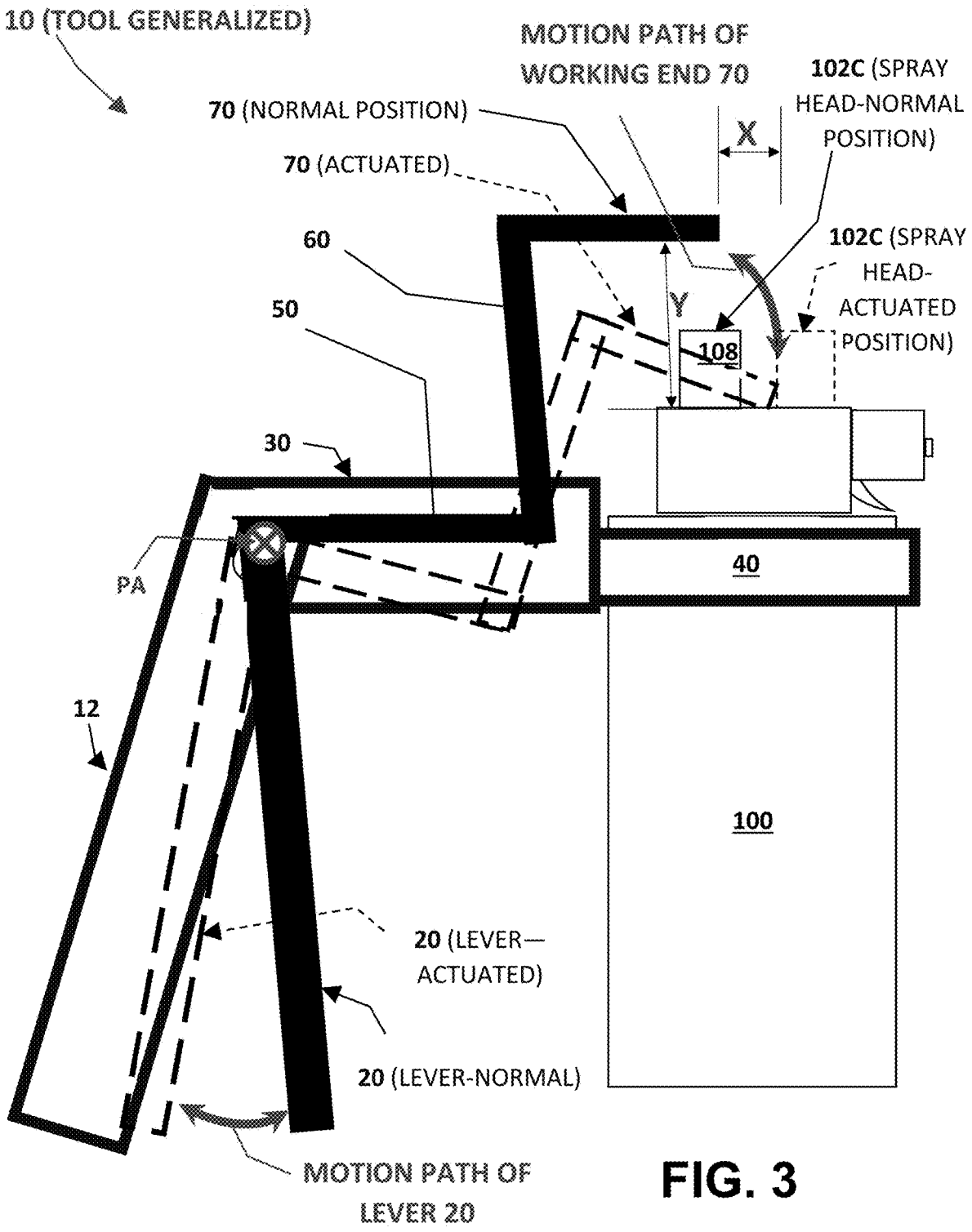
Figure 6:
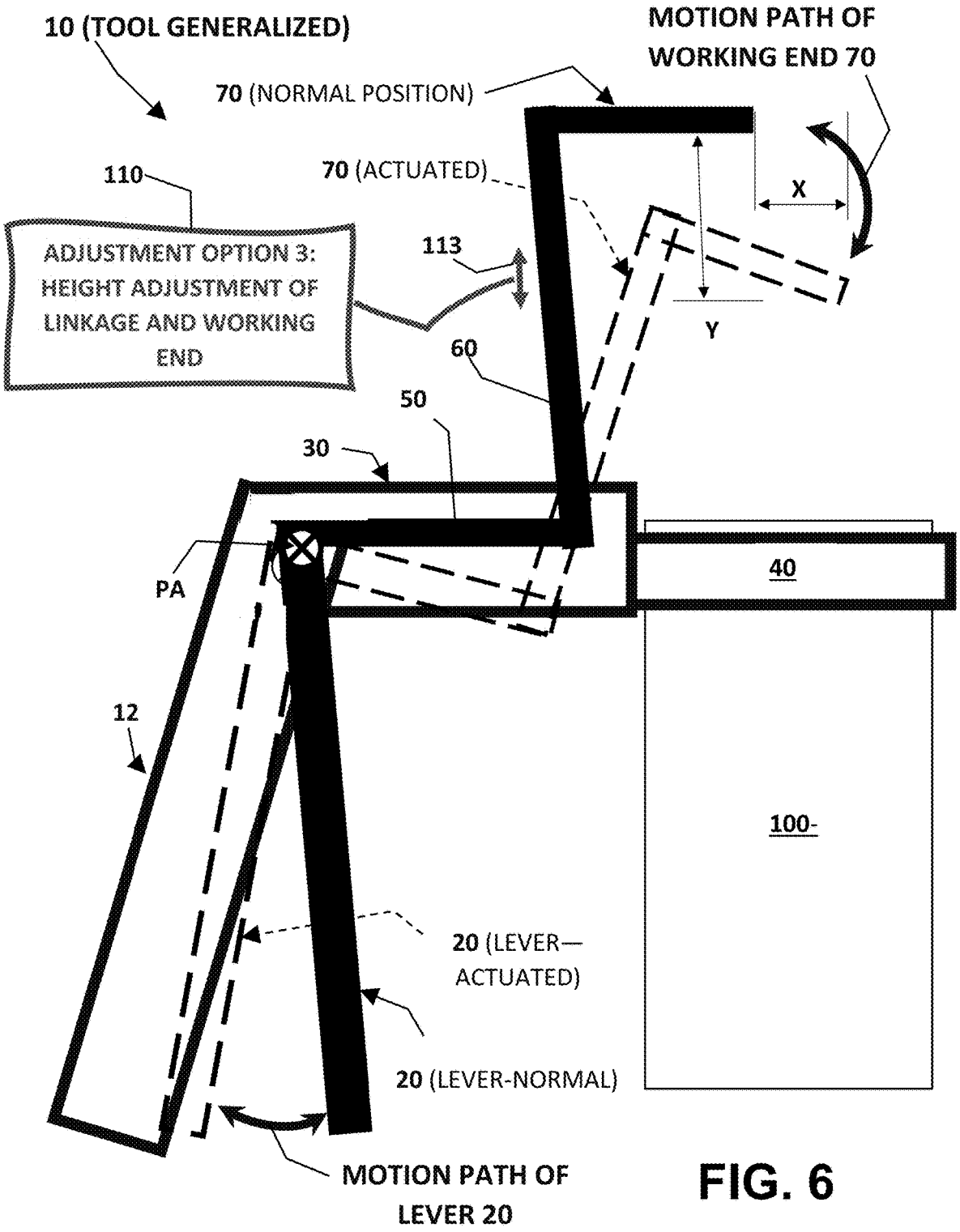
Figure 7:
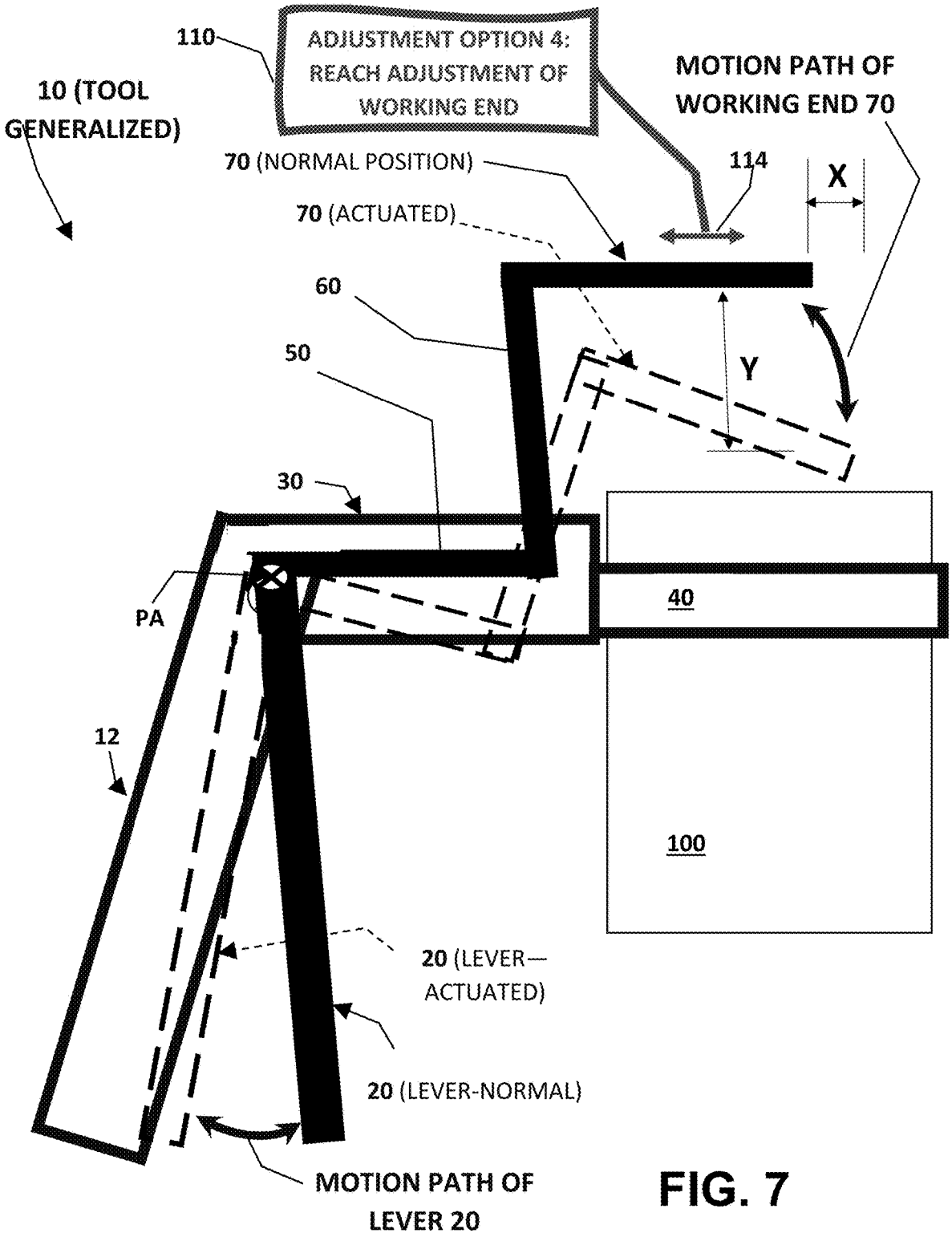
Figure 8:
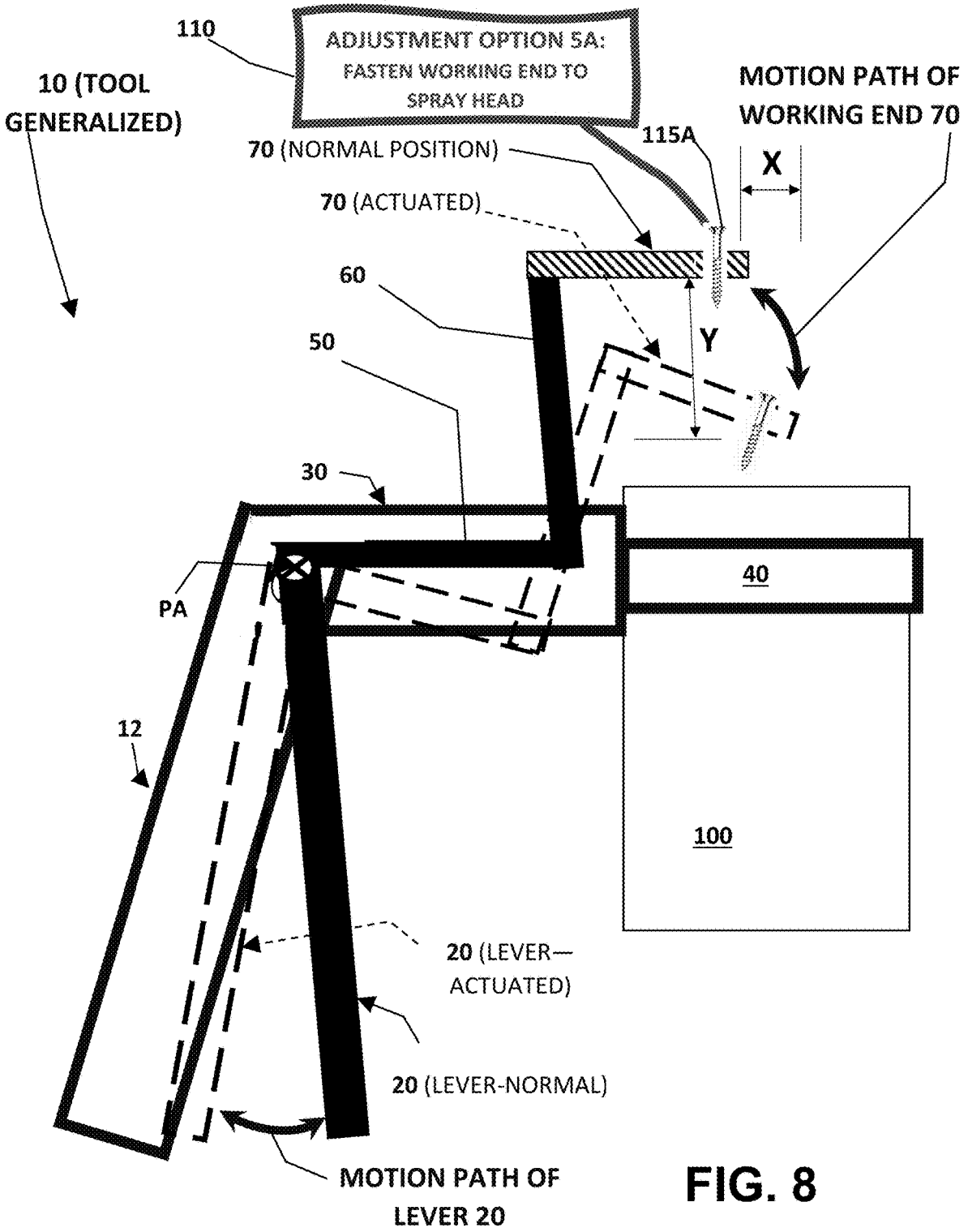
Figure 9:
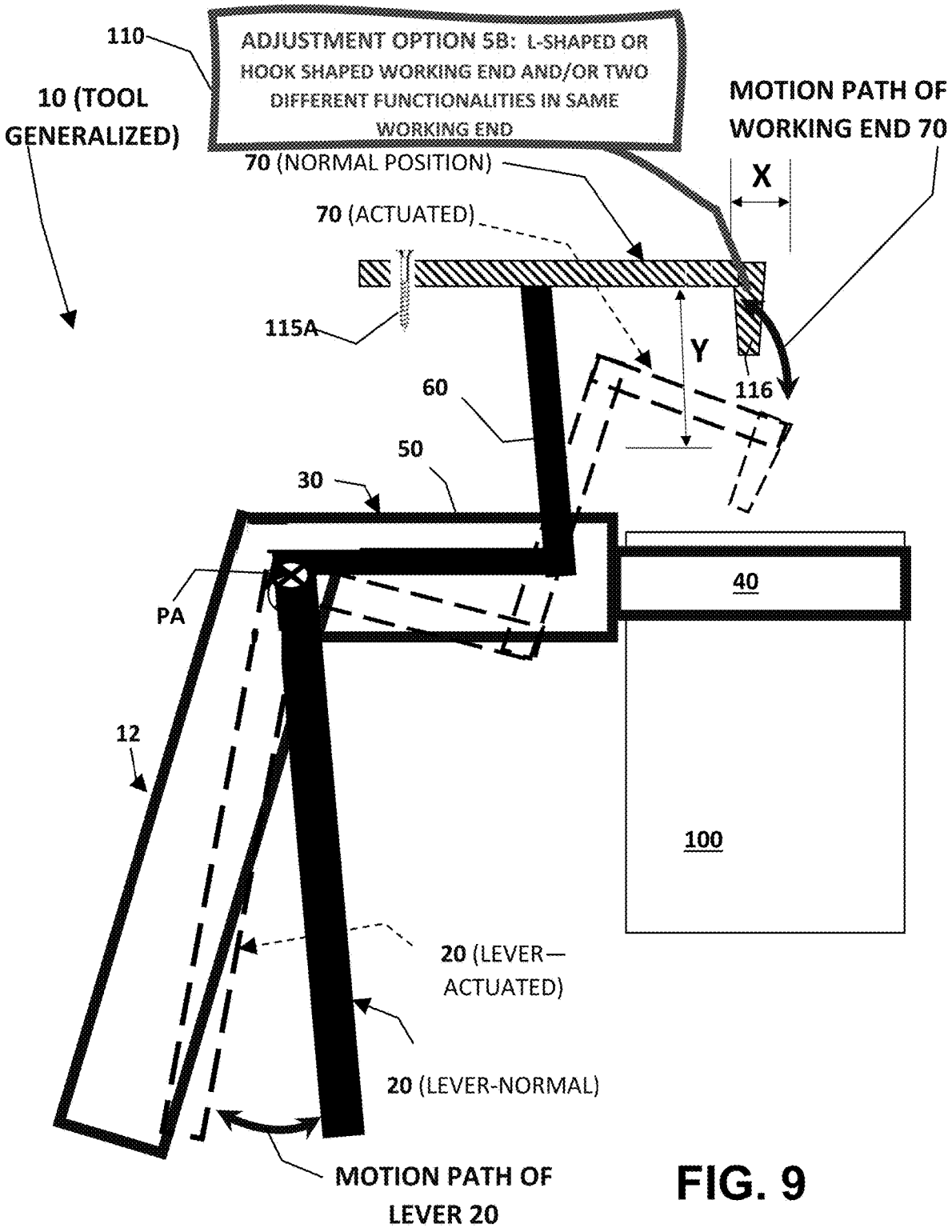
Figure 10:
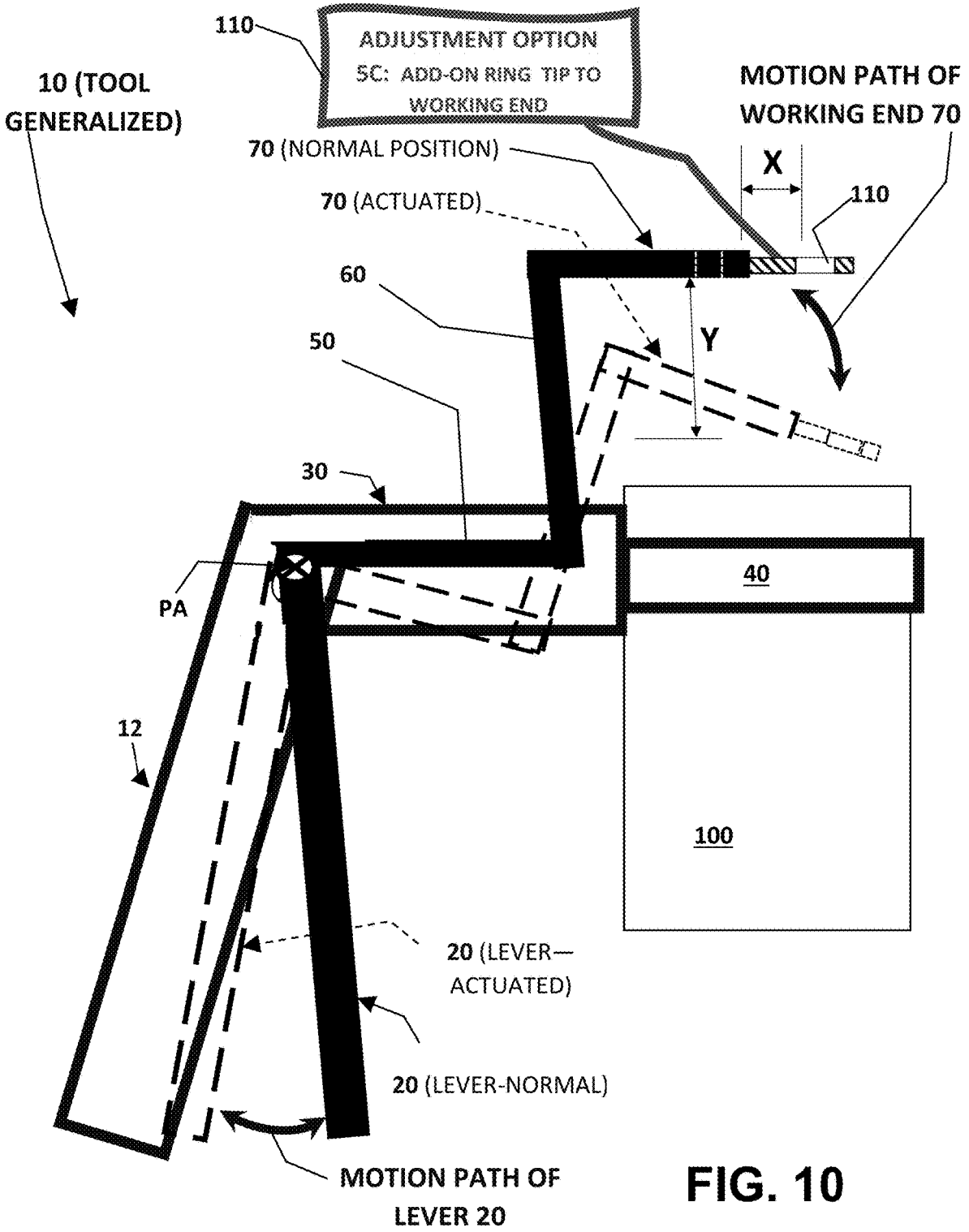

FIGS. 8-10 are highly diagrammatic illustrations of the generalized embodiment of a tool according to FIGS. 1-3, showing additional possible adjustment features that could be implemented individually or in any combination with the tool, and individually or in any combination with the adjustment features of FIGS. 4-7; namely different way to functionalize the working end of the tool for purposes of providing benefits for different sizes, shapes, and types of spray containers.

Figure 11:
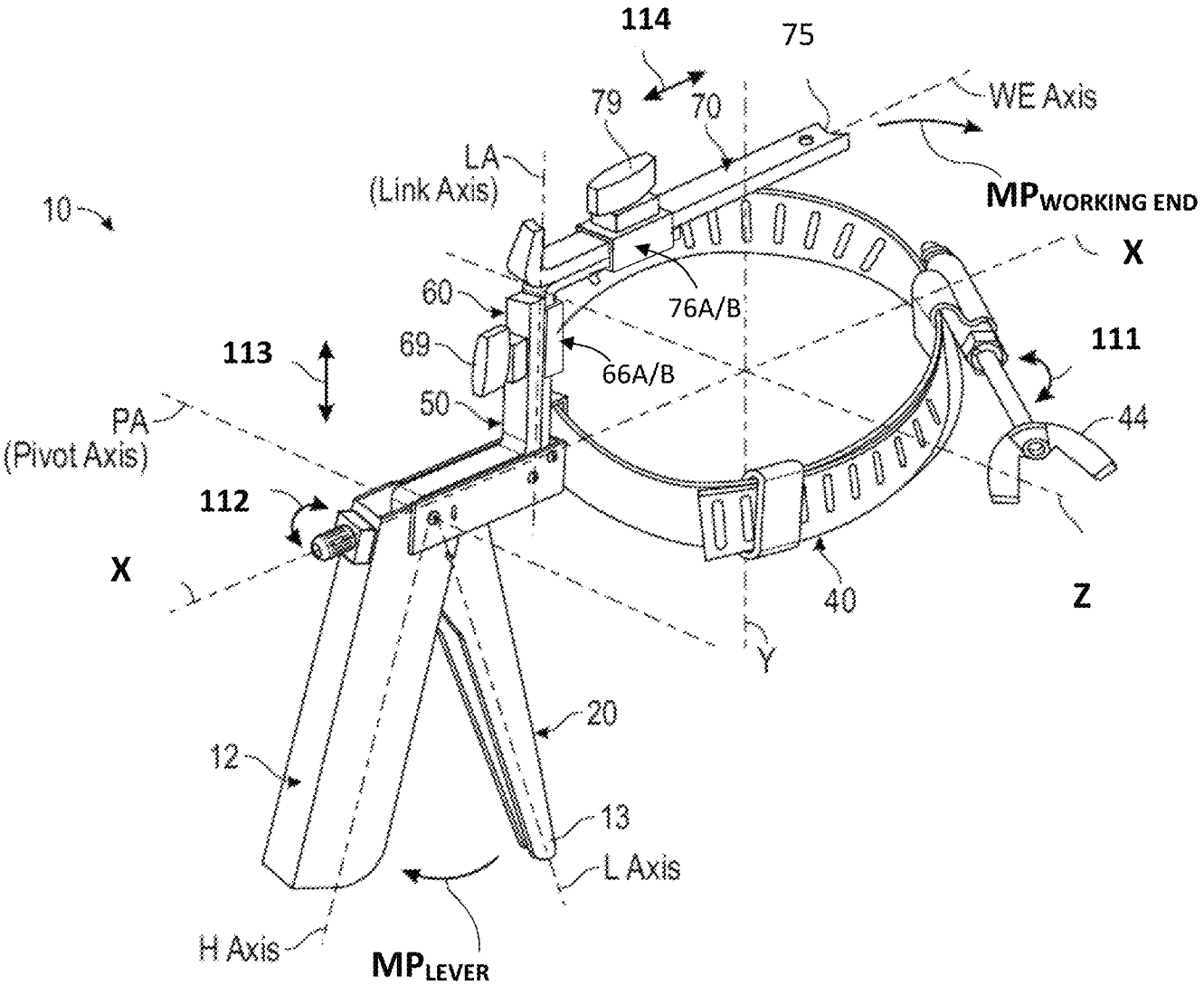

FIG. 11 is a perspective view in normal, unactuated state of a first specific exemplary embodiment of a tool 10 according to one or more aspects of the invention, shown is isolation without it mounted to a spray container.

Figures 12A, 12B, 12C:
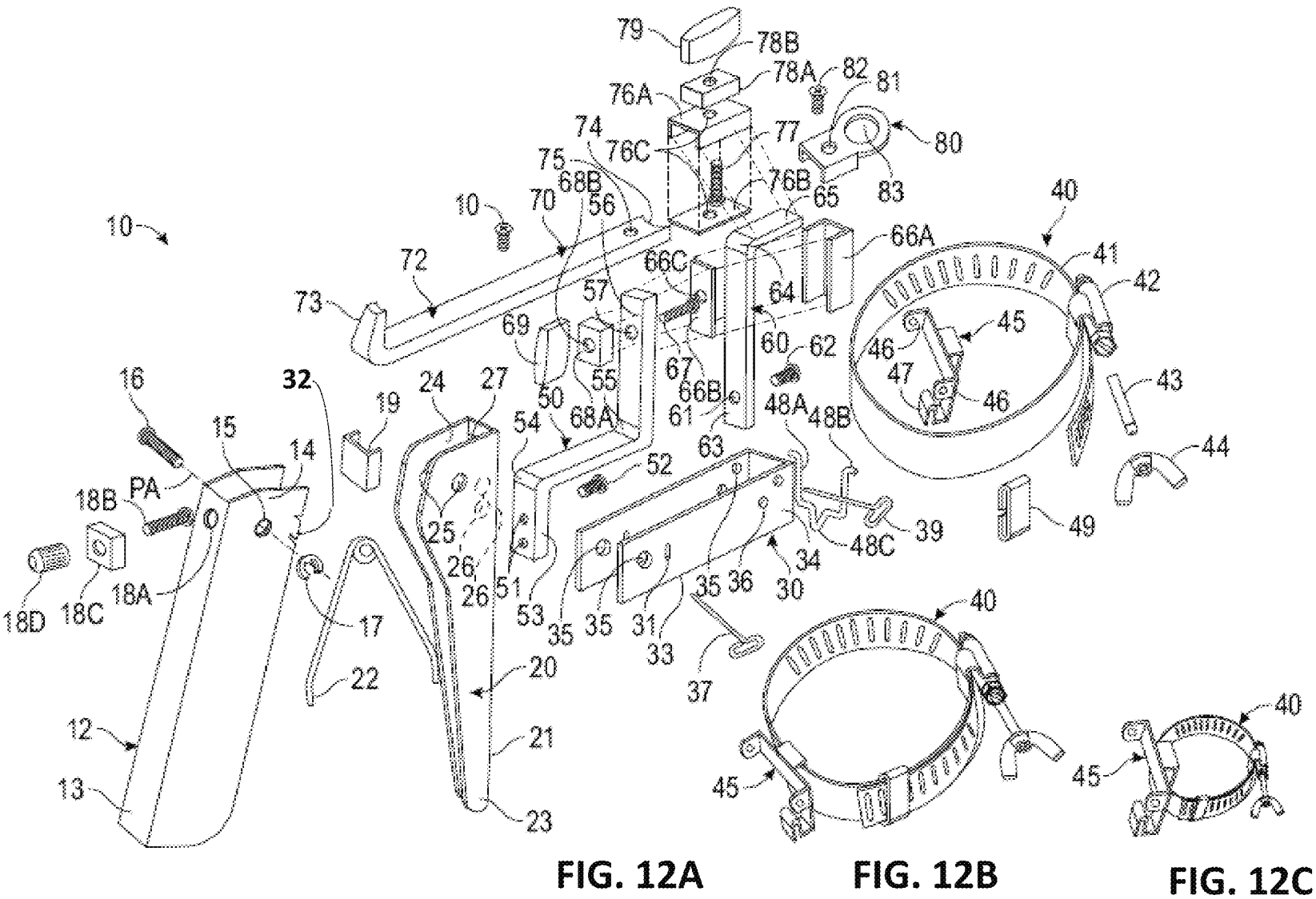
Figure 12D:
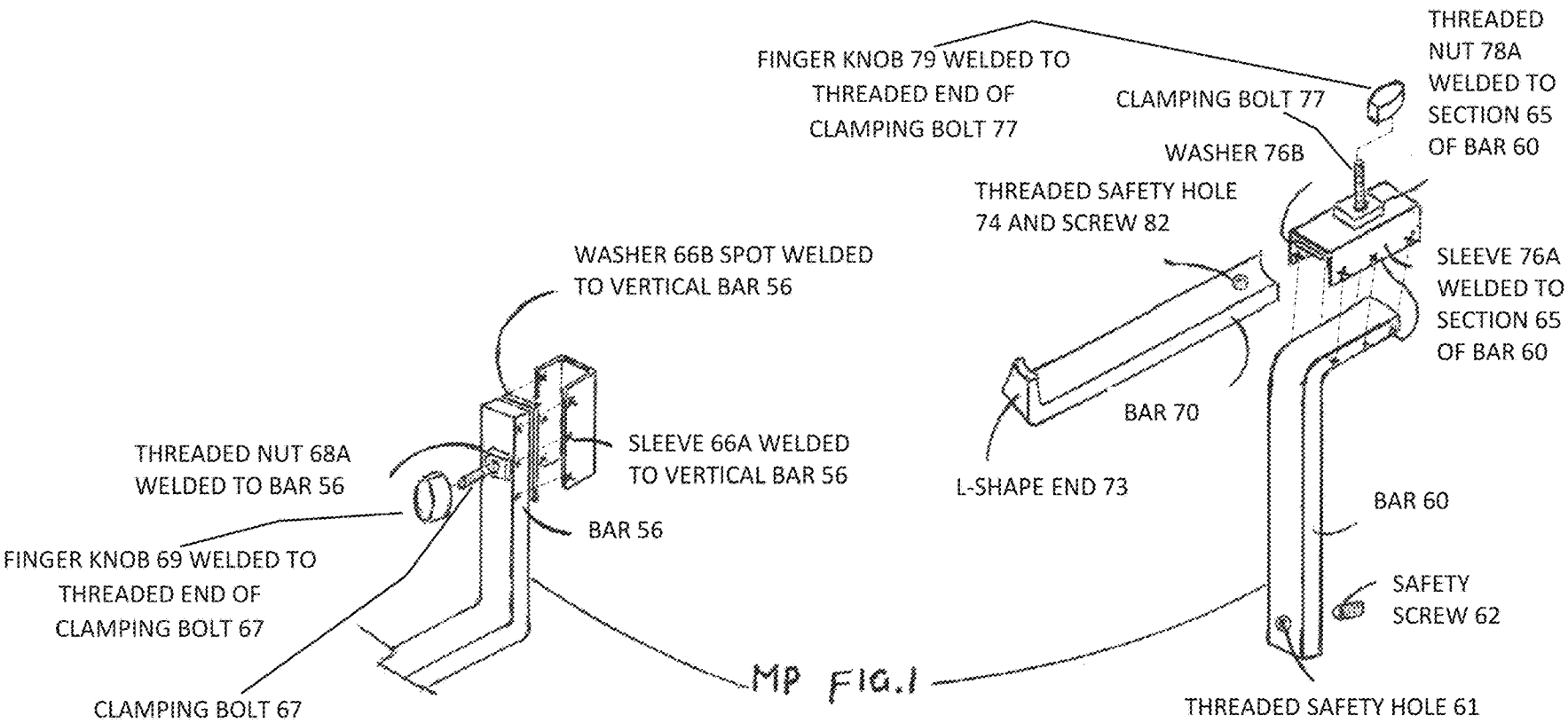

FIG. 12A is an exploded view of FIG. 11, illustrating one example of components to fabricate and assemble a tool 10. FIGS. 12B and 12C show alternative views of container clamping members 40. FIG. 12D is a diagrammatic view of more details about how sleeves 66A and 76A are assembled and operated.

Figure 13B:
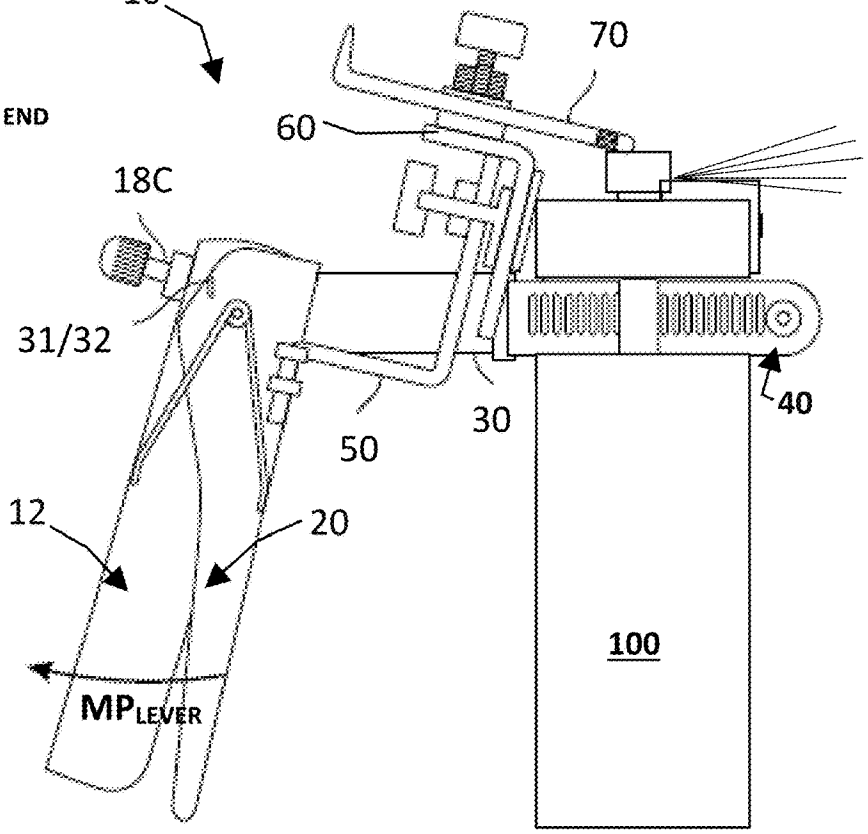
Figure 13A:
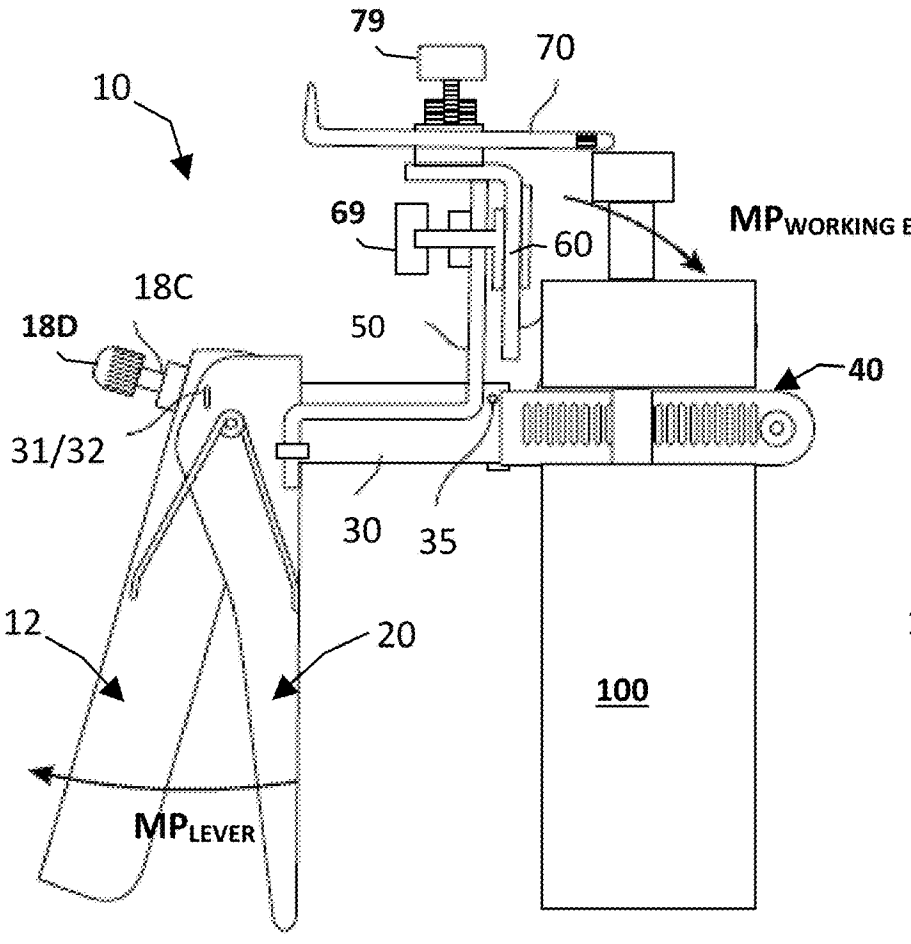

FIG. 13A is a side elevation of the tool 10 of FIG. 11 in normal state (non-actuated state) and mounted to one type of spray container. FIG. 13B shows tool 10 in an actuated state where its hand-operated lever 20 is pivoted along a lever motion path $MP_{LEVER}$ into its handle 12, and a distal tip 74 of working end 70 follows a proportional curved working end motion path $MP_{WORKING\ END}$ to provide force at the dispensing head 104 of a container 100.

Figure 13C:
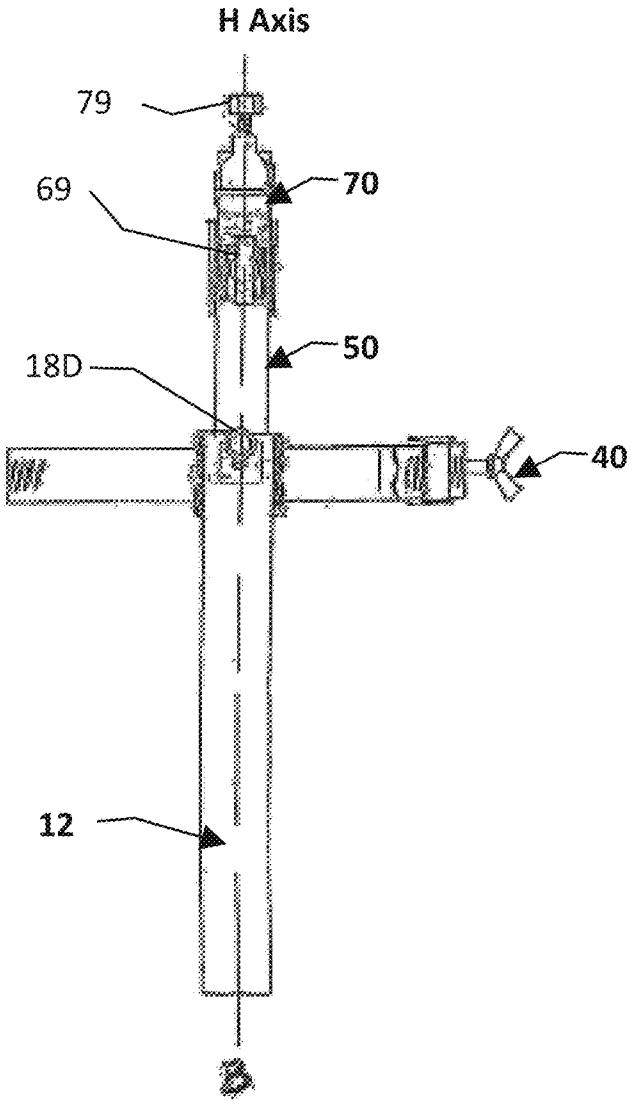
Figure 13F:
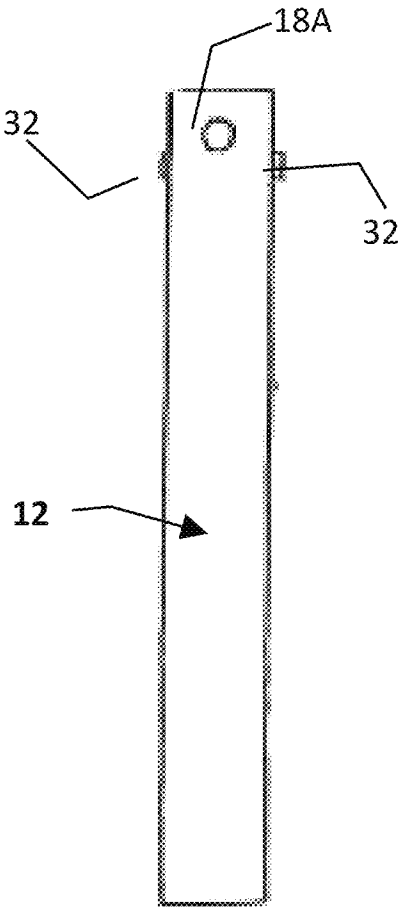
Figure 13E:
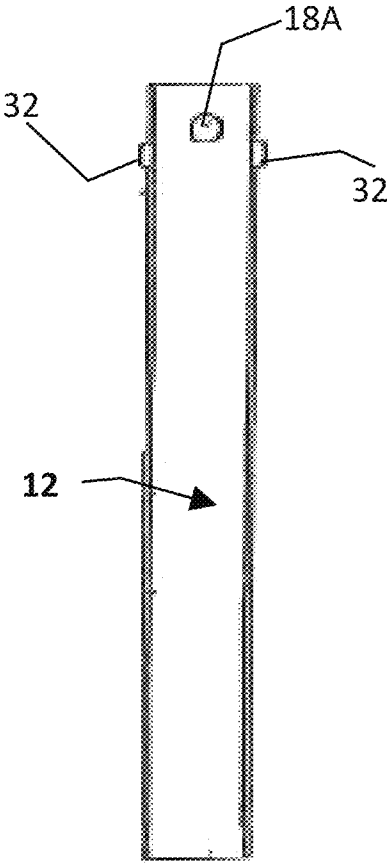
Figure 13D:
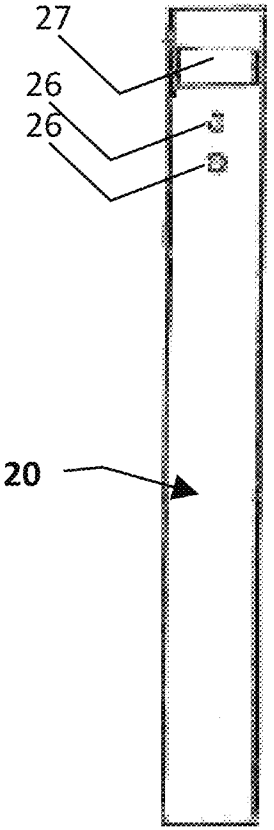

FIG. 13C is a back elevation view of tool 10 of FIG. 11. FIGS. 13D, E and F are isolated views of the handle 12, and opposite sides of lever 20, respectively, of FIG. 13C.

Figure 14B:
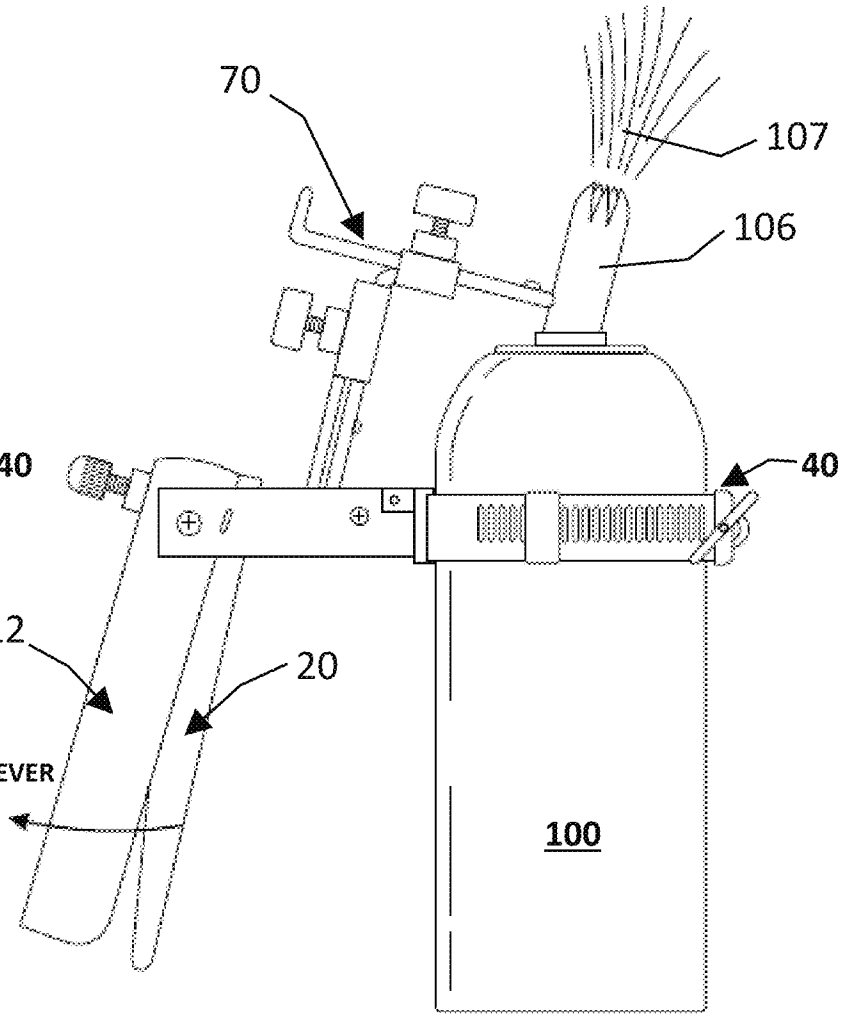
Figure 14A:
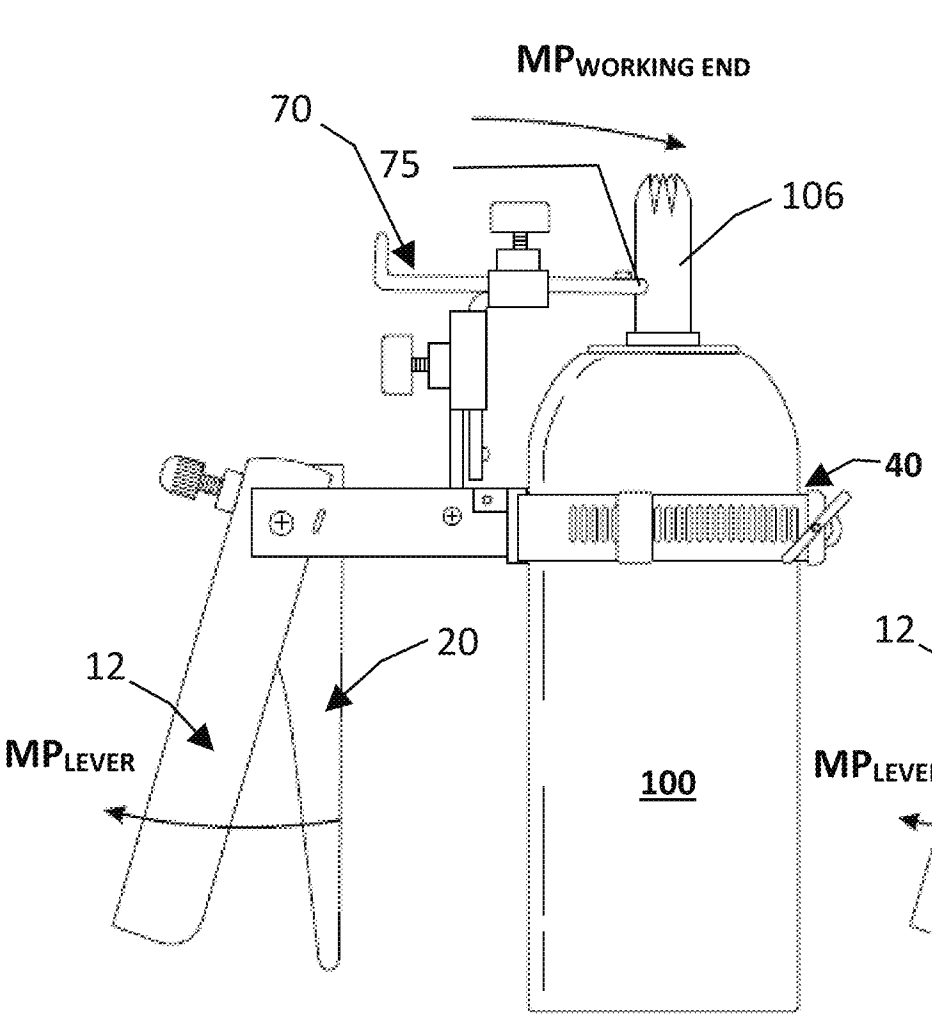

FIGS. 14A and B show non-actuated and actuated states of tool 10 of FIG. 11 for proportional working end motion $MP_{WORKING\ END}$ to push nozzle 106 of a whipped cream aerosol dispenser 100 sideways in response to the lever motion path $MP_{LEVER}$ to selectively dispense its contents.

Figure 15A:
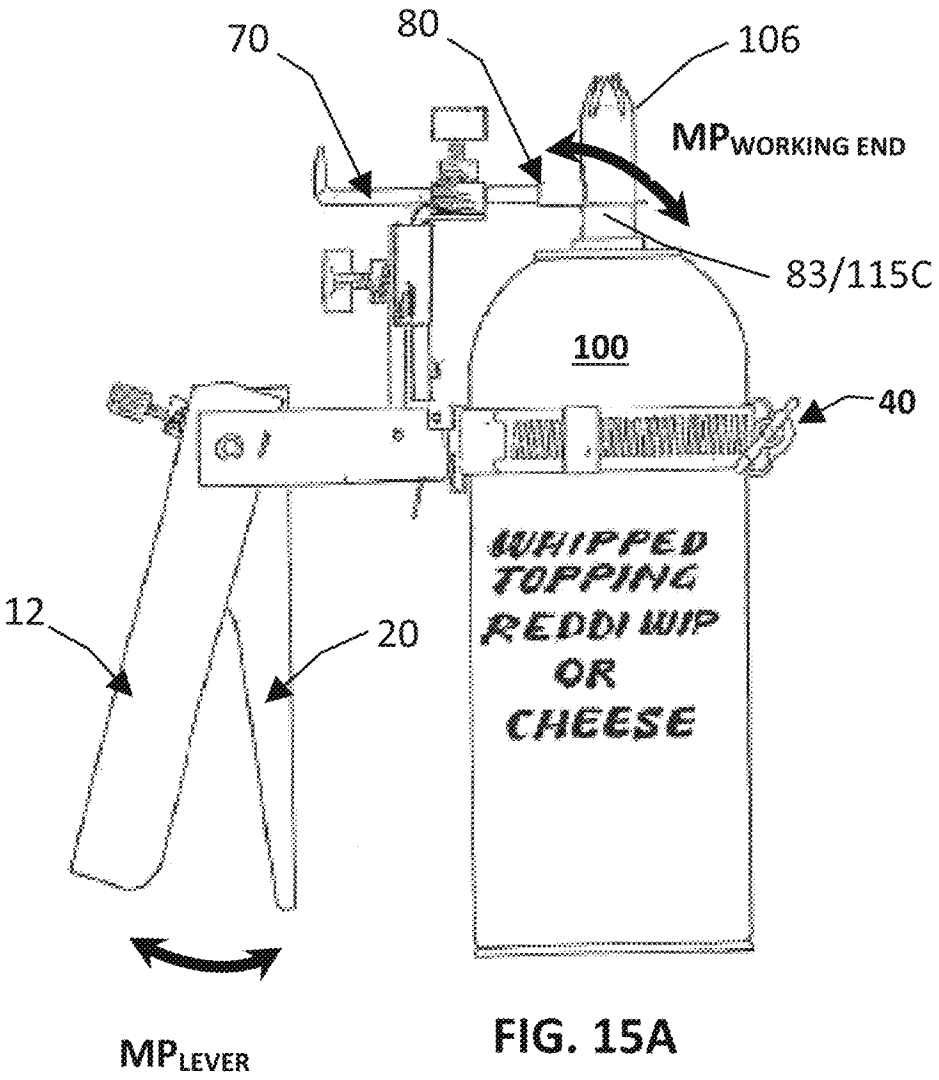
Figure 15B:
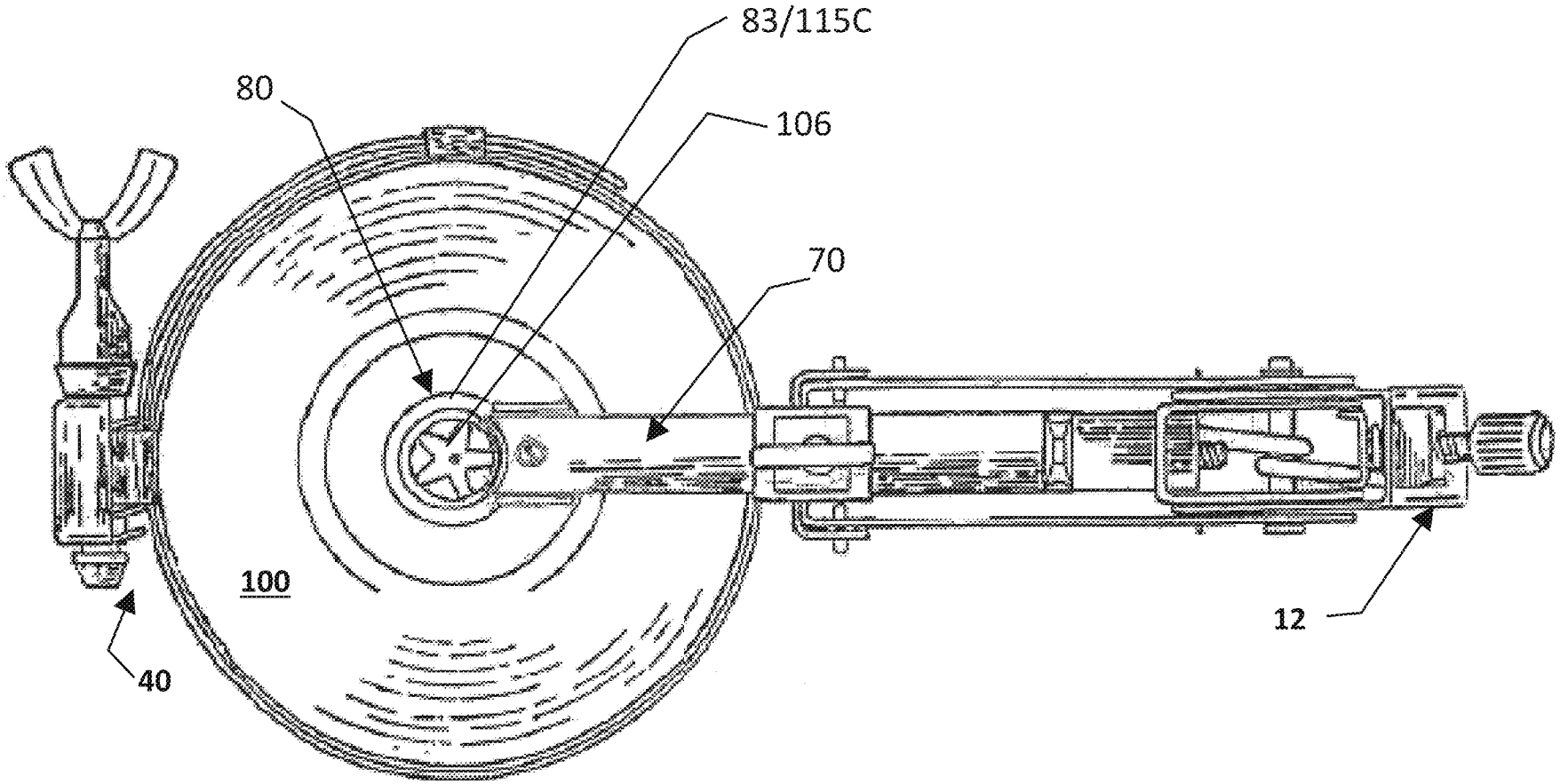
Figure 17:
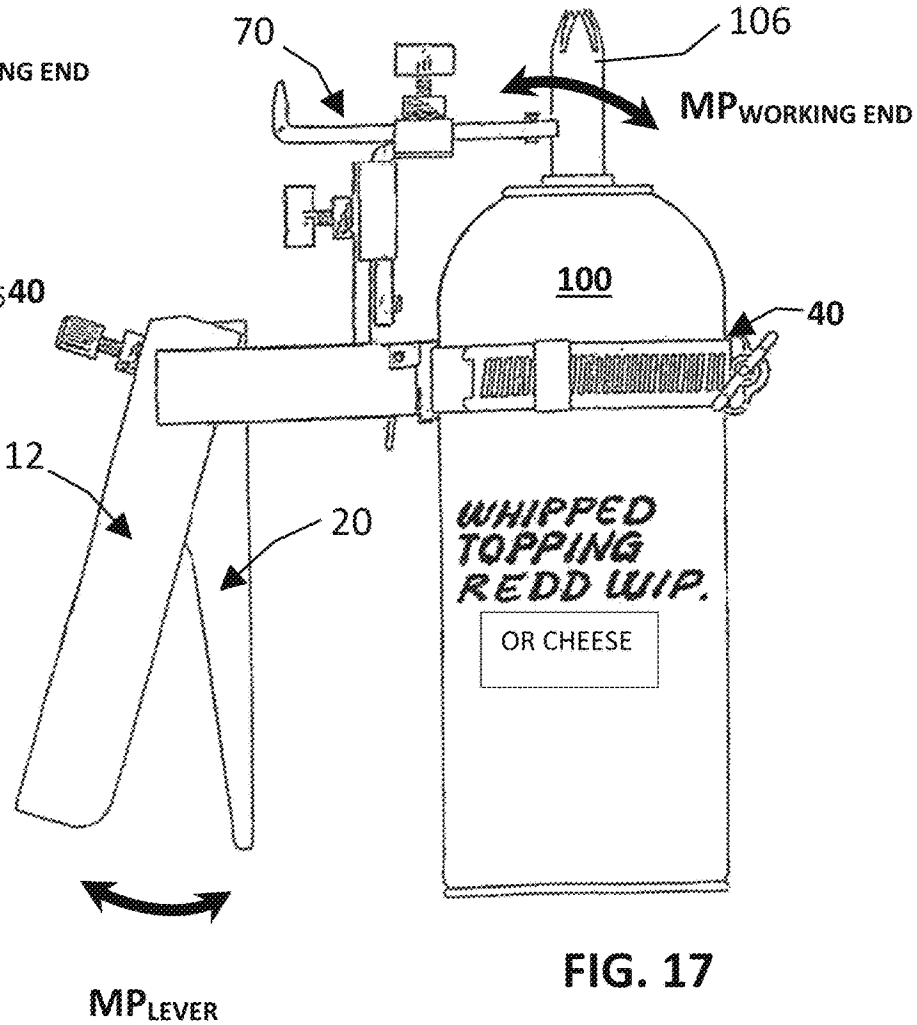
Figure 16:
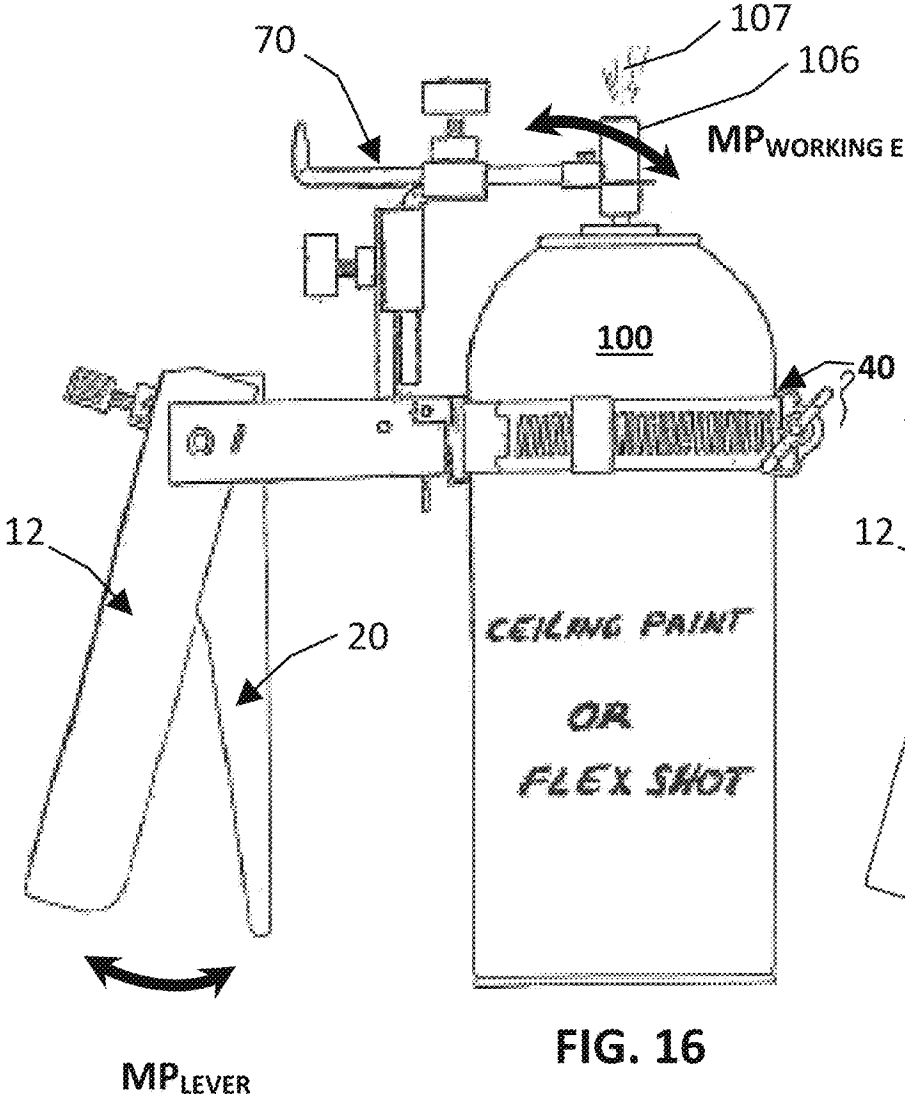
Figure 19:
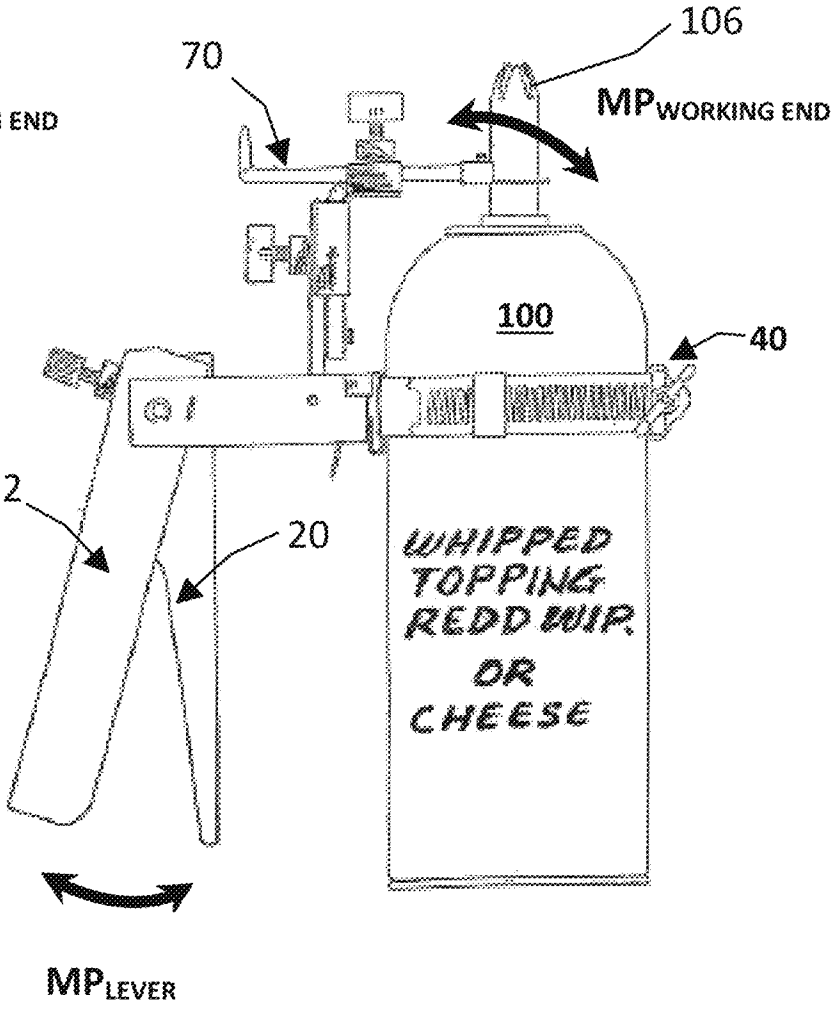
Figure 18:
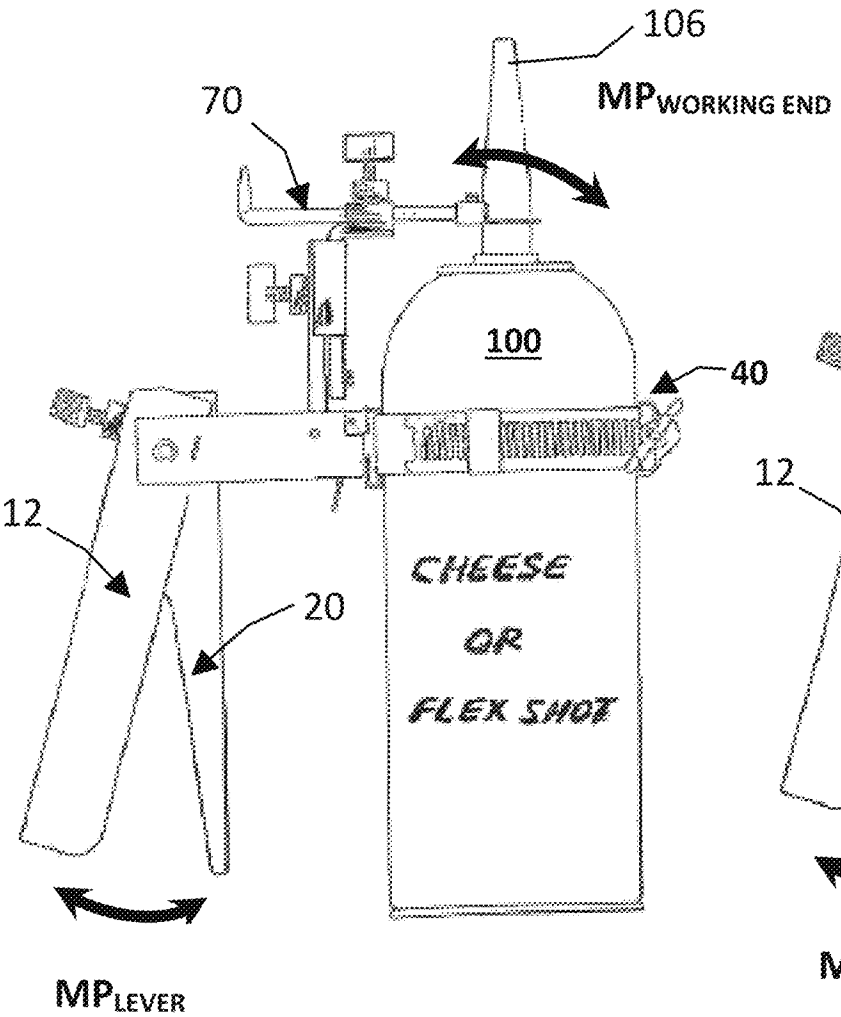

FIG. 15A shows the same whipped cream aerosol container of FIGS. 14A and B, but with an add-on tip member 115C for working end 70. FIG. 15B is a top view of FIG. 15A.

FIGS. 16, 17, 18 and 19 are non-actuated states using the same basic tool 10 of FIG. 11 with one of the working ends of the embodiments of FIG. 14A or FIG. 15A for a variety of different types of lateral motion aerosol dispensing heads for different types of substances (e.g. paint or coatings, whipped cream, cheese whip, and the like), and shows how the working end 70 can be adjusted or functionalized relative the nozzle of each of the versions. Spray would be actuated from any of the different containers with the motion paths illustrated in FIGS. 14A-B.

Figure 20A:
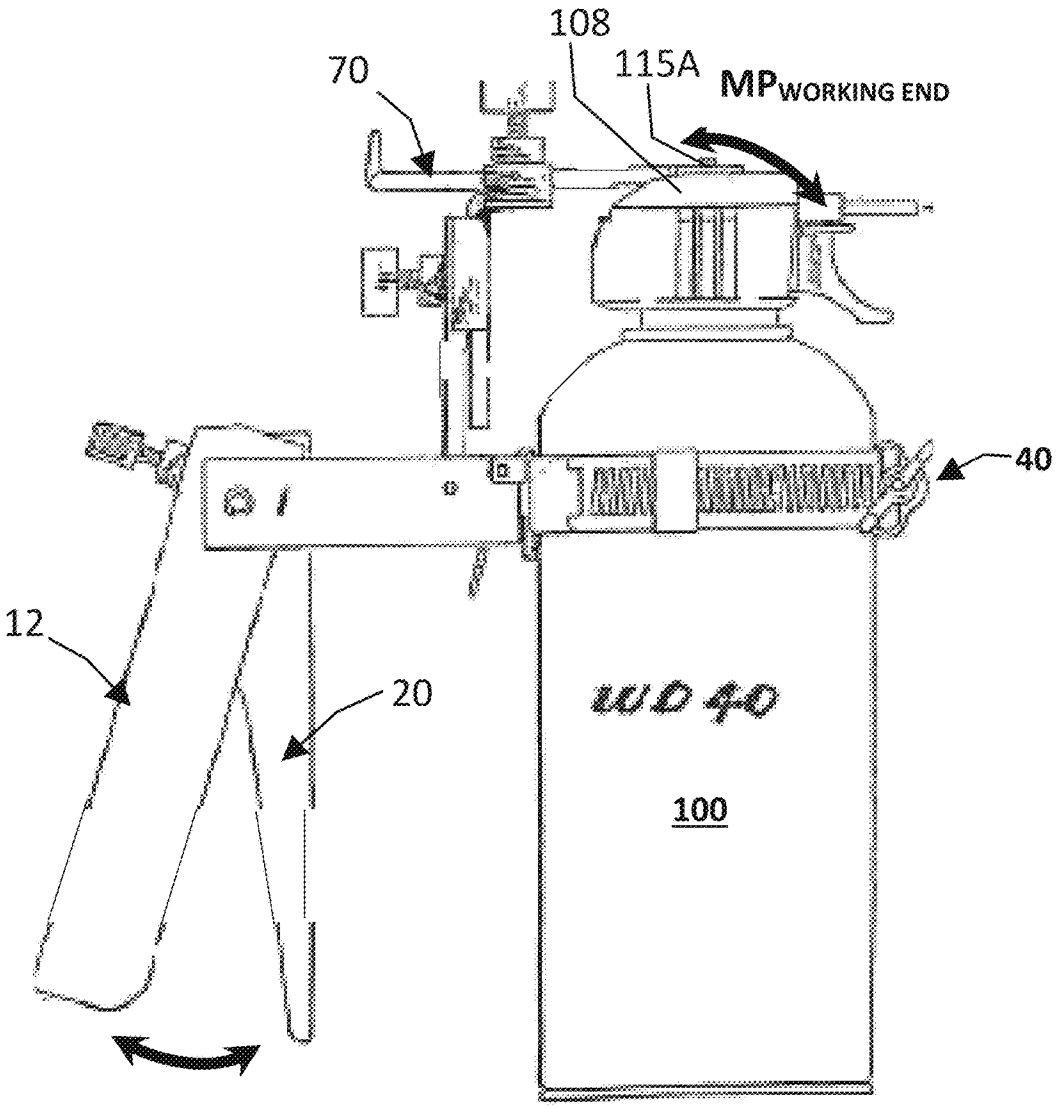
Figure 20B:
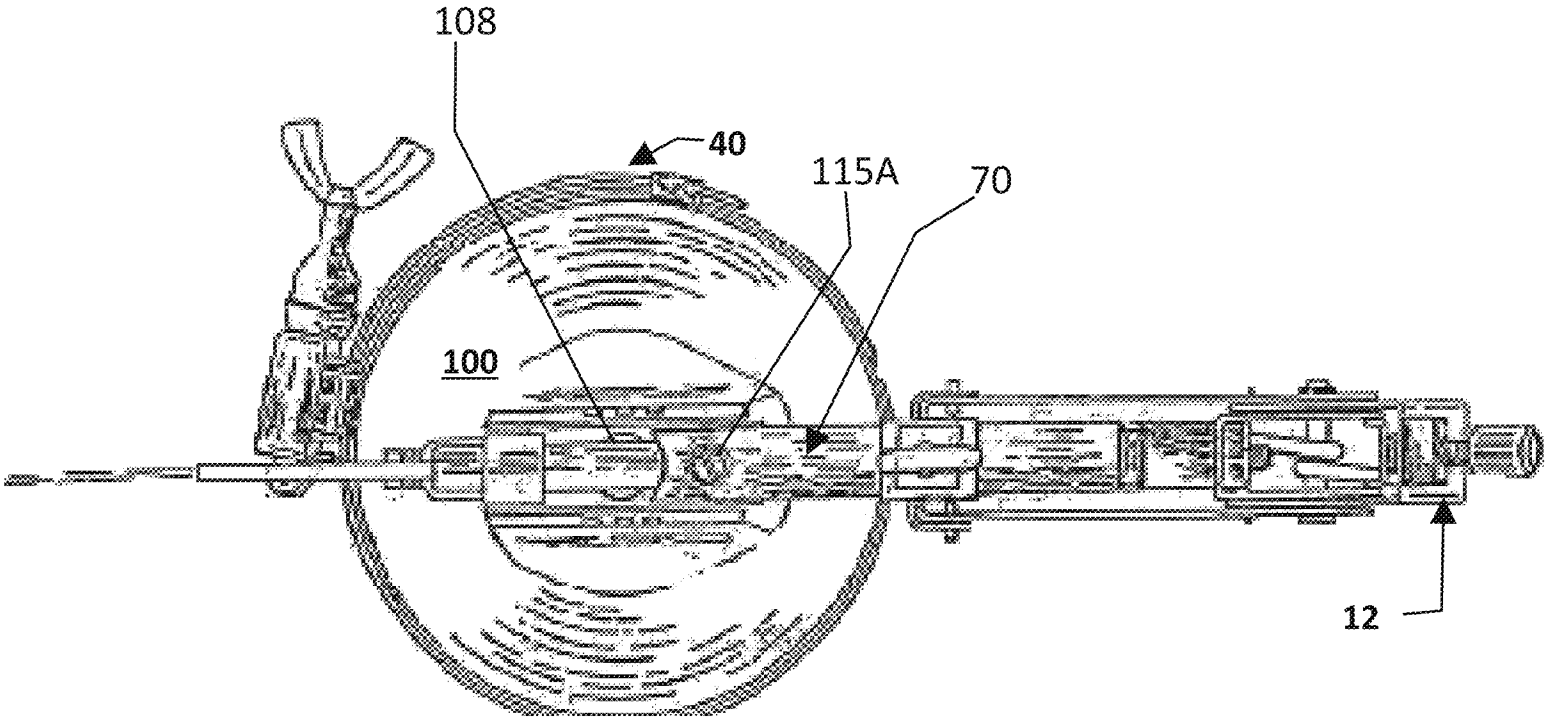
Figure 20C:
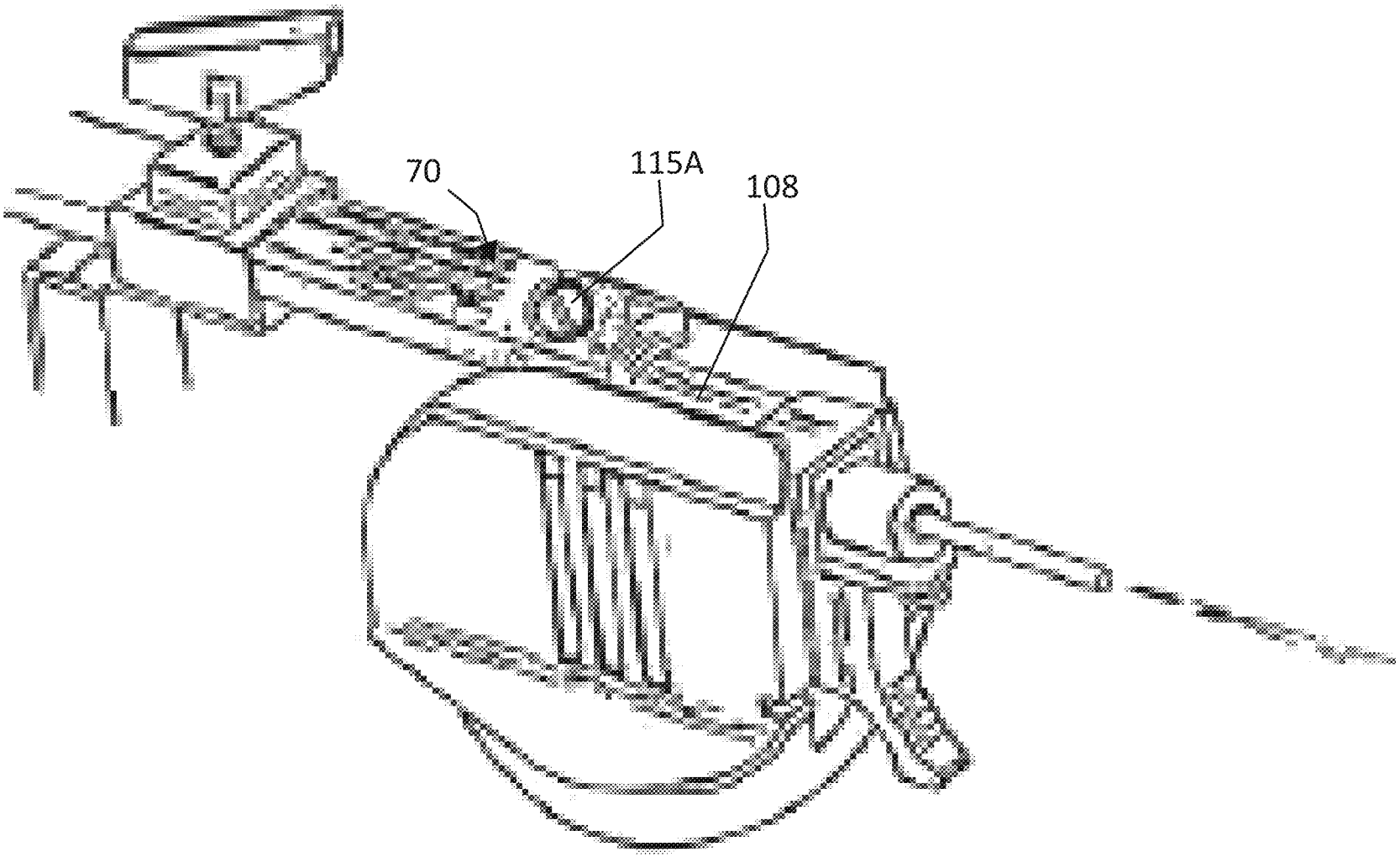

FIG. 20A-C shows how the same basic tool 10 of FIG. 11 can be adjusted for use with a finger-trigger-type pump on a non-pressurized container, where the pumping action is lateral to the axis of the container 100. FIG. 20A is a side elevation view. FIG. 20B is an enlarged top plan view of FIG. 20A. FIG. 20C is an enlarged isolated view of the way the working end is attached to the dispensing head of FIG. 20A.

Figure 22:
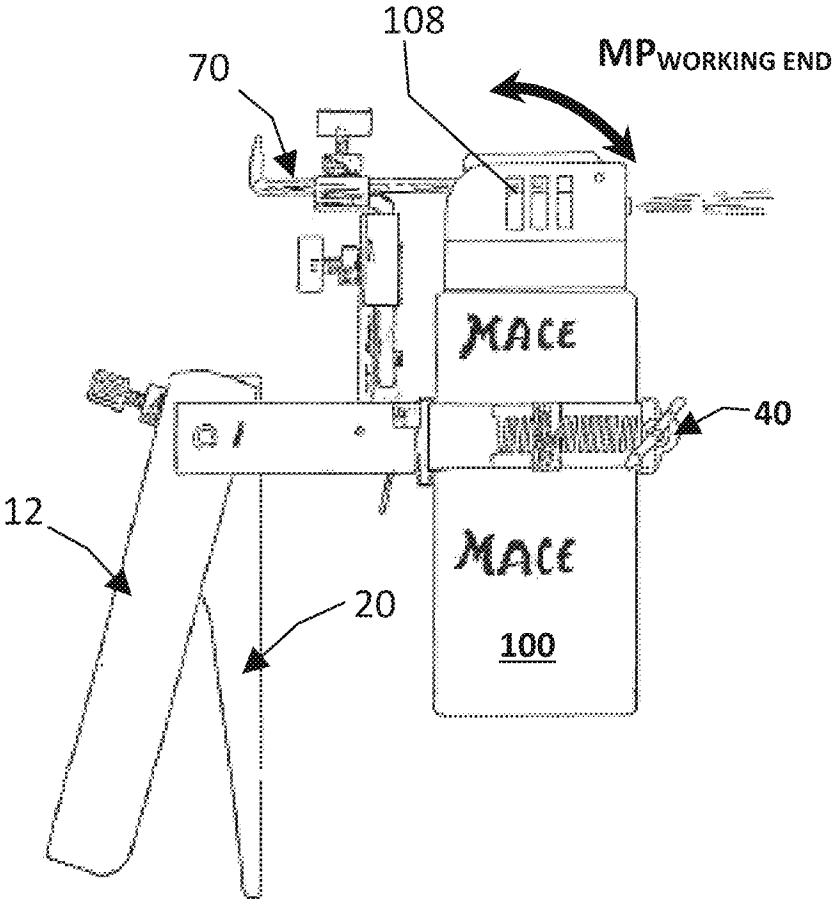
Figure 21:
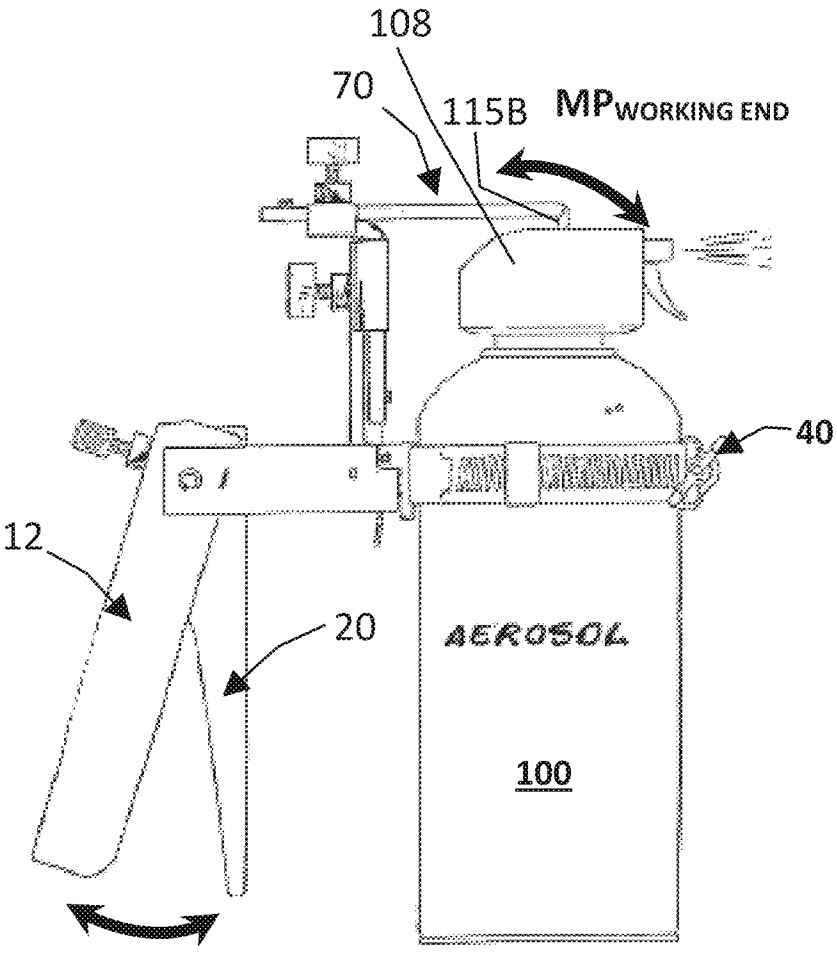

FIGS. 21 and 22 are still further additional illustrations of how the basic tool 10 of FIG. 11 can be adjusted and configured to dispense contents from a variety of containers that utilize lateral motion to spray out the contents, whether aerosol or not.

Figure 23A:
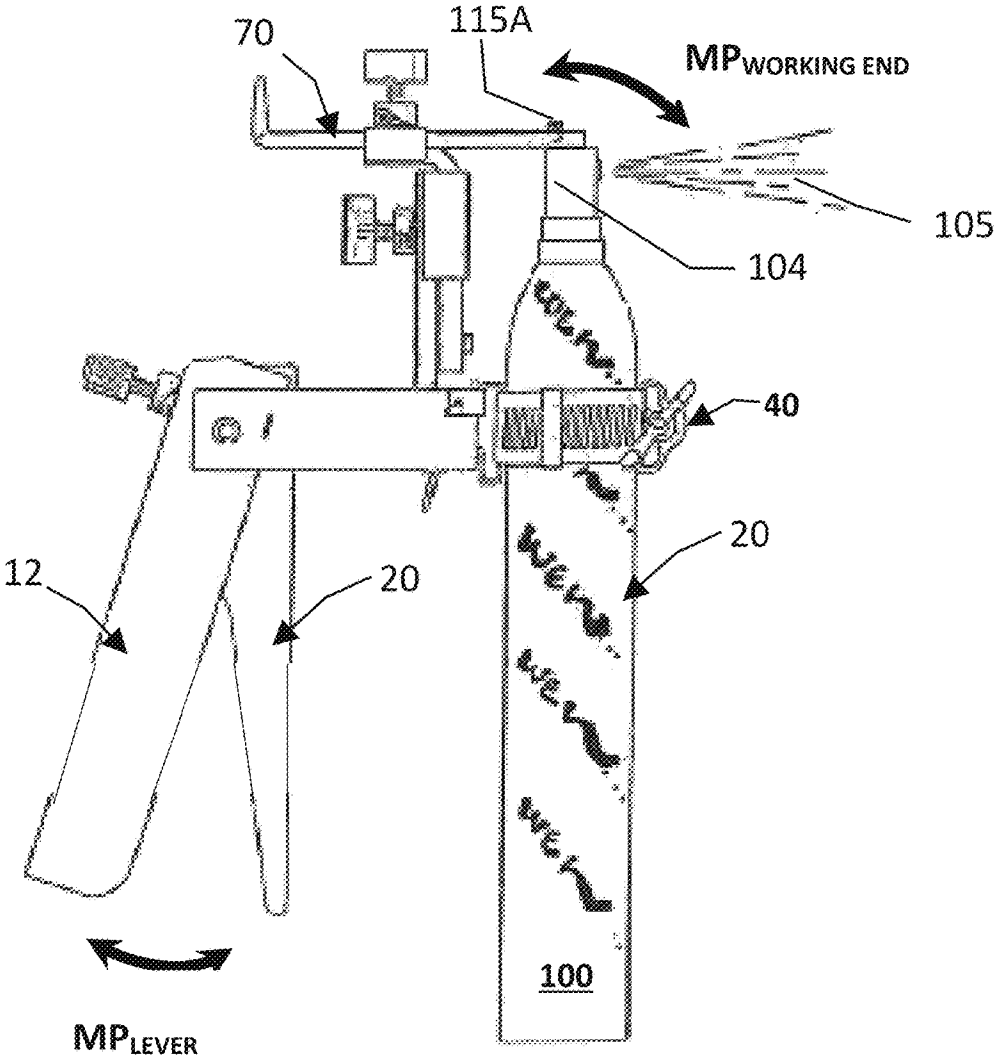
Figure 23B:
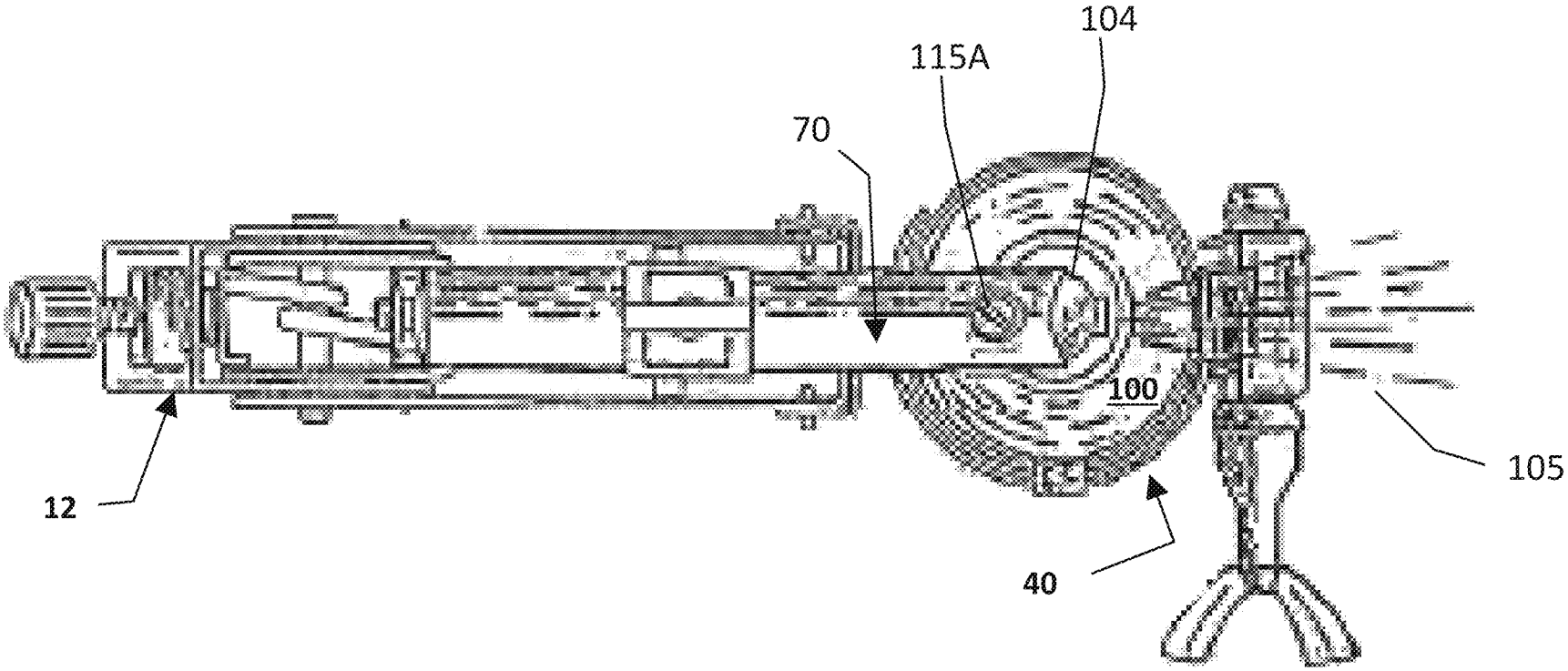
Figure 25:
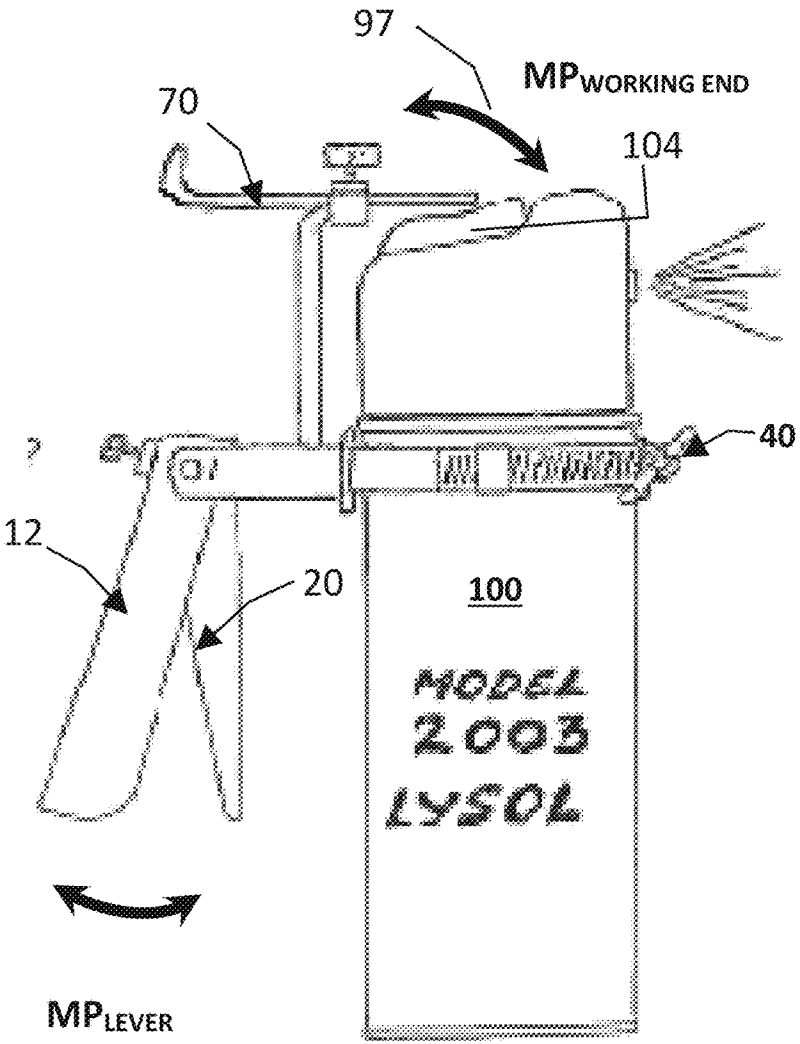
Figure 24:
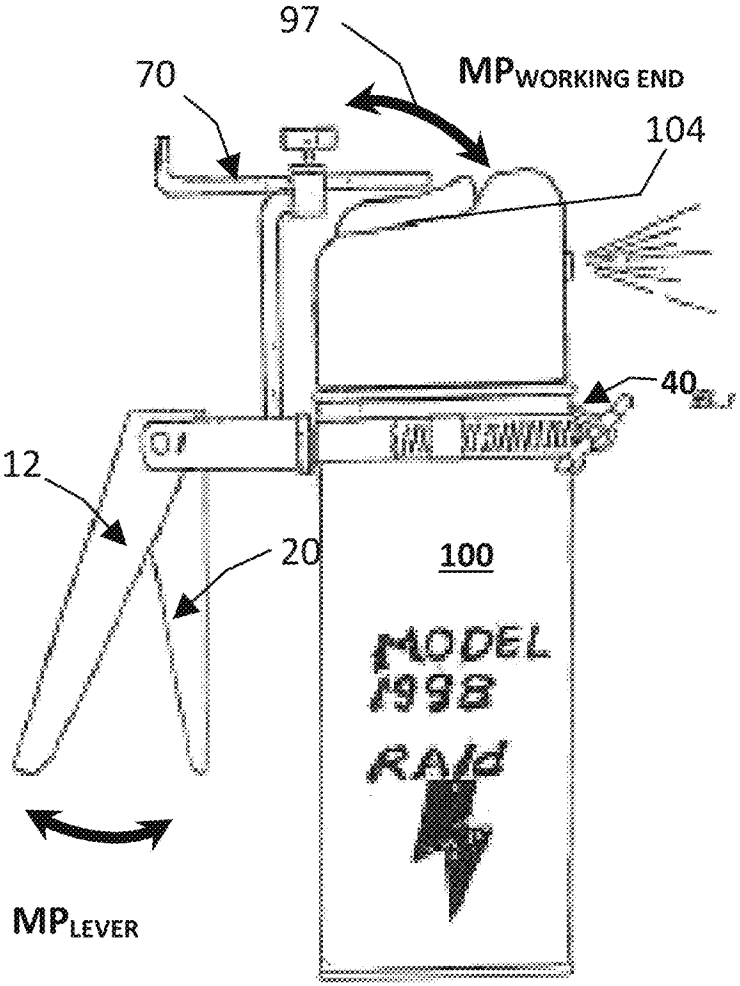
Figure 27:
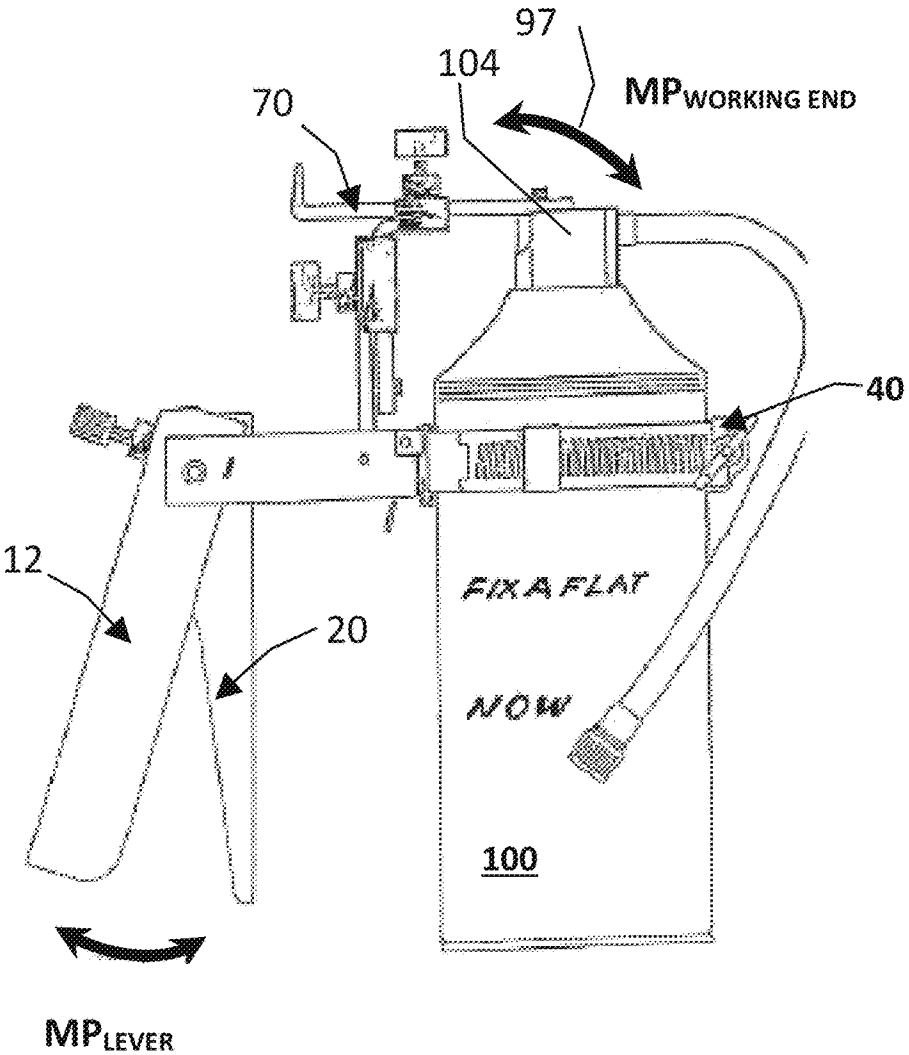
Figure 26:
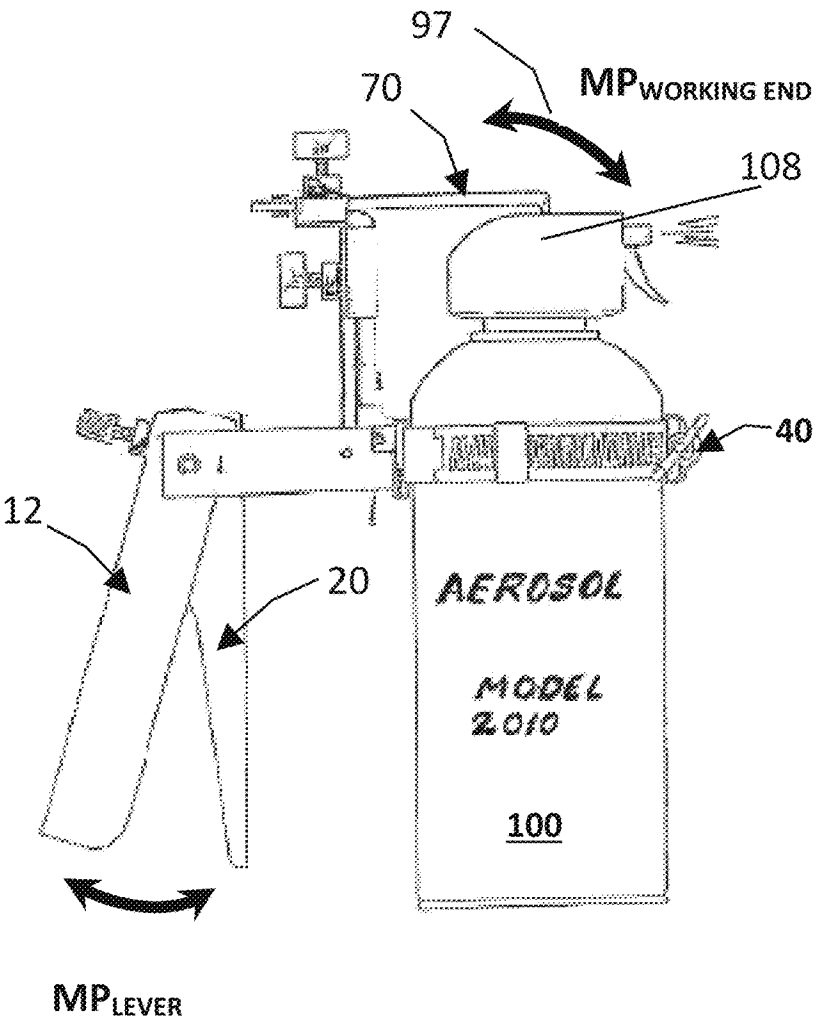
Figure 29:
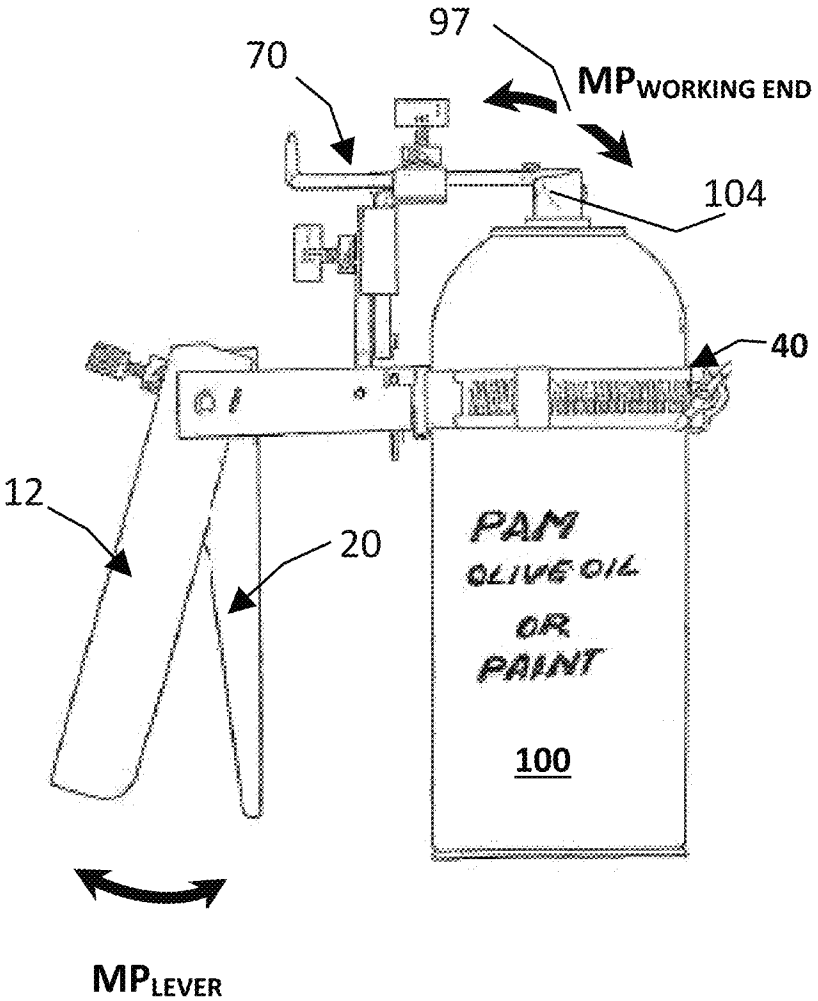
Figure 28:
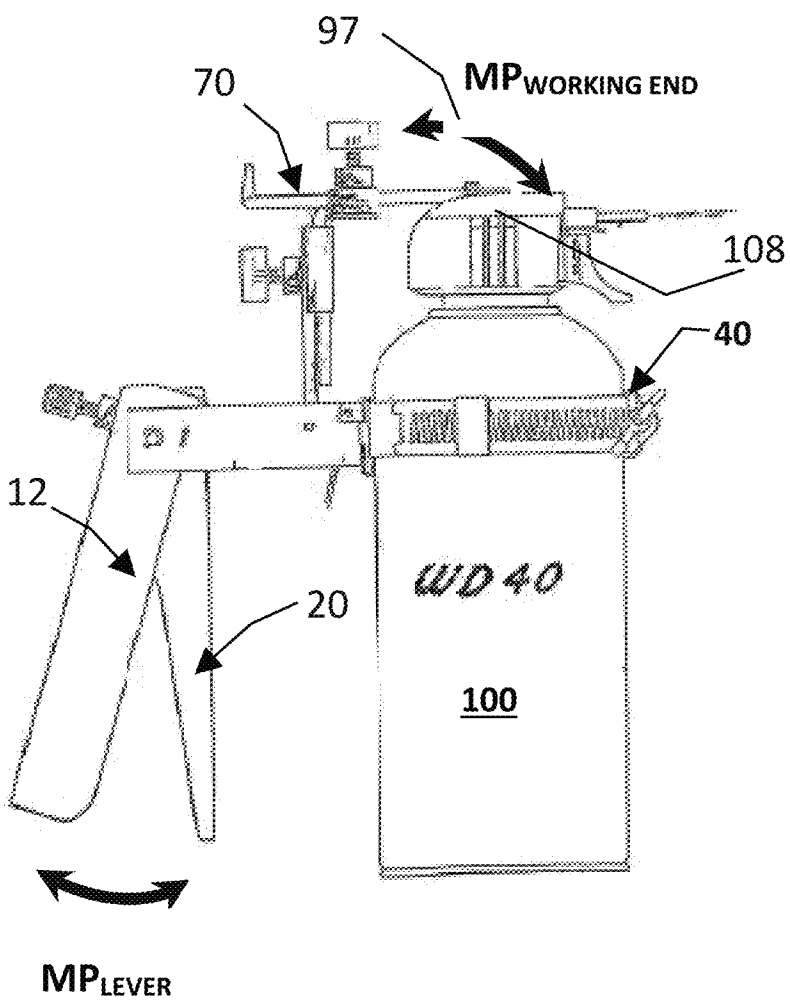
Figure 31:
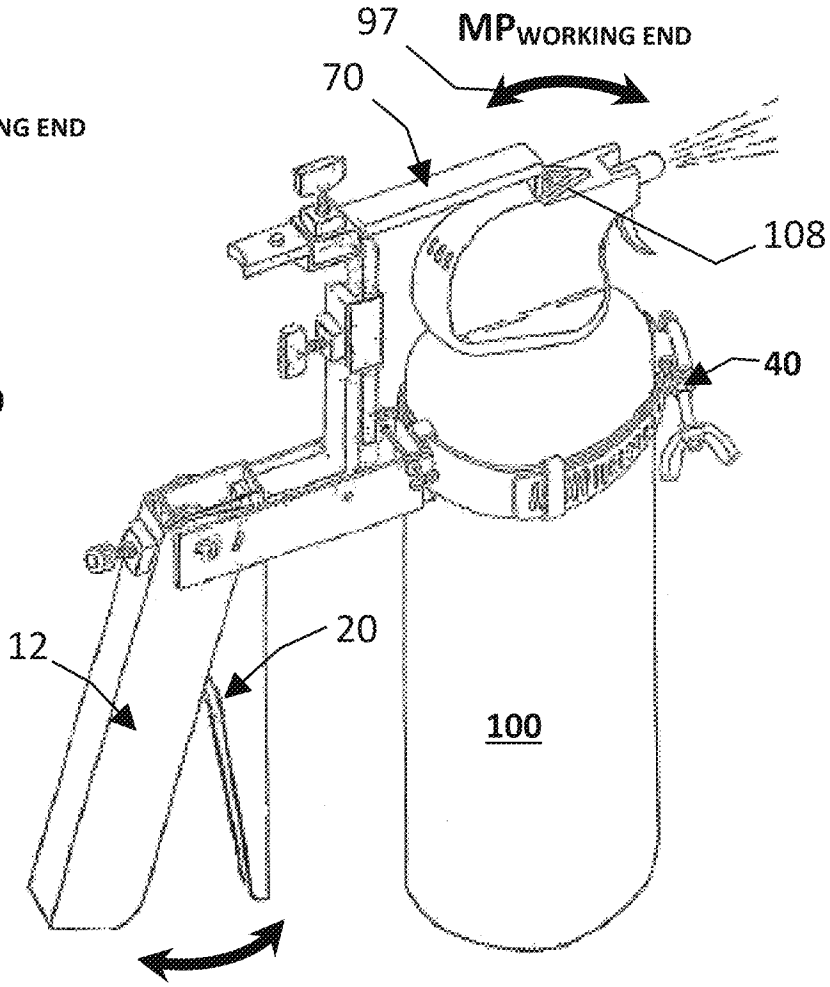
Figure 30:
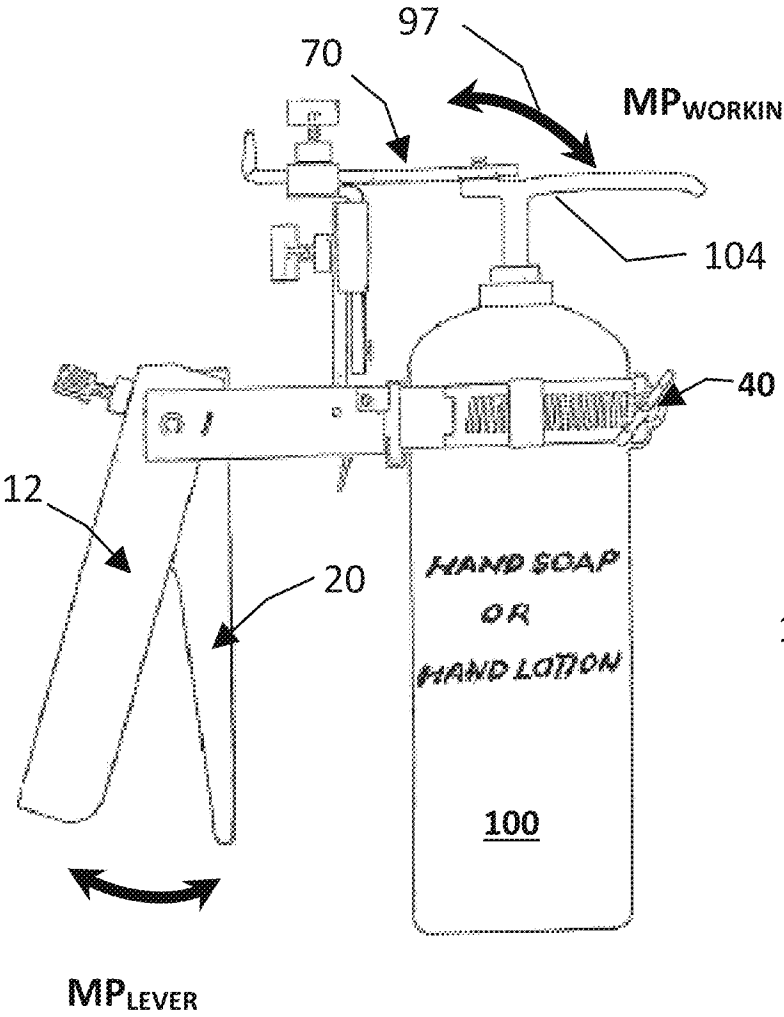
Figure 33:
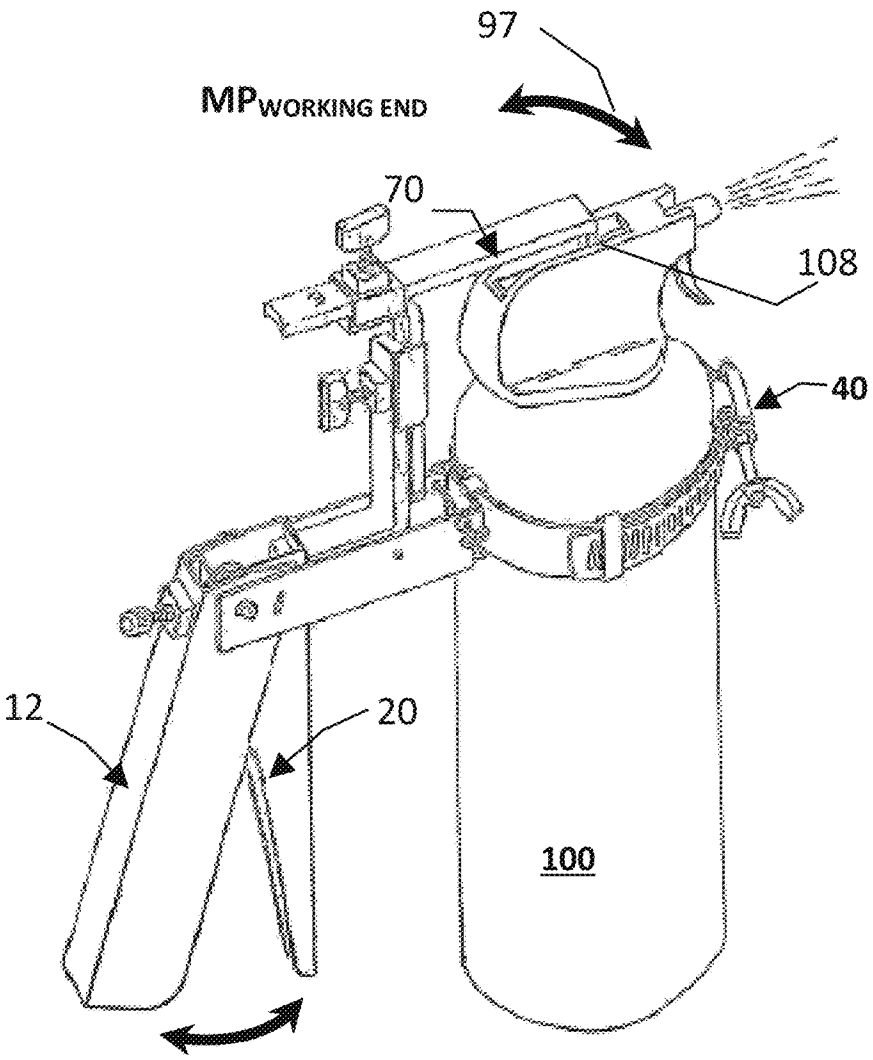
Figure 32:
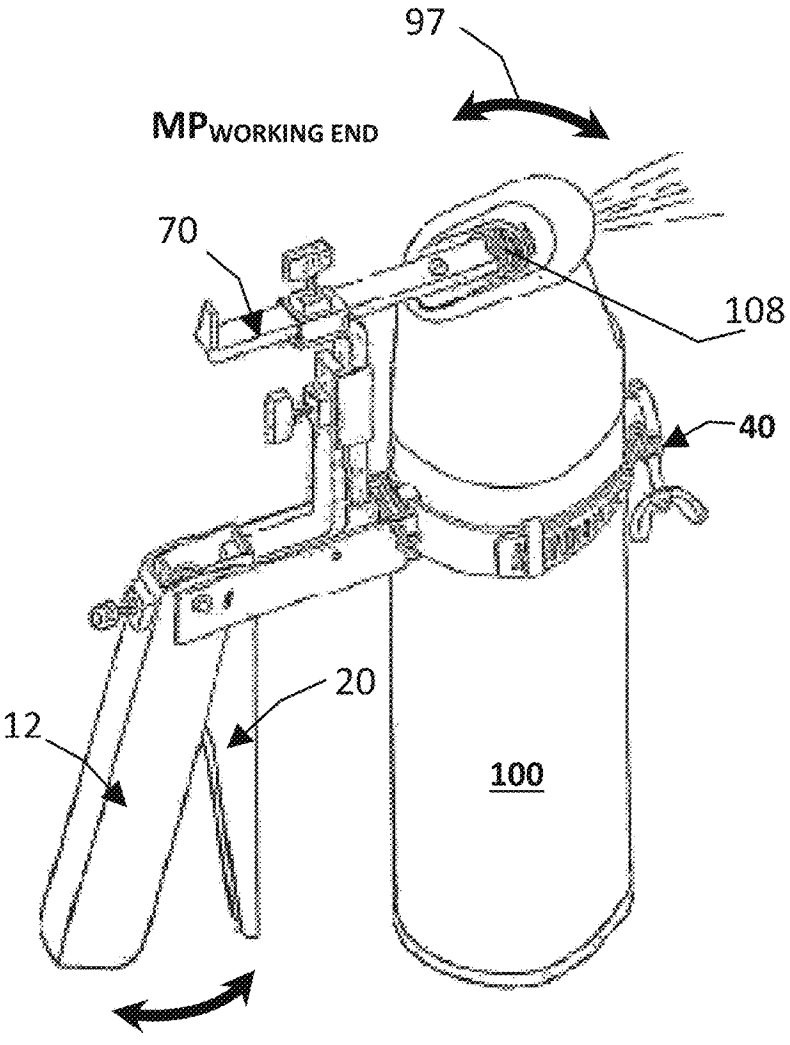
Figure 35:
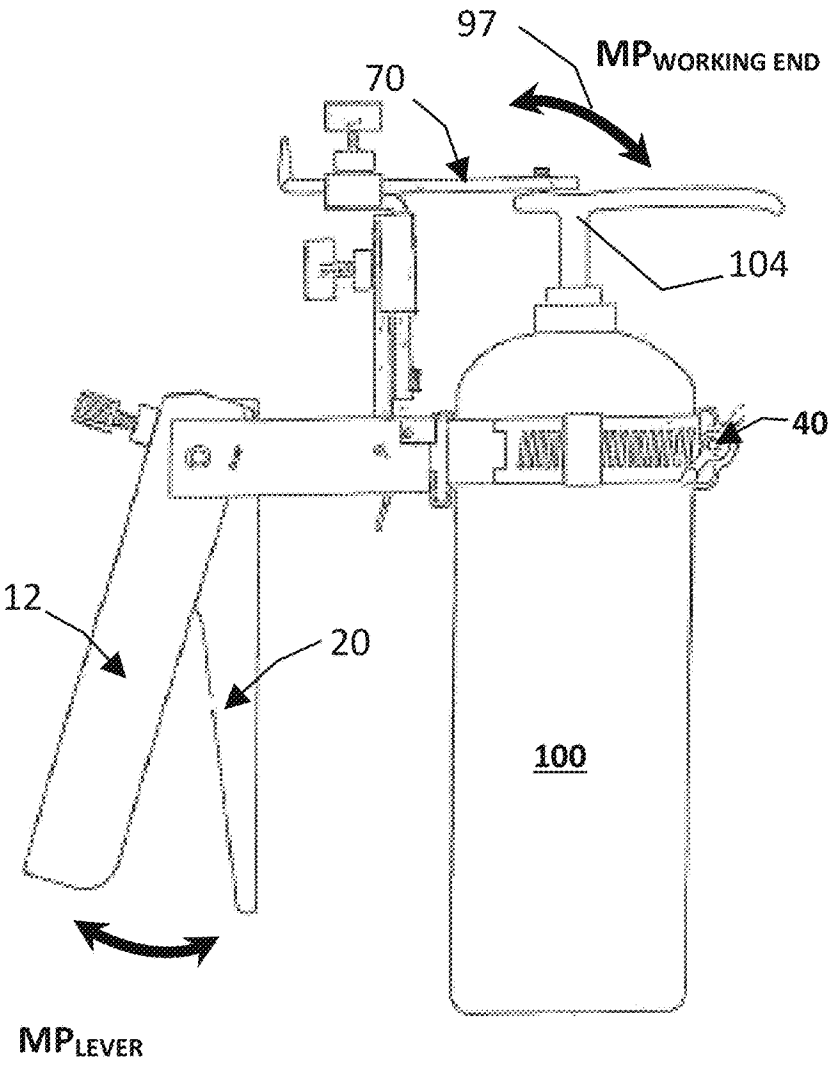
Figure 34:
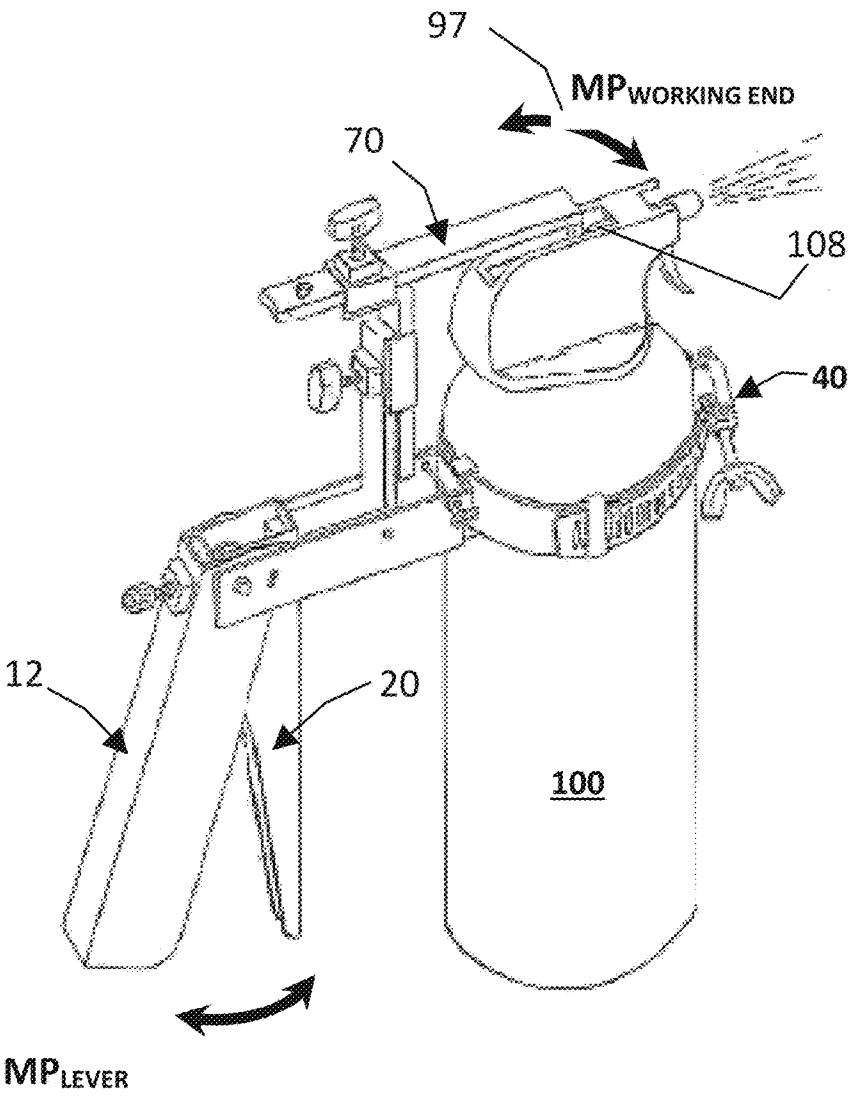
Figure 36A:
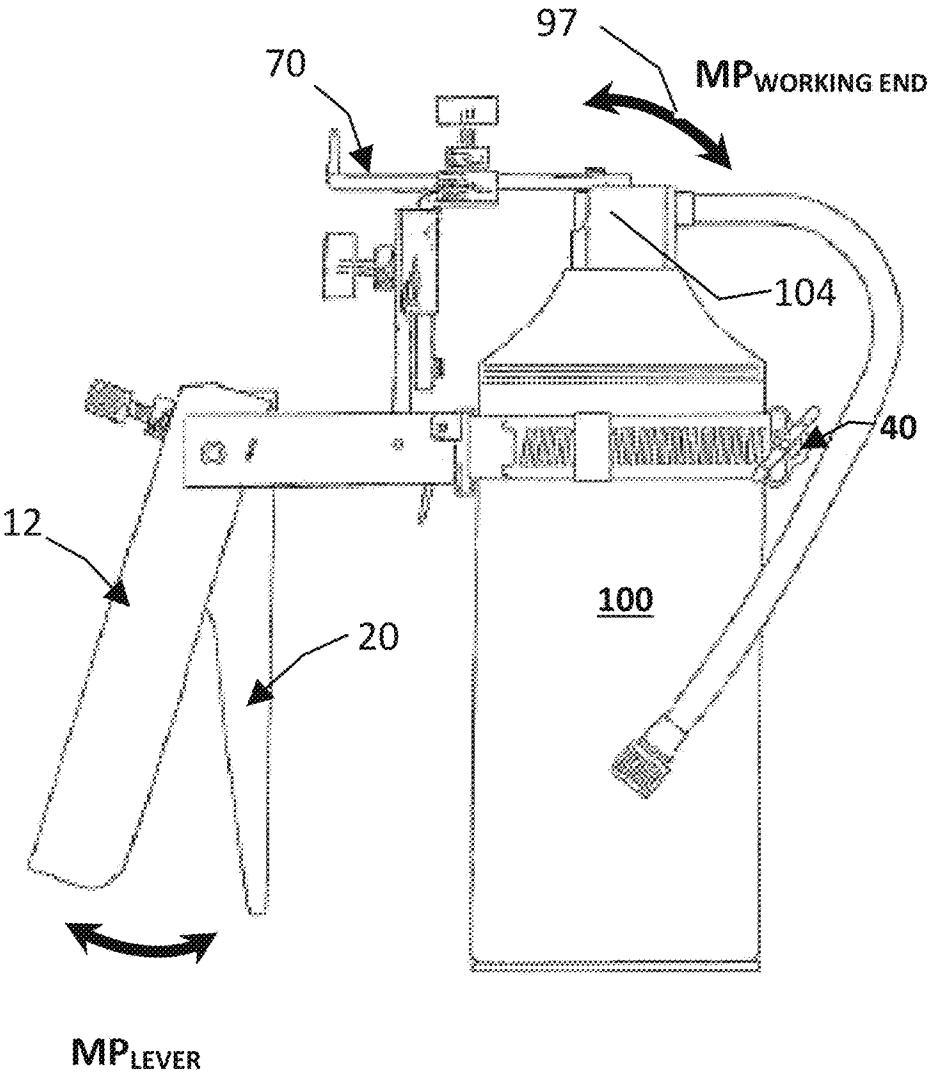
Figure 36B:
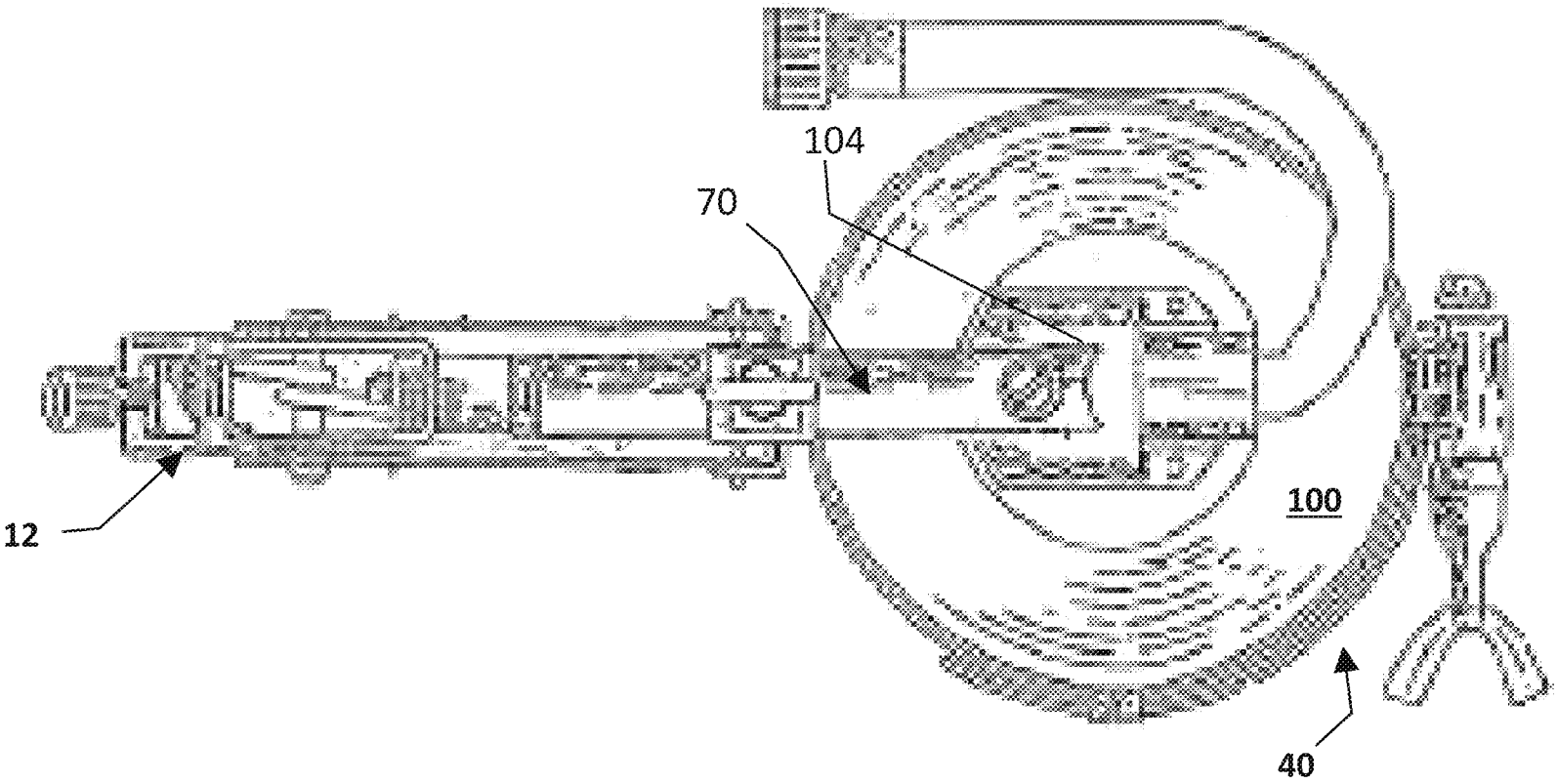
Figure 37A:
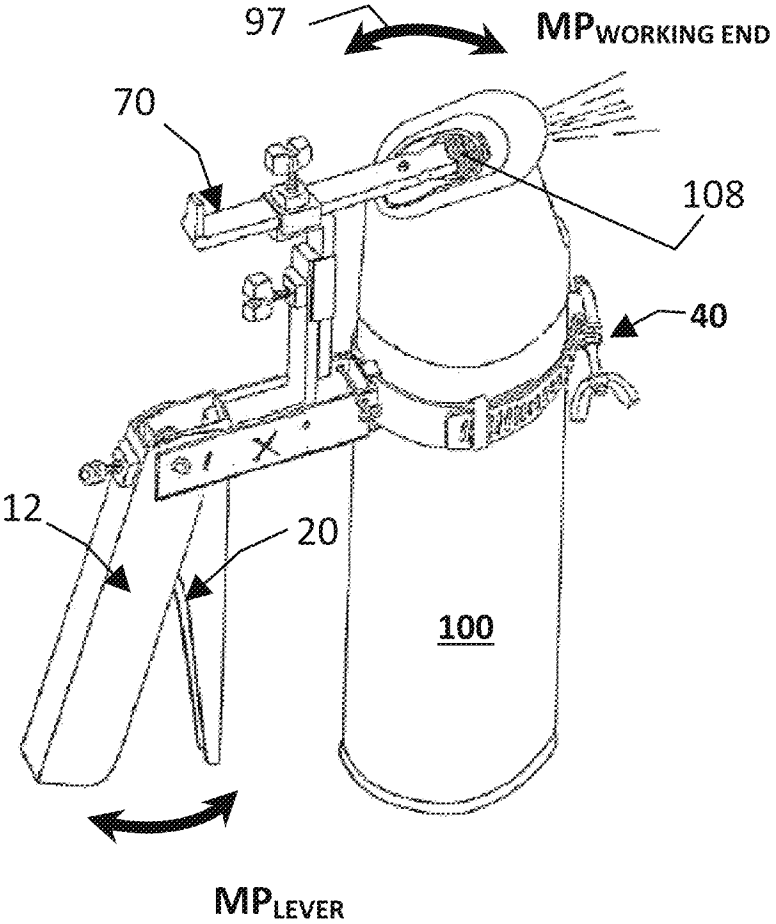
Figure 37B:
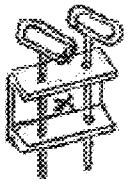

FIGS. 23A and B illustrate side elevation and top plan views of another version of the basic tool 10 of FIG. 11 operatively mounted and adjusted on a still further different type of spray container 100.

FIGS. 24, 25, 26, 27, 28, 29, 30, 31, 32, 33, 34, 35, 36 A-B and 37A-B are still further examples of how the basic tool 10 of FIG. 11 can be mounted to and adjusted for operation of a variety of spray containers using the clamp 40, either a screw/fastener to the spray head or the L-end by selectively reversing the opposite tips of working end 70, and then relying on the curved path motion $MP_{WORKING\ END}$ of working end 70 of the tool to either press down or laterally move the spray head pump mechanism or head to dispense container contents selectively. These illustrations give a variety of examples of how the same tool of FIG. 11 can be adjusted to work with a variety of spray containers. All of them use the basic curved path motions $MP_{LEVER}$ and $MP_{WORKING\ END}$ illustrated in FIGS. 14A-B for spray activation.

Figure 39:
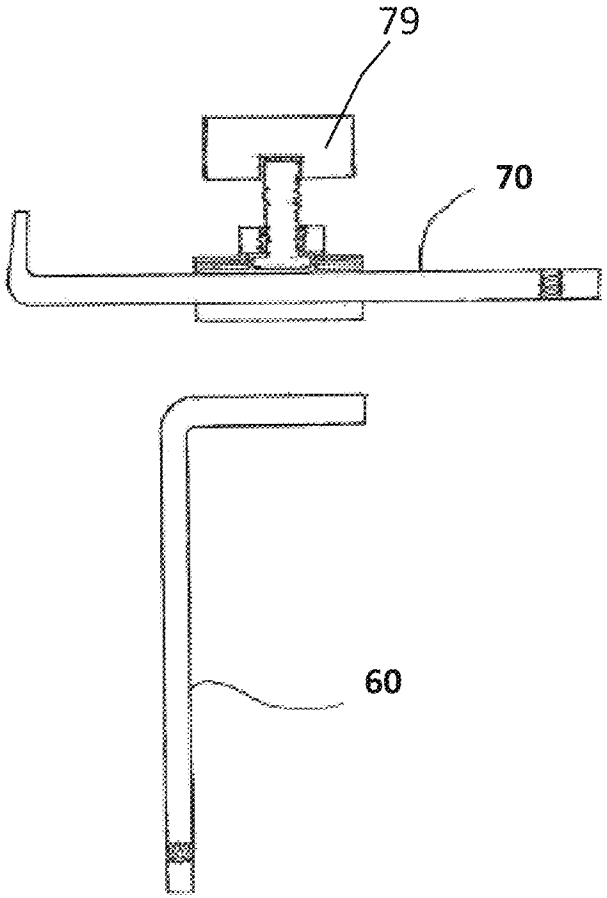
Figure 38:
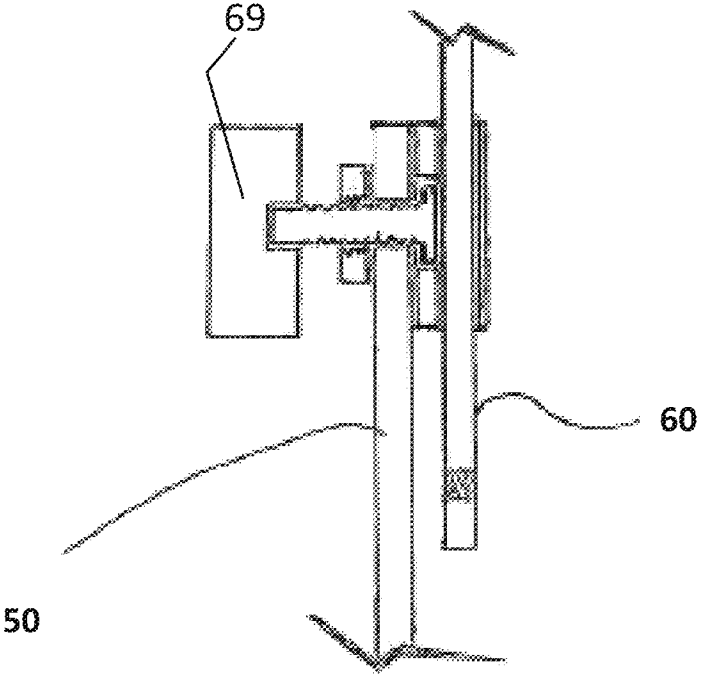

FIGS. 38 and 39 are isolated enlarged views of an alternative ways to mount parts of the linkage between the handle and the working end of tool 10 of FIG. 11 to allow adjustment options like height and reach of the working end 70 of the tool relative to different container sizes, shapes, and spray head types.

Figure 40A:
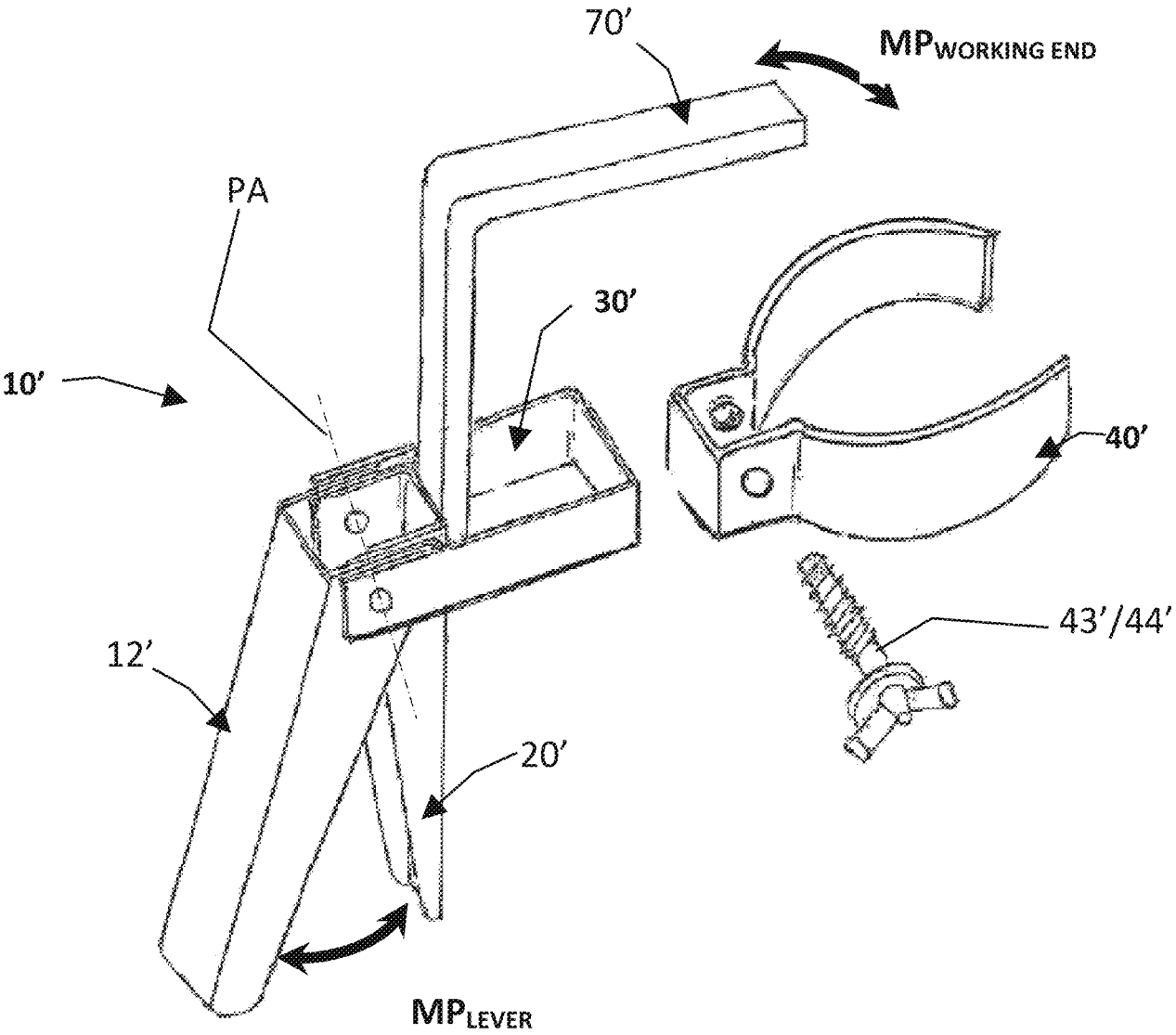
Figure 40B:
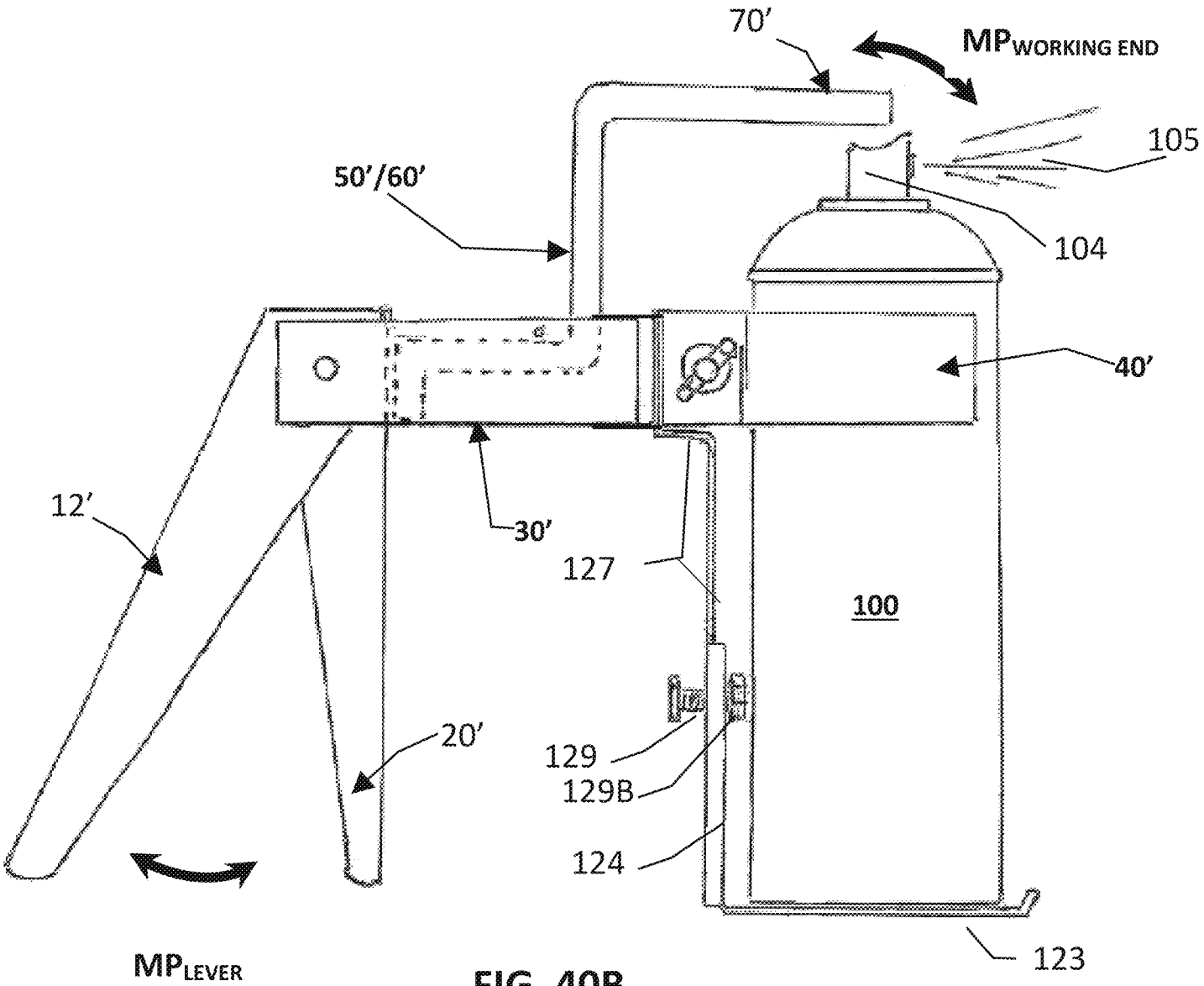
Figure 40C:
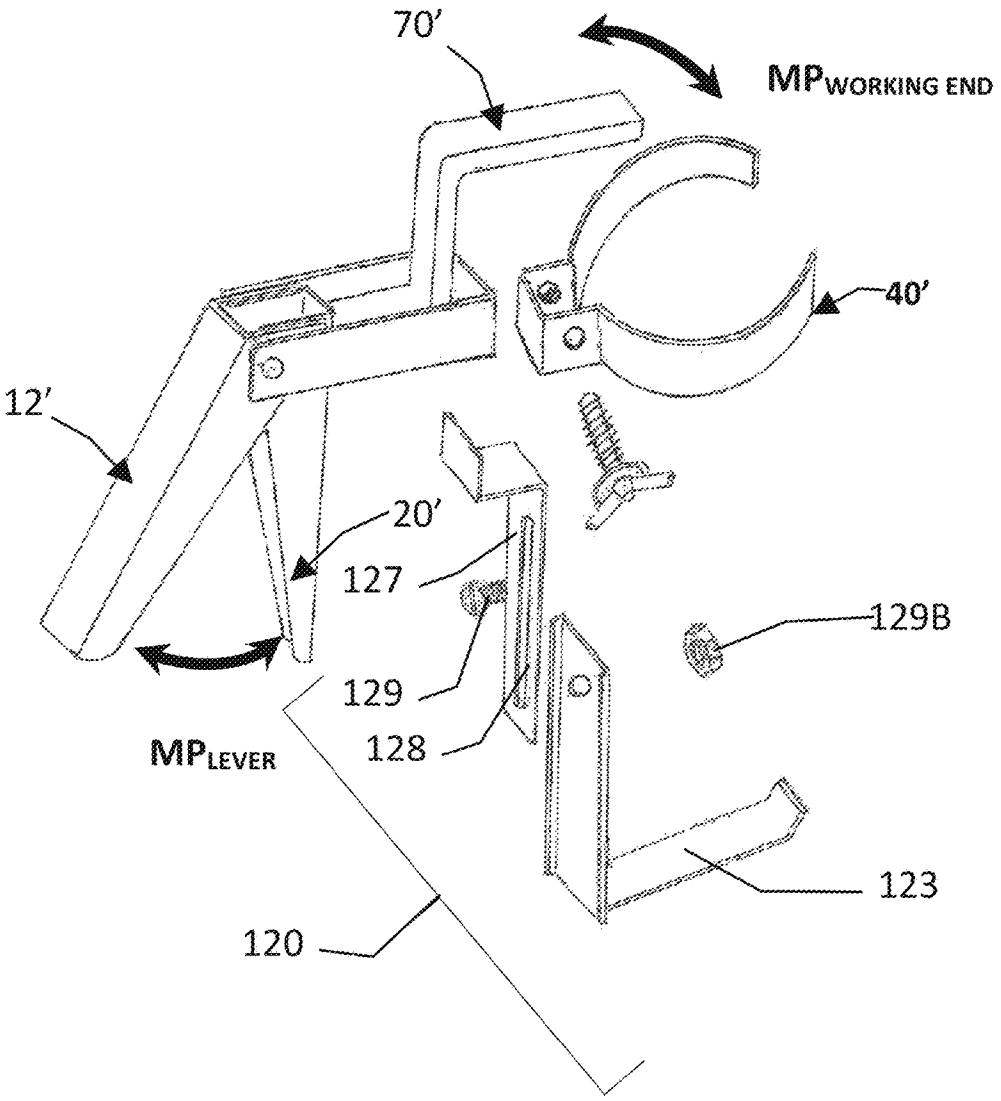

FIGS. 40A-C are exploded and assembled non-actuated states for a different specific exemplary embodiment according to aspects of the present invention. This embodiment 10' utilizes a similar curved lever motion path $MP_{LEVER}$ to produce proportional curved working end motion path $MP_{WORKING\ END}$ like that of tool 10 of FIG. 11, but does not have all the adjustability features of the tool 10 of FIG. 11.

Figure 40E:
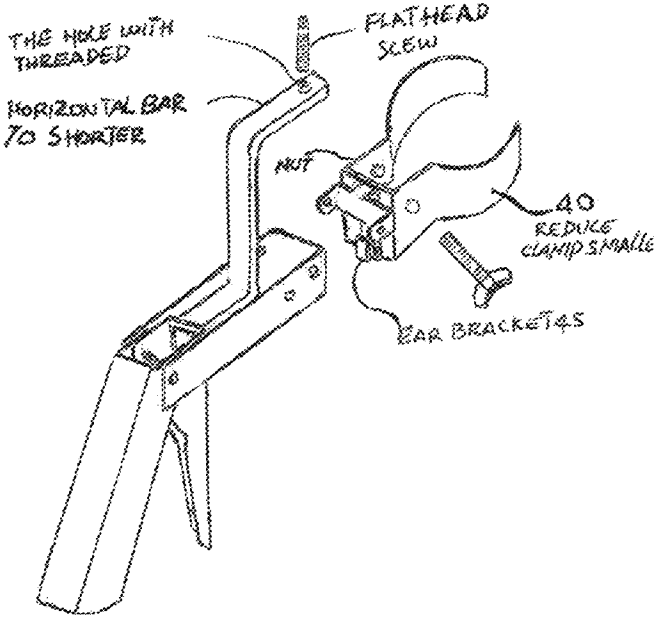
Figure 40D:
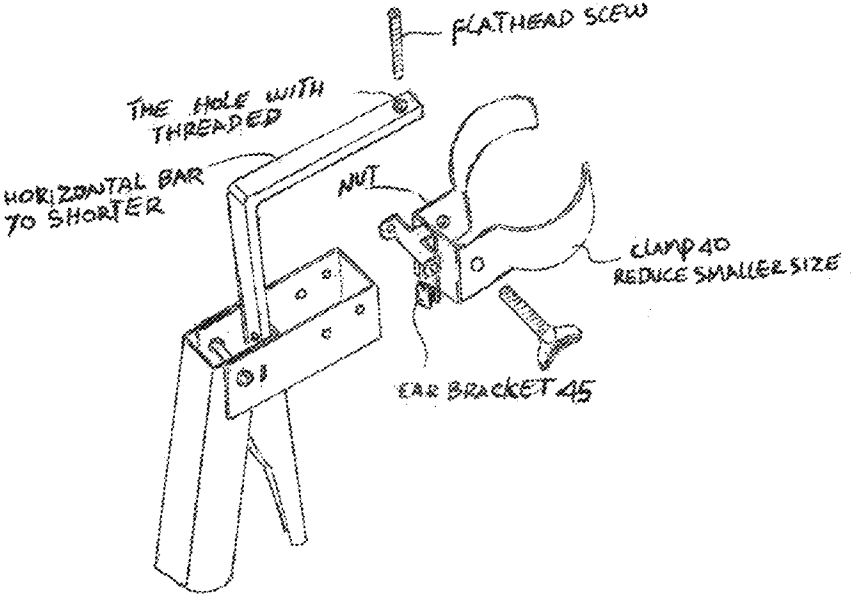

FIGS. 40D and E are partially assembled, partially exploded views of different forms for the embodiment of FIGS. 40A-C.

IV. DETAILED DESCRIPTION OF THE EXEMPLARY EMBODIMENTS

A. Overview

For a better understanding of the invention, a variety of different exemplary embodiments according to principles and aspects of the invention will now be described in detail. It is to be understood that these are examples only and are neither exclusive nor inclusive of all forms and embodiments the invention can take.

As will be seen by the reader, the drawings illustrate principles and aspects according to the invention. Variations obvious to the skilled in the art will be included within the invention which is not limited by these examples.

B. General Embodiment of the Invention

A general embodiment according to the invention is a tool that allows a user to quickly and easily mount any of a number of different types, sizes, and shapes of liquid or aerosol spray containers at one end of the tool, and then use a hand-held grip with lever-action member to selectively operate the spray mechanism of the container.

With particular reference to FIG. 1, basic features according to aspects of the invention are illustrated diagrammatically. One feature of this generalized embodiment of tool 10, is a proportional curved motion path $MP_{WORKING\ END}$ of the tip of a working end 70 of tool 10, in response to curved motion path $MP_{LEVER}$ of a hand-operated lever 20 pivotable at pivot axis PA at handle 12. A linkage between lever 20 and working end 70 translates $MP_{LEVER}$ to $MP_{WORKING\ END}$. This linkage between 20 and 70 is diagrammatically illustrated in FIG. 1 by solid black for clarity. Note how it pivots around pivot axis PA. The ability to move the solid black component (lever 20 and working end 70, and the linkage between them) is illustrated by dashed lines in FIG. 1.

Importantly, the proportional curved $MP_{WORKING\ END}$ provides much flexibility for tool 10. The curved path of $MP_{WORKING\ END}$ geometrically provides two range of motion components. It allows working end 70 to provide a first component range of motion over a range Y in FIG. 1. This allows end 70 to push down a spray head or nozzle that requires motion along the Y axis to dispense. See, for example, the up and down movement of spray head 102A in the Y direction in FIG. 1.

But it also produces a second component range of motion over a range X in FIG. 1. This is not a linear translation of lever motion $MP_{LEVER}$, which would not produce both an Y axis range of actuation and an X axis actuation as does a curved path $MP_{WORKING\ END}$. And it seems counter-intuitive. However, the inventor has discovered that this two-component degree of motion allows a single tool 10 to be implemented to operate a wider variety of types of spray heads, as further discussed below.

To assist in understanding of this embodiment, the following major components of the embodiment will have the following reference numbers and reference lines and planes throughout this description. It is to be understood that the specific shapes and proportions of components in this generalized embodiment 10 can vary and are not limited to those in FIGS. 1-10, which are for purposes of example only:

| Reference numbers or letters | Description |
|---|---|
| 10 | Apparatus/tool, generally |
| 12 | Handle, generally |
| 20 | Pivotable lever, generally (pivots into handle 12) |
| 30 | Frame, generally (structurally connecting and supporting handle 12 to clamp 40) |
| 40 | Clamp, generally (to clamp a container 100) |
| 50 | First linkage section, generally (fixed to lever 20) |
| 60 | Second linkage section, generally (slidably adjustable relative to first linkage section 50 to allow height adjustment of working end 70 relative to container in clamp 40)) |
| 70 | Working end of tool, generally (it can have optional features such as slidable adjustable relative to second linkage section 60 to allow lateral adjustment of working end 70 and/or having different functionalities at opposite tips so that a selected one of the tips can be used for different spray containers |
| $MP_{LEVER}$ | Curved motion of pivoting lever 20 |
| $MP_{WORKING\ END}$ | Curved motion of working end 70 proportional to $MP_{LEVER}$ |
| PA | Pivot axis of lever 20 in handle 12 |
| X, Y, Z | Axes in three dimension centered in receiver for container |

FIG. 1 is a highly diagrammatic illustration of a generalized embodiment of a tool according to aspects of the invention, and its operation relative a push-down type spray head 102A of a spray container 100. Container 100 is first secured against movement in any direction X, Y, or Z. this can be by a number of techniques and is not limited to that shown in FIG. 1. In FIG. 1 this securement is achieved by a mount or clamp 40. The strap of clamp 40, when tightened around the side wall of container 100 is a mechanical stop against movement of container 100 in the X direction and well as the Z direction (into or out of the page of FIG. 1; see FIG. 11 for the Z axis). The clamping force of clamp 40 is made sufficient to frictionally resist any sliding of container 100 up or down (Y direction movement) for the normal range of forces hand squeezing of lever 20 can apply to spray head 102A.

Spray head 102A is fixed at the top of a stem that extends to container 100, and ejects spray from container 100 by up and down (along the Y axis of FIG. 1) of head 102A. Solid black shows the linked lever 20 to working end 70 via linkage sections 50 and 60 in a normal, non-lever-actuated position. Dashed lines show the same combination 20/50/60/70 when lever 20 is actuated. This produces $MP_{LEVER}$ which is translated by 50/60 to the tip of 70 at or near spray head 102A. This concurrently produces the curved $MP_{WORKING\ END}$ at that tip of 70. The curve of $MP_{WORKING\ END}$ produces a first geometric component range of motion Y. The tip of 70 abuts the top of spray head 102A, and applies force to move head 102A along the Y axis to push head 102A down for a pump stroke. By either a single pivoting squeeze of lever 20, or repeating sequentially a series of squeezes, either a single pump action or repeating pump actions of spray head 102A can be selected and controlled by the user of tool 10.

But the curved path $MP_{WORKING\ END}$ also produces the X range of motion component of tip of 70. In this example, this second X direction movement is not needed to get pumping action of head 102A. The inventor has the subtle insight that the arrangement can work. It is configured to allow the tip of 70 to slide a distance across the top of head 102A. This does not interfere with the up/down pumping action needed.

Thus, this curved $MP_{WORKING\ END}$ motion produces the subtle combination of an up-down (Y axis) movement for pumping action and a lateral (X axis) movement. Here, the X axis movement is not utilized as an actuation force. This can seem counter-intuitive. If you needed up-down (Y axis) pumping action, why would you also allow lateral (X axis) range of motion? This feature of the invention will become clearer with reference to the following examples of use of generalized tool 10.

FIG. 2 is a highly diagrammatic illustration of a generalized embodiment of a tool according to aspects of the invention, and its operation relative a different type of spray container; one with a nozzle 102B that must be tilted sideways to operate dispensing of contents of container 100. This, again, illustrates the subtle but important feature of both X and Y components of the curved $MP_{WORKING\ END}$. But in this example, the lateral X axis) component of the curved $MP_{WORKING\ END}$ motion (instead of the up-down or Y axis component) is primarily used to produce lateral (X axis) actuation forces against the side of nozzle 102B. As is well-known for these types of spray containers 100, side tilt of nozzle 102B opens a valve or flow path for pressurized or aerosol contents of container 100. Here, the Y axis movement is not utilized, or is secondary only, as an actuation force. The free distal tip of working end 70 can slide along the side of vertical nozzle 102B. Again, this can seem counter-intuitive. If you needed lateral (X axis) tilting action, why would you also allow up/down (Y axis) range of motion?

FIG. 3 is a highly diagrammatic illustration of a generalized embodiment of a tool according to aspects of the invention, and its operation relative a still further different type of spray container; one with a slide mechanism 108 in the spray head 102C that must be pushed sideways/laterally (X direction) to pump spray or eject contents of the container 100. Here, both X and Y components of curved $MP_{WORKING\ END}$ can be utilized. The Y component can be used to move the tip of 70 down into abutment with slide 108. The X component can then urge slide 108 laterally (X direction) to create a pump action needed to eject container 100 contents.

As will be appreciated by those skilled in the art, the subtle, counter-intuitive curved path motions enable the invention to be used with a variety of different spray container types and configurations.

Thus, the generalized embodiment meets one or more of the objects, features, advantages, or aspects of the present invention. Below are additional or optional features.

1. The Tool Provides Mechanical Advantage to the User Plus a Beneficial Working End Motion Path The lever 20 provides mechanical advantage via a linkage to move a working end 70 of the tool 10 relative the given spray mechanism of the container held in the tool to assist the user in pushing or pulling the spray mechanism.

2. The Tool Provides Improved User-Control Plus a Beneficial Working End Motion Path The pistol-grip 12 and lever action can also provide the user with more control of the spray. The lever 20 can be spring-loaded or otherwise biased to a non-actuated position to provide automatic return of lever 20 to a normal, non-actuated position after each user-squeeze. This gives the user feedback as far as how far the lever is pulled, how quickly the lever is pulled, and how long of a time period the lever is pulled. This allows the user to select and control between a continuous actuation of the spray mechanism, one quick burst of the spray mechanism, a series of bursts, or some combination of any of the foregoing, all with the mechanical advantage of the lever arm of the lever, and translation of the curved motion path $MP_{LEVER}$ of the lower end of the lever to a curved motion path $MP_{WORKING\ END}$ of the working end of the tool as it interfaces with and moves the spray mechanism of the container. This curved motion path at the working end allows a variety of different types of spray mechanism to be serviced by this same tool. This feature is different than prior art techniques that use a linear motion path of the working end.

3. The Tool Provides Adjustability of a Variety of Sizes and Types of Spray Containers Relative to the Working End Plus a Beneficial Working End Motion Path It is to be noted that at least in some examples, the ability to clamp or mount a container in various positions in the mount allows one form of adjustability of container relative to the working end of the tool. For example, if a long container is desired to be mounted, it could be clamped nearer its top in the mount to be within the curved motion path $MP_{WORKING\ END}$ of the working end, without adjustment of the working end. In contrast, a short container could be grasped and held nearer its bottom to position it in the curved motion path $MP_{WORKING\ END}$ of the working end without adjusting the working end. The tool can hold quite small spray containers by simple and quick adjustment of the container mount (one non-limiting example being a clamp).

Figure 4:
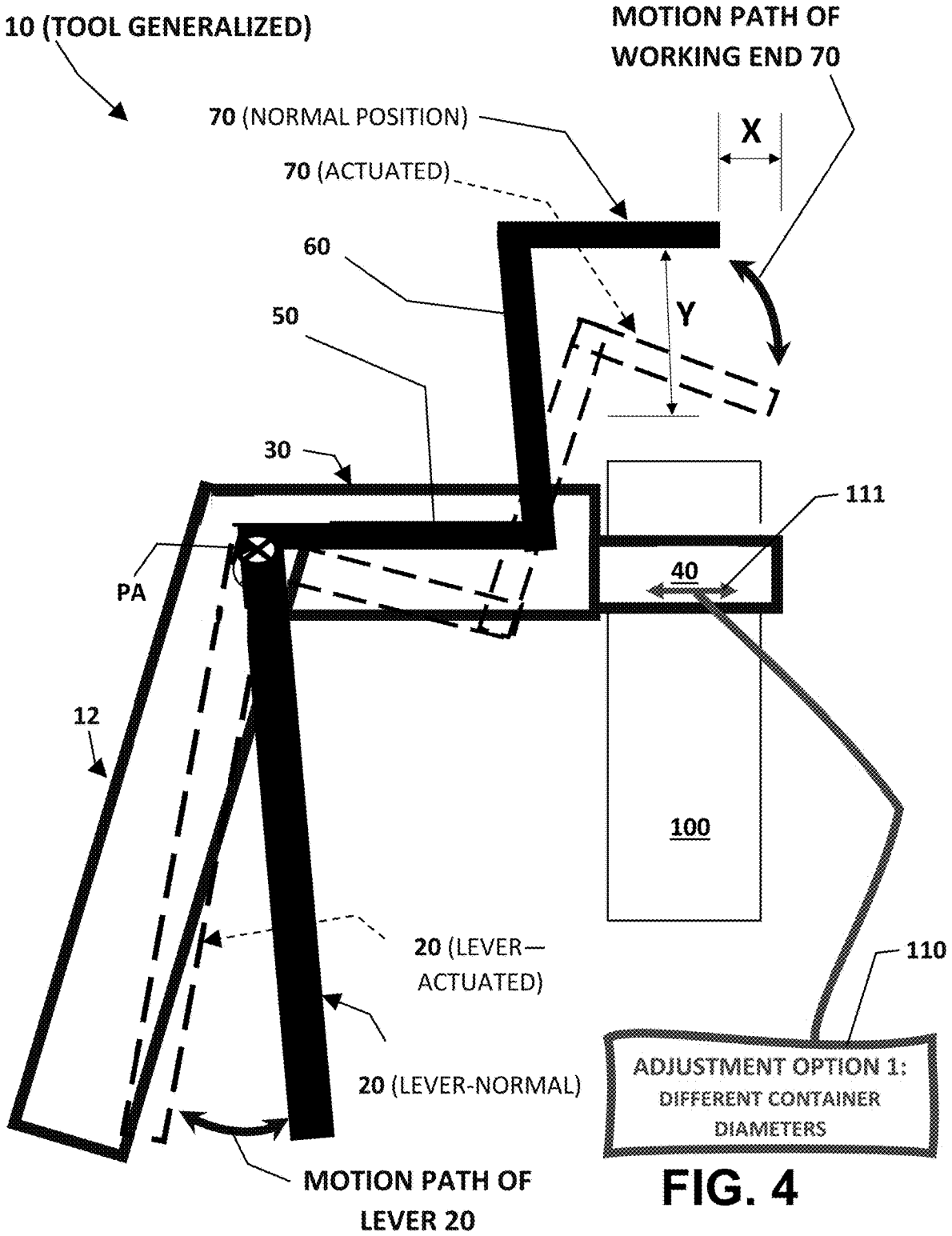
FIGS. 4-7 are highly diagrammatic illustrations of the generalized embodiment of a tool according to FIGS. 1-3, showing a number of different possible adjustment features that could implemented individually or in any combination with the tool; namely adjustment for different sizes, shapes, and types of spray containers.

FIG. 4 is a highly diagrammatic illustration of the generalized embodiment of a tool according to FIGS. 1-3, showing a first possible adjustment control of the tool; namely adjustment for different diameters of containers. In one form the container mount is an adjustable hose/ring clamp 40 or a C-clamp 40' (see, e.g., FIGS. 30A-C) that can be reduced in clamping diameter for smaller cross-sectional diameter containers. Importantly, it likewise can be quickly and easily adjustable to hold larger containers by increasing the clamping diameter of the mount. And, of course, it can be quickly and easily adjustable to securely hold container sizes in-between a smallest and a largest for a given mount. In some cases, different sized mounts (ones with different ranges of gripping diameters) could be optionally available, and the appropriate size switched into the tool if a different size range is needed.

Figure 5:
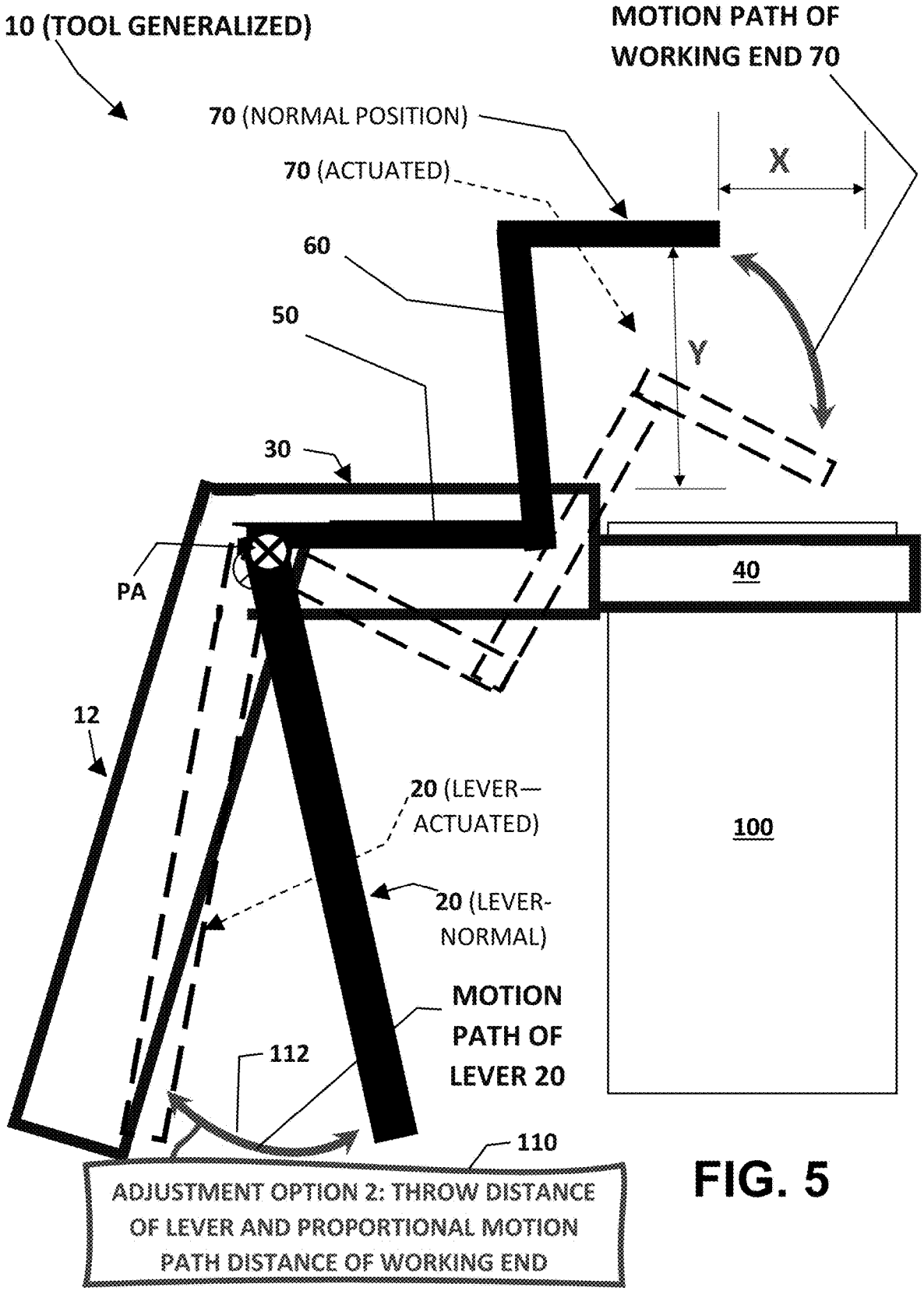

FIG. 5 is a highly diagrammatic illustration of the generalized embodiment of a tool according to FIGS. 1-3, showing a second possible adjustment control of the tool; namely adjustment of the range of pivot or throw of the hand-controlled lever to get a different length proportional motion path for the working end of the tool that actuates the spray head of whatever container is held by the tool. As will be appreciated, by appropriate configuration, tool 10 could have a manual adjustment to adjust the range of pivot of lever 20 about pivot axis PA. This would change (shorten or lengthen) the amount of throw of lever 20 (i.e. the length of $MP_{LEVER}$) when squeezed. This, in turn, would proportionally shorten or lengthen the length of $MP_{WORKING\ END}$ which would shorten or lengthen the X and Y components of $MP_{WORKING\ END}$. One non-limiting example is a knob or control on handle 12 that would change the position of a mechanical stop that determines length of $MP_{LEVER}$. An example of this will be discussed later. Other techniques are possible.

4. The Tool Can Provide Optional Additional Adjustability of the Working End Relative a Mounted Container One optional adjustment feature that can be included in the tool 10 is a high degree of adjustability of the position of the working end 70, and its curved motion path $MP_{WORKING\ END}$, relative to any container 100 mounted in the tool by adding adjustability between the working end 70 and the lever 20. For example, the linkage between the pivoting lever 20 and the working end 70 could have at least two sections that can adjusted over a range of relative positions to one another, and then secured in a selected position within the range.

FIG. 6 a highly diagrammatic illustration of the generalized embodiment of a tool according to FIGS. 1-3, showing a third possible adjustment control of the tool; namely adjustment of working end height (e.g. its height in generally a Y direction) for different lengths of containers.

In one specific example, the two linkage sections could be slidably adjustable (or otherwise translated) each other in a direction at least generally parallel to the longitudinal axis of any container held in the mount of the tool. In FIG. 6 linkage sections 50 and 60 are shown as a single non-adjustable part of the component including lever 20 and working end 70. This is one possible configuration. An example of slidably height adjustment is described later. But in this optional adjustment feature, in one example, section 60 could be configured to selectively lengthen or contract. This would allow the working end 70 to be raised or lowered relative the container 100 in the mount 40. This allows a high degree of adjustability relative the spray mechanism of the container 100.

A container 100 can be mounted in the mount 40 with its spray mechanism extending a distance above the mount 40. The linkage sections could be released from securement, slid relative to one another until the working end of the tool is positioned proximate the spray mechanism of the mounted container, and then the linkage sections re-secured relative to one another to allow precise positioning of the working end and its curved path to the spray mechanism of the container in the mount. Thus, instead of having to carefully set the position of the container in the mount, it can be gripped in a convention position and then the working end adjusted to it by adjustment of the linkage sections. This allows the tool to work for a wide variety of different spray containers. But, further, both the position of the container in the mount, and the linkage section adjust can be used together to provide even more adjustability capabilities.

5. The Tool Can Provide Optional Additional Adjustability of the Working End Relative a Mounted Container A still further optional adjustment feature that can be included in the tool is a high degree of adjustability of the position of the working end, and its curved motion path, relative to any container mounted in the tool by adding adjustability between the working end and the linkage coming from the lever to adjust what will be called the reach of working end 70 relative to a spray head of a container 100 mounted in mount 40. For example, the working end is mounted on the linkage. A releasable adjustment could allow the working end to be moved relative the linkage to either raise or lower the working end, or move the working end towards or away from the mount.

FIG. 7 a highly diagrammatic illustration of the generalized embodiment of a tool according to FIGS. 1-3, showing a fourth possible adjustment control of the tool; namely adjustment of working end reach for different diameters of containers, and different types of spray heads.

In one specific example, the working end 70 is an elongated member that is slidably adjustable along a section (e.g. section 60) of the linkage in a direction perpendicular to the longitudinal axis (Y direction) of any container 100 held in the mount 40 of the tool 10. This would allow the working end 70 to be moved closer or further away from the container in the mount. This allows a high degree of adjustability relative the spray mechanism. A container can be mounted in the mount with its spray mechanism extending a distance above the mount. The working end could be released from securement, slid relative the linkage until the working end of the tool is positioned proximate the spray mechanism of the mounted container, and then the working end re-secured relative to the linkage to allow precise positioning of the working end and its curved path to the spray mechanism of the container in the mount. An example of this is discussed later.

Thus, instead of having to carefully set the position of the container in the mount, it can be gripped in a convention position and then the working end adjusted to it by adjustment of the working end to the container spray mechanism. This allows the tool to work for a wide variety of different diameters of spray containers. But, further, both the position of the container in the mount, and the linkage section adjustment, and the working end adjustment can be used individually or in any combination of one, two, or all three together to provide even more adjustability capabilities.

6. The Tool Can Provide Optional Additional Adjustability by Incorporating Different Functionalities into the Working End A still further optional adjustment feature that can be included in the tool are a plurality of different functionalities in the working end itself.

By functionalities is meant that the tip or tips of working end 70 can include different functional features that allow further flexibility in the different types and configuration of spray heads and/or containers tool 10 can work with.

One example is a working end distal end that can either directly come into abutment of a spray mechanism of a container mounted in the tool, or can receive an optional added extension or a securement mechanism, either of which can be used to abut, contact, or attach to the spray mechanism. In one specific example, the distal end of the working end can simply be the end of an elongated member (e.g. an arm or flat rod) that contacts the top or side of a spray mechanism, and the optional extension could be a ring attachable to the distal end that surrounds the spray mechanism. An optional securement mechanism could be a screw or other fastener that attached the working end to the spray mechanism. Another example of an optional added adjustability is that the working end can be elongated but have different form factors at opposite ends that provide different functionalities relative a spray mechanism. In one specific example of this feature, the working end is an elongated arm, rod, or flat rod with one end with no modification but a modified shape (e.g. L-shape or hook or other extended shape) at the other end. This elongated arm can then be released from the linkage, the desired end positioned nearest the container in the mount, and then the working end arm adjusted to a desired position relative the spray mechanism in the mount. In some cases, the unmodified end is sufficient to operate the spray mechanism one end. In some cases a modified end works. This allows a further high degree of adjustability relative the spray mechanism. This allows the tool to work for a wide variety of different diameters of spray mechanisms. But, further, any of the foregoing adjustment features, whether or not optional, can be used individually or in any combination of one, two, or more together to provide even more adjustability capabilities.

FIG. 8 is a highly diagrammatic illustration of the generalized embodiment of a tool according to FIGS. 1-3, showing a sixth possible adjustment control of the tool 10; namely an additional functionalization of the working end, here a fastener or securement member 115A that can secure the working end 70 to spray head to make sure the spray head mechanism to which it is attached follows the motion path $MP_{WORKING\ END}$ of the tool's working end, in all directions of motion.

FIG. 9 a highly diagrammatic illustration of the generalized embodiment of a tool according to FIGS. 1-3, showing seventh and eight possible adjustment controls of the tool; namely (1) another functionalization of the working end by providing a shape (one non-limiting example an L-shape 115B, see also tip 73 in other Figures) at the distal tip of the working end 70 that can reach down or contact and push or pull a portion of a spray head, and furthermore, (2) a reversible working end 70 that has different functionalities at opposite ends so that the user can mount the working end 70 on the tool 10 with either end at the spray head of a container 100 in mount 40 to use the desired end that best fits a certain spray container. A release mechanism can be included to allow the user to mount working end 70 in one direction toward the spray head, or to remove or turn it so the other end is at the spray head. Specific non-limiting examples are given later.

FIG. 10 a highly diagrammatic illustration of the generalized embodiment of a tool according to FIGS. 1-3, showing a nineth possible adjustment control of the tool; namely a removeable tip 115C that can be mounted and secured to a tip of the working end 70. In one example, removable tip 115C that can assist spray head operation if desired for a certain spray head (one non-limiting example is a ring that can surround a spray nozzle and help maintain control of and both push and pull of the nozzle).

As will be appreciated by those skilled in this technical area, the generalized embodiment of FIGS. 1-10 meets or exceeds one or more of the objects, features, advantages, or aspects of the invention. It utilizes the subtle but highly versatile feature combination of lever-arm leverage to create a curved path motion at the working end, plus a variety of possible adjustability features to accommodate a wide variety of spray-type containers with one tool. As a practical example, a homeowner can have one tool according to the invention but use it for spray assist for most if not all aerosol, pressurized, non-pressurized, or other spray head type spray containers typically found around a home.

As can be seen by looking at the drawings as a whole, the following principles of operation are the same throughout the embodiments and examples in this detailed description:

1. A rigid pistol-grip or hand-sized handle includes a lever that is pivoted in a manner that the handle can be held in user's palm and the user's fingers can take advantage of hand gripping force to selectively squeeze the lever to the handle. This creates an arc of motion in a rearward direction at the end of the lever around the lever's pivot axis at the handle.
2. A connection, frame, or backbone is rigidly connected between the handle an adjustable receiver or mount for a spray container at a position extended away from the handle. In one example, the adjustable receiver or mount is a clamp that can be adjusted to receive and cinch a range of sizes and shapes of containers. That receiver or mount can optionally be adjustable to secure different form factors of containers and hold the container in place as it experiences the forces caused by the working end against the dispensing mechanism of the container.
3. A linkage from the handle extends to a working end. The working end is adapted to come into abutment with dispensing mechanism, nozzle, or other component that causes dispension from the container. The working end moves in response to the pivoting of the lever in a proportional and complementary curved path. As such, the user squeezing the lever actuates one range of motion of the working end along the curved path relative the dispenser head. If it is an aerosol dispensing head, squeezing the handle and holding it will in response release continuous spray from the container until the lever is released. If non-aerosol, pumping action of the lever by the user's hand causes working end movement consistent with pumping the head to eject container contents.

In some embodiments, the linkage between lever and working end can be adjusted to position the working end in different places in 3-D space for different containers and dispensing heads. This allows the apparatus to be used for a wide variety of containers and dispensing heads.

A method according to the invention takes advantage of the proportional lever pivoting with curved path movement at the working end for these types of purposes. A method can take advantage of one or more adjustability features as described above to help apply the method to a wide range of spray containers. FIGS. 1-10 are annotated to highlight the subtle but beneficial insight of the inventor regarding the generalized embodiment. To further assist an understanding of the invention several specific examples according to one or more aspects of the invention will now be described in detail. It is to be understood that these specific examples include the basic features of the generalized embodiment described above. As will be understood by those of skill in the mechanical arts, the components and operation of the components of this specific example can be configured to provide the basic features as described with the generalized embodiments, as well as one or more of the optional adjustability features. Therefore, those features will not be described is specific detail here for sake of brevity, and reference can be taken to the description of the generalized embodiment. The specific examples that follow are just several non-limiting ways the invention can be built and used.

C. Specific Example 1

With reference to FIGS. 1-39, a first specific example tool 10 according to the invention will now be described, including various optional or alternative features. It is to be understand that tool 10 and the components of these figures are not drawn to exact scale in each figure or between figures, but are drawn to illustrate what one of skill in the art needs to understand to make and use these specific examples. The results and benefits can be readily understood by reference to not only FIGS. 1-39, but also to FIGS. 1-10.

1. Assembled Apparatus

As can be seen in FIG. 11, this specific tool 10 includes the general features from the generalized embodiment above; namely, a hand grip 12, a lever 20 pivotable around pivot axis PA relative to handle 12, a working end 70 away from handle 12, and linkage sections 50 and 60 linking the pivotable movement $MP_{LEVER}$ of lever 20 to $MP_{WORKING\ END}$ proportional movement of working end 70. Certain parts of a complete tool 10 have been omitted in FIG. 11 for purposes of clarity of the basic components. Those parts can be understood with reference to the exploded, dissembled view of FIG. 12A and its description below.

One adjustability feature (like that of FIG. 4) is a mount 40 (here a screw or band clamp with worm gear diameter adjustment) that can be manually and easily adjustable to secure a range of sizes of a container 100 in 3-D space (X, Y, and Z coordinate space shown in FIG. 11). In this example, ring clamp 40 has a manual adjustment 44 (e.g. a worm gear) to change the gripping size or diameter sides; namely the gripping cross-sectional area of a container 100 in generally the XZ plane of FIG. 11. Operation of such clamps are well-known to those skilled in the art. Others are possible. One example is at FIGS. 40A-E.

In this embodiment of tool 10, a manual knob is rotatably generally around the Z axis or direction (see arrow 112) to adjust the range of throw (i.e. the range of how far lever 20 can move between normal and fully squeezed positions) of lever 20. A biasing member (e.g. tension spring 22) is installed between handle 12 and lever 20 to bias lever 20 pivoted away from handle 12 in a normal state, but allows typical hand strength to squeeze lever 20 to handle 12. The user releases sufficient squeeze force and lever 20 returns towards normal position. This allows the user a high degree of control of the leveraged force at working end 70. The tip of working end 70 positioned nearest clamp 40, in response to movement $MP_{LEVER}$ of lever 20, moves proportionally along curved path $MP_{WORKING\ END}$, which provides subtle benefits of the invention discussed herein. This is the adjustment feature illustrated diagrammatically in FIG. 4.

In this embodiment, other adjustability features are included.

First, vertical or height adjustment of working end 70 is via manual adjustment knob 69. Untightening of clamping bolt 67 by rotating finger knob 69 which is fixed to bolt 67 unclamps bolt 67 against member 50 and allows linkage member 60 to slide along linkage member 50. Once extended or retracted (within a range allowed by the components), knob 69 can be hand-tightened to move bot 67 into a clamping position to secure that height. Linkage member 50 is rigidly attached to lever 20. Arrow 113 in FIG. 11 indicates that adjustability. This is the adjustment feature illustrated diagrammatically in FIG. 6.

Additionally, similarly manual adjustment knob 79 (e.g., a thumb screw fixed to threaded clamping bolt 77) adjusts lateral positioning of working end 70 be a similar sliding movement relative to linkage member 60. Knob 79 is untightened to unclamp bolt 77 against member 60, working end 70 slid to extend its reach towards clamp 40 or retract its reach, and knob 79 hand-tightened to re-clamp bolt 77 against member 60 to secure a selected reach position for end 70. Arrow 114 indicates this adjustability. This feature is illustrated in FIG. 7.

Furthermore, tool 10 of FIG. 11 includes all four adjustability features of FIGS. 8-10. Working end 70 is removable (by untightening knob 79 sufficiently that working end 70 can be removed from the sleeve 76 (see FIG. 12A). This allows either end 73 or end 74 to be selected to be nearest clamp 40. Thus, the same working end 70 provides the flexibility of at least two different functionalities at opposite reversible ends for use.

FIG. 11 shows three different functionalities on reversible working end 70. One is simply an unmodified end 75; meaning the blunt end of the flat elongated bar portion of end 70 is used to move into contact with a spray head of a container held in clamp 40. The blunt end can have some shape. For example here, it is concave in the XZ plane along the working end axis. This can help center that end along the side wall of a vertical nozzle. Other shapes are possible. In contrast, a major modified shape is shown at opposite end 73 of working end 70. The non-limiting example is an-shaped or hook end that extends quite a bit out of the XZ plane along the working end axis. This allows both extra reach downward and/or a different surface abut to different spray heads. For example, hook end 73 may work better to contact and slide a slidable member that needs lateral (X direction sliding) to pump to spray. Additionally, a threaded aperture 75 is functionalized in end 74 if needed. One use is a passage for a screw or fastener that can be screwed through aperture 75 and a distal end brought into contact with the plastic or other material of a spray head to help secure working end 70 to a spray head during operation of tool 10. Another functionality of aperture 75 is simply to thread a threaded bolt or shaft through it to serve as a mechanical stoop to disallow member 70 from separating from member 60 when unclamped. A still further functionality of aperture 75 is to receive a screw or bolt to fasten an add-on tip like optional add-on ring tip 80 of FIG. 11. All of these add adjustment features and flexibility of tool 10 for a wide variety of different spray head and container configurations. Some of these features are illustrated in FIGS. 8-10.

2. Exploded View of Components for and Their Assembly into Tool 10 of Specific Example 1

With specific reference to FIGS. 12A-D, one example of components, and characteristics of those components, to assembly and use tool 10 of Specific Example 1 are shown.

i. The Unit of Handle 12, Frame 30, and Clamp 40

Handle 12, frame 30, and clamp 40 function as a unit. Clamp 40 clamps to a spray container 100. Frame 30 connects clamp 40 to handle 12. When assembled this unit is structurally rigid and allows a user to grip handle 12 and point the unit at a target for the spray.

FIG. 12A shows handle 12 includes a body 13. It could be of suitable strength and durability material. One example is formed metal plate (e.g. steel). Others are possible (e.g. suitably rigid, strong plastics). Aligned through-holes 15 at the top 14 receive a pivot pin 16 having an enlarged head on one end and a radial notch on the other so that pin 16 can be secured in place by snap ring clip 17 that removable seats into that radially groove. Note the interior of handle is open.

Lever 20 has aligned openings 25 which can be aligned with openings 15 in handle for the pivotal attachment to handle 12 by pin 16. Spring 22 can provide normal tension of lower end 23 of lever 20 away from lower end 13 of handle 12. This provides a pistol-grip type arrangement with lever as an outwardly spring-biased trigger that can be squeezed and brought near to handle 12 by rotation of lever 20 on pivot pin 16, which determines pivot axis PA.

A U-plate 19 can be fit into the open space at the top end 24 of lever 20. Machine screw or bolt 18A can be threaded onto nut 18C until threads are exposed from nut 18C. Then the exposed threads are passed from the inside of handle 12 through opening 18A. Control nut 18D would then be threaded onto exposed threaded end of bolt 18A on the outside back side of handle 12. By manually rotation of control nut 18D, the head of bolt 18B would be moved either towards or away from the inside opposite wall of lever 20 (when it is pivotally mounted to handle 12). The head of bolt 18B thus would act as a mechanical stop to limit the range of rotation of lever 20 away from handle 12. If control knob 18D is turned to extend bolt the maximum toward lever 30, spring 22 will only be allowed to bias lever 30 a first angular range relative to handle 12. If knob 18B is rotated to shorten the extension of bolt towards lever 30 (in other words, a greater length of bolt 18B would extend out the back side of handle 12, the amount of angular pivoting rotation allowed of lever 30 away from handle 12 is increased. In this way, adjustability of the range of throw of lever 30, as in FIG. 5, is allowed by easy and quick manually adjustment of knob 18D.

What will be called frame or connector 30 is rigidly connected between handle 12 and clamp 40. This provides structural rigidity for the user to hold handle 12 in a hand and support a container 100 clamped into clamp 40, and further provide a sufficiently rigid combination to allow lever 30 to be pulled and pivot to overcome outward bias of spring 22.

Frame 30 can take different forms. It could be one-piece with handle 12 and also of structurally sufficient material to resist deformation relative the forces it will experience (e.g. formed sheet metal or sufficiently rigid other materials).

In this embodiment frame 30 is a separate piece from handle 12, a U-shaped rigid member (e.g. formed sheet metal or strap). It is assembled to handle 12 as follows. The open end of frame 30 is pried apart to pass over ears 32 on opposite sides of upper end 14 of handle 12 until slots 31 in frame 30 snap on ears 32. This provides both connection and orientation of frame 30 in a pistol-type combined configuration. When lever 30 is assembled into handle, openings 35 in frame 30 are also aligned with openings 15 in handle 12 and opening 25 in lever 30 to provide additional mechanical resistance to frame 30 moving relative to handle 12.

Clamp 40 is attached to the other end of frame 30. This could be by a number of techniques. Again, the connection has to be structural strong enough to support a variety of spray containers 100 and not bend or deform when working end 70 is brought down and lever 30 applies leverage on a spray head. Thus, clamp 40 could be rigidly affixed to frame 30. Here, clamp 40 is an off-the-shelf strap 41, worm gear 42, and members 43 and 44 can adjust the diameter inside of ring 40 for different diameter containers. As a separate component, and to allow substitution of different sized ring clamps 40 (e.g. see FIGS. 12B and 12C), clamp is removably mounted to frame 30 as follows.

A mounting bracket 45 (e.g. sheet metal or similar structural strength and rigidity) includes two ears 46 with aligned openings on one end of a vertical backbone section, and a bent portion with lateral tunnel 47 at the bottom of the backbone. The vertical backbone length is slightly more than the height of the closed end 34 of frame 30. Outward pointing fingers 48A and B of retaining clip 48 are squeezed towards one another and snapped into holes 46 of bracket 45. Clip 48 is swung upward so that a majority of clip 48 is above holes 46 of bracket 45.

A portion of the strap 41 of band clamp 40 free from worm gear 42 or slots needed for diameter adjustment is brought against the exterior of closed end 34 of frame 30. See FIG. 11. The backbone of bracket 45 is then sandwiched over that portion of clamp strap 41 so that its apertures 46 and its tunnel 47 extend over and rearward of the top and bottom, respectively, of end 34 of frame 30. Clip 48 is then swung down on its outward pointing fingers 48A and B that are journaled in holes 46 of bracket 45 until its cross member 48C snaps into tunnel 47. This holds clamp 40 in position to closed end 34 of frame 30. Clip 48 is locked into bracket 45 on top and bottom, and clip 48 is inside the interior of frame 30. Thus, clamp 40 cannot move away from frame 30. Thus, substantial rigidity between ring clamp 40, backbone 30, and handle 12 exists to support a container 100 and hold it relative to forces in motion by lever action of lever 20.

The reverse process can release clamp 40. Cross member 48C is released from tunnel 47, and clip 48 swung up on ears 48A/B while still connected by ears 48A/B to bracket 45 through the interior of frame 30. This unclamps clamp strap 41 from the closed end 34 of frame 30. This allows maintenance or repair of clamp 40, or substitution of a different ring clamp (e.g. different range of clamping diameters or otherwise), or substitution of a different mounting for containers 100.

FIG. 12A shows some optional features. Frame 30 could have pairs of aligned openings like pair of openings 35 and/or pair of openings 36 in opposite sidewalls of frame 30. Pins 37 and/or 39 optionally could be inserted, one to a pair of frame openings 35 and 36 to prevent clip cross member 48C from inadvertently releasing from tunnel 47 of bracket 45 and clip 48 rotating up and releasing clamp 40 from frame 30.

FIG. 12A also shows a clip 49 that optionally could be used to temporarily hold the free end of clamp strap 41 against clamp 40. Also shown are one version of worm gear 42 that can be adjusted by a flat-head screwdriver blade, but optionally/alternatively, an extension 43 could be welded to the screw and have a fixed wingnut 44 that could be turned by hand to adjust clamp 40 clamping diameter, to eliminate the need of use of tools. See parts 43 and 44 assembled to clamp 40' and 40" in FIGS. 12B and C.

ii. The Unit of Lever 20, Linkage Section 50, Linkage Section 60, and Working End 70

Lever 20, linkage sections 50 and 60, and working end 70 also function as a unit. Linkage connects lever 20 to working end 70 so that working end 70 moves in response to, and proportionally to, pivoting of lever 20 in handle 12 by the user squeezing lever 20 towards handle 12. Linkage sections 50 and 60 rigidly make that connection between lever and working end 70 so leverage force of lever 20 can be applied to a spray head by working end 70. In this embodiment, linkage sections 50 and 60 also include features that the user can adjust height of and reach of working end 70 relative to clamp 40, which is turn, allows height and reach adjustment to a spray container held in clamp 40.

FIG. 12A shows in this embodiment linkage 50 that can be screwed or bolted or otherwise rigidly fastened through apertures 51 by two fasteners 52 along the front face of and near the top 24 of lever 20. They could be machine screws into threaded apertures 51, or bolts through apertures 51 and secured on the back side of lever 20 with nuts. Other techniques are possible (e.g. welding). In this example, 50 has two bends 54 and 55 to create a rough Z-shape that has a first end 53 that extends up (Y direction), a middle between bends 54 and 55 that extends out (X direction) and then a second end 56 that extends further up (Y direction) and has an aperture 57. When tool 10 is assembled, linkage section 50 pivots in response to pivoting of lever 20 in the interior of frame 30. Note its bends 54 and 55 are basically 900 but could be from a range of other angles. Linkage section 50 provides a first amount of height and reach relative to the center axis in the Y direction through clamp 40.

Linkage member 60 in this embodiment is L-shaped from lower end 63 to distal end 65. When assembled to linkage section 50, its end 63 extends along the clamp-side of end 56 of linkage 50 (Y direction), and end 65 extends further out (X direction) from lever 20. Linkage section 60 provides ability for additional height and reach.

In this embodiment, working end 70 is a separate piece with opposite, reversible functional ends 73 (L-shaped hook function) and 74 or 75 (concave leading edge or aperture for screw to screw into spray head or bolt to attach extension). Working end 70 is elongated between ends so that when installed it provides additional reach (X direction) towards the center axis (Y direction) of clamp 40.

As can be understood with reference to FIGS. 1-10, the assembled unit 20, 50, 60, and 70 provides such height and reach on the opposite side of pivot axis PA from free end 23 of lever 20. Thus, when assembled and secured, the unit provides a distance between free end 23 of lever 20 and the chosen end 73 or 74 positioned nearest the central axis of clamp 40. This arrangement provides the proportional curved motion path $MP_{WORKING\ END}$ to chosen end 73 or 74 in response to squeezing of end 23 of lever 20 towards handle to move end 23 along curved motion path $MP_{LEVER}$.

In this embodiment, end 63 of linkage section 60 is slidably adjustable in height along end 56 of linkage section 50, and the bottom of working end 70 is slidable along the top end 65 of linkage section 60, to provide two height or reach adjustments for positioning working end 70 relative to clamp 40. The technique to allow sliding adjustment and then securement in a chosen position is the same for both.

For section 60 adjustment, refer to FIG. 12D (left side). A metal washer 66B (here a flat rectangular piece) is spot welded to the inner side of vertical portion 56 of first metal linkage section 50 with through-bore 66C in washer 66B aligned with through-bore 57 in linkage portion 56. Through-bore 57 is made larger than the diameter of threaded bolt 67 so bolt 67 can freely slide through. Threaded metal nut 68A is welded to the opposite side of portion 56. Threaded metal bolt 67 is slid through through-bores 66C and 57 with the head of bolt 67 larger than those holes and threaded through nut 68A to expose its threaded end opposite its head end of bolt 67 as in FIG. 12D. Then U-shaped metal sleeve portion 66A is welded to vertical portion 56 at/over washer 66B and over the head of bolt 67 (this is shown diagrammatically in FIG. 12D by "X's" on both pieces to indicate the general location of spot welds). Sleeve is thus rigidly attached to 56 and presents a channel through which end 63 of second linkage section 60 can be slid from a top direction when the head of bolt 67 is moved towards washer 66B. Sleeve 66A is sized to receive end 63 of second linkage section 60 through its top end so that ends 56 and 63 are side-by-side but end 63 can slide relative to end 56. For clarity, FIGS. 12A and 12D illustrate sleeve 66A exploded from 56. Thus, member 66A and 66B and end 56 basically form a rectangular cross-section tubular member with interior passage that is closely complementary to the combined exterior dimensions of end 63 so that end 63 can slide inside it. The head of screw 67 would be in the interior of sleeve 66A. The threaded body of bolt 67 would extend through aperture 66C of washer 66B and would fit through aperture 57 of end 56 of linkage section 50 and be threaded through nut 68A to expose the threaded end of screw 67 that extends through apertures 66C and, 57, and nut 68A. A metal finger knob 69 is then secured (e.g. welded or otherwise mounted) to the very distal end of screw 67 in a manner such that when a user manually rotates knob 69 screw 67 would turn in kind in either direction in threaded nut 68A. This allows the user to turn screw 67 in nut 68A one way to extend the head end of bolt 67 inside sleeve 66A towards the interior wall of sleeve 66A opposite washer 66B (which would clamp anything inside sleeve 66A), or turn screw 67 in the opposite direction to retract the head end of bolt 67 inside sleeve 66A away from clamping position to an unclamping position in the direction of washer 66B. When all this is assembled, turning finger knob 69 sufficiently in one direction draws the body of screw 67 through nut 68A and the head of screw 67 moves towards nut 66B (i.e. the amount of threaded bolt 67 that is exposed on the nut 68A side of 56 increases). This increases the room inside sleeve 66A and allows end 63 to freely slide into and along sleeve 66A. Conversely, turning finger knob 69 in the opposite direction causes the body and head of screw 67 to move through nut 68A in the opposite direction and farther into sleeve 66A. If turned sufficiently, the bolt head comes into contact with end 63 in sleeve 66A and, in turn, would clamp end 63 against the opposite interior wall of sleeve 66A and prevent end 63 from sliding up or down in sleeve 66A. Sufficient release of clamping pressure by reverse operation of knob 69 releases clamping pressure of the bolt head of bolt 67 on linkage portion 63 and frees end 63 to slide again in sleeve 66A. As such, this combination allows height adjustment (Y direction) of section 60 relative to section 50. The user simply loosens the clamping action of bolt 67, slides part 63 in sleeve 66A to a desired position, and re-applies clamping pressure of bolt 67 to fix part 63 in sleeve 66A. Other techniques of manual clamping and release of clamping between members 50 and 60 are possible. Also, the parts can be made of other materials than metal, with techniques to make the combination of parts adjustably clamp in an analogous way to that which is described here. For example, some or all parts could be made of relatively rigid molded plastic.

Similarly, as shown in FIG. 12D (right side), working end 70 is adjustable relative to second metal linkage section 60 by being slidable in metal sleeve 76A once it is fixed (e.g. welded) on end 65 of second linkage portion 60. A metal washer 76B is fit up into the interior of sleeve 76A (it could be on the exterior). A metal nut 78A is fixed (e.g. welded) to the opposite exterior side of sleeve 76A. A metal threaded bolt 77 having a head end and a free end has its free end slid through aligned apertures in washer 76B and sleeve 76A, which apertures are larger than the diameter of bolt 77, and then threaded through nut 78A to expose the free end of bolt 77 as shown in FIG. 12D. That combination of sleeve 76A with bolt 77 threaded through nut 78A spot welded to section 65 of bar 60. A metal knob 79 can be fixed (e.g. welded) onto the free threaded end of bolt 77 so that manually rotation of knob 79 causes threaded movement of the body of bolt 77 through nut 78A in either direction. As diagrammatically indicated at FIG. 12D (right side), sleeve 76A is shown for clarity exploded from where it is spot welded (at the "X's") to end 65 of second linage section 60. Sleeve 76A is sized to receive end 74 of working end 70 through it. When knob 79 is sufficiently turned in one direction, it moves the head of bolt 77 inside sleeve 76A towards nut 78A, which would release clamping pressure on anything (e.g. working end 70) inside sleeve 76A. Sufficient rotation of knob 79 in the other direction moves the head of bolt 77 inside sleeve 76A away from nut 78A and clamps anything inside sleeve 76A (e.g. working end 70) relative to second linkage section 60. As described above, rotation of knob 79 sufficiently in the opposite direction releases the clamping force of the head of screw 77 to working end 70 in sleeve 76A, to allow either further reach adjustment of working end 70 or removal of working end 70 to, for example, reverse its ends or change which side is up or down in sleeve 67A. Optionally, as indicated in FIG. 12D, a set screw 62 could be threaded part way into a threaded aperture 61 in the bottom of second linkage section 60 as one way, for safety, to prevent inadvertent separation of second linkage section 60 out of sleeve 66A of first linkage section 50. Other ways to prevent this are possible.

As will be appreciated, other techniques to allow height and reach adjustment of these components are possible. The arrangement in FIG. 12A is one non-limiting example, but it does allow a user to make such adjusts by hand and without tools.

iii. The Multi-functional Working End 70

As previously discussed, another subtle but beneficial feature of this embodiment is the ability to have further, built-in, adjustment or functional features for tool 10.

One example is the reversible hook end 73 or opposite end 74 with blunt end or opening 75 for a fastener.

Another optional feature is an add-on tip or member 80. As shown in FIG. 2A, aperture 75 in working end 70 can be alternatively used to mount by a screw or both add-on tip 80 through hole 83. In this embodiment, tip 80 is a ring 83. One function ring 83 adds is that it can go over such things as a whipped cream spout or the like to get better lateral motion when working end 70 moves over its curved path. Ring 83 is one non-limiting example of an add-on tip for further adjustment or functional options for tool 10.

1. Operation of Assembled Tool 10 of Specific Example 1

FIGS. 13A and B diagrammatically illustrate curved path lever action and its proportional curved path working end action when lever 20 is squeezed from its normal biased outward position towards the handle 12. FIGS. 13A and B have certain components shown in vertical cross-section for clarity; namely handle 12, frame 30, linkage sections 50 and 60, and working end 70.

In operation, a container 100 chosen by a user is brought to and clamped into clamp 40 of assembled tool 10 in a position where spray head 104 is near the selected tip of working end 70. In FIG. 13A container 100 has a vertical pump spray head 104 that extends from container 100 by a stem. The user than can finely-adjust the height and reach of working end 70 by manually adjustment of one or more of knobs 69 and 79 as earlier discussed. Additionally, throw of lever 20 can be adjusted as earlier discussed.

When ejection of contents of container 100 is desired, the user holds handle 12 in his/her palm, wraps his/her fingers around lever 20, and squeezes or pulls lever 20 towards handle 12. This produces curved path motion $MP_{LEVER}$, which is turn produces proportional curved motion path $MP_{WORKING\ END}$. As shown in FIG. 13B, that proportional motion tips working end 70 over and down. By appropriate configuration of tool 10 so that working end 70 comes into abutment with the top of spray head 104, the down component of curved motion path $MP_{WORKING\ END}$ pushes head 104 down for a pump action to dispense spray 105 from container 100. The user can make one squeeze for one pump action, or sequentially squeezes for sequential and multiple pump actions, as needed or desired.

As can be seen, tool 10 of Specific Example 1 achieves one or more of the objects, features, aspects, and advantages of the present invention. This tool 10 not only utilizes the subtle benefit of curved path motion, but has multiple adjustment and optional configurations to allow effective operation with a wide variety of different size, shape, and type of spray containers and spray heads. This will be further discussed below.

4. Illustrations of Examples of Different Spray Containers With Which Tool 10 of Specific Example 1 Can be Utilized As will be appreciated by those skilled in the mechanical arts, tool 10 can be applied to many different types of spray heads and containers. FIGS. 14A-B through 39 give non-limiting examples to further show how this common curved path lever action with reciprocal curved path working end action can be implemented in a wide variety of different types of dispensing containers and heads. Those skilled in the art will see that the curved path at the working end can push use the vertical component of curved path motion to push a spray head down (Y direction). Its horizontal (X direction) component can be used to push against an aerosol dispensing tip laterally to release contents under pressure just as one would if they took a thumb or finger and moved that nozzle laterally. Its lateral (X direction) component of motion also shows how the curved path of the working end could effectively laterally push a slide action pump-type sprayer to get pumping action in the same way a finger pump laterally would. It also shows how the curved path action can produce downward or wide direction pressure on a typical aerosol spray nozzle to eject contents.

FIGS. 14A and B show non-actuated and actuated states of tool 10 of FIG. 11 for proportional working end motion to push nozzle 106 of a whipped cream aerosol dispenser 100 sideways in response to the lever motion path to selectively dispense its contents.

FIG. 15A shows the same whipped cream aerosol container of FIGS. 14A and B, but with an add-on tip member 115C for working end 70 that includes a ring that goes over the nozzle 106 to ensure connection to the working end 70. It would tilt nozzle 106 with the motion paths illustrated in FIGS. 14A-B. FIG. 15B is an enlarged top elevation of FIG. 15A.

FIGS. 16, 17, 18 and 19 are non-actuated states using the same basic tool 10 of FIG. 11 with one of the working ends of the embodiments of FIG. 14A or FIG. 15A for a variety of different types of lateral motion aerosol dispensing heads for different types of substances (e.g. paint or coatings, whipped cream, cheese whip, and the like), and shows how the working end 70 can be adjusted or functionalized relative the nozzle of each of the versions. Spray would be actuated from any of the different containers with the motion paths illustrated in FIGS. 14A-B.

FIG. 20A-C shows how the same basic tool 10 of FIG. 11 can be adjusted for use with a finger-trigger-type pump on a non-pressurized container, where the pumping action is lateral to the axis of the container 100. A fastener 115A (e.g. screw) is secured into the slide member 108 of the plastic spray head pump to hold working end 70 to it, so that lever action of lever 20 produces the proportional curved working end motion path at the slide member 108 to, in turn, pump the spray head to dispense contents from container 100 (here a lubricant like WD-40). FIG. 20B is an enlarged top plan view of FIG. 20A. FIG. 20C is an enlarged isolated view of the way the working end is attached to the dispensing head of FIG. 20A.

FIGS. 21 and 22 are still further additional illustrations of how the basic tool 10 of FIG. 11 can be adjusted and configured to dispense contents from a variety of containers that utilize lateral motion to spray out the contents, whether aerosol or not. FIG. 21 shows an option that instead of screwing working end 70 to a laterally sliding member 108 of the spray head actuator, a specially-shaped end 115B (here a non-limiting example is an L-end or hook end 73 as in FIG. 12A) can be adjusted into abutment with that sliding member 108 of the spray head actuator such that lever action of lever 20 produces proportional curved path motion of the working end 70 to push and pull laterally the spray head actuator. Spray would be actuated from any of the different containers with the motion paths illustrated in FIGS. 14A-B.

FIGS. 23A and B illustrate side elevation and top plan views of another version of the basic tool 10 of FIG. 11 operatively mounted and adjusted on a still further different type of spray container 100. Here, clamp 40 of FIG. 21C is used to clamp the slender container 100 (e.g. air spray) in place in tool 10, a screw or fastener 115A is extended through a hole 75 in the distal tip of one end of working end 70 of the tool 10 and into the plastic spray head 104 of container 100, and the curved motion path of lever 20 moves the spray head 104 down toward the container 100 by the proportional curved motion path of working end 70 sufficiently to produce a single pump action. Lever 20 can be pressed into handle 12 once and held to continuously release (see 105) aerosol or pressurized container contents, or pressed and released quickly once for one spurt of spray 105, or pressed and released multiple times to produce separate, sequential bursts of spray 105. The fastener 115A would cause spray head 104 to always follow the motion path of working end 70 because of its physical attachment to working end 70. Thus, this can produce effective pumping action even if spray head 104 was not spring-loaded to return to its normal extended position on container 100. But even if spring-loaded, the attachment at 115A would produce quick and responsive pumping action by pulling and releasing spring-loaded (see spring 122 in FIGS. 11-12A) of lever 20.

FIGS. 24 to 36A-B and 37A-B are still further examples of how the basic tool 10 of FIG. 11 can be mounted to and adjusted for operation of a variety of spray containers using the clamp 40, either a screw/fastener to the spray head or the L-end by selectively reversing the opposite tips of working end 70, and then relying on the curved path motion 97 of working end 75 of the tool to either press down or laterally move the spray head pump mechanism or head to dispense container contents selectively. These illustrations give a variety of examples of how the same tool of FIG. 11 can be adjusted to work with a variety of spray containers. All of them use the basic curved path motion 97 illustrated in FIGS. 14A-B for spray activation.

FIGS. 38 and 39 are isolated enlarged views of an alternative ways to mount parts of the linkage between the handle 12 and the working end 70 of tool 10 of FIG. 11 to allow adjustment options like height and reach of the working end 70 of the tool relative to different container sizes, shapes, and spray head types.

Other embodiments and configurations are, of course possible.

D. Second Specific Embodiment

An example of another embodiment according to aspects of the invention is shown in FIGS. 40A-C. It utilizes aspects from Specific Example 1 but differs as follows.

FIGS. 40A-C are exploded and assembled non-actuated states for a different specific exemplary embodiment, namely tool 10', according to aspects of the present invention. This embodiment 10' utilizes a similar curved lever motion path to produced proportional curved working end motion path like that of tool 10 of FIG. 11, but does not have all the adjustability features of the tool 10 of FIG. 11. The version of FIG. 40A has an open jawed clamp 40' for receiving a container 100. A variety of containers, and position of the container in the clamp, are possible. The version of FIGS. 40B and C adds a platform 122 to support the bottom end of a container 100 in the clamp 40' as an optional feature, and platform 122 has linear adjustability by sliding platform 122 along bracket 126 fixed to clamp 40'.

The main difference is the container receiver can be claw shaped and resilient so that different sized containers can be snapped fit in through the opening in that C-shaped receiver. There does not necessarily need to be adjustment of height or reach of the working end. This embodiment, however, follows the same principles as the first specific embodiment. It translates pivotable lever action at the hand grip into curved path working end travel at the distal end.

FIGS. 40D and 40E illustrate additional possible features of this embodiment of FIGS. 40A-C. For example, the shape of the linkage 70' could vary. Non-limiting examples are shown in FIGS. 40D-E, where an L-shaped linkage 70' can be connected to trigger lever 20 as in FIG. 40D, or an S-shape of FIG. 40B. The length of horizontal and vertical sections of member 70' can vary.

Another example is size and/or length of frame 30 (compare FIGS. 40A-B).

Another example is size and/or shape of clamp 40'. As will be appreciated by those skilled in the art, a smaller clamp could be installed on frame 30' for smaller containers, and a larger clamp for larger containers. Another option is that the user can use one clamp as in FIG. 40A or 40B for a range of container sizes. Having a clamp 70' with essentially jaws like this would allow a container of smaller diameter than the normal width between the jaws to be inserted, the thumb screw turned, and the jaws converged to clamp the smaller container. But a container of similar diameter to the normal position of the jaws could be inserted and with only minor turning of the thumbscrew, held in place. But, further, a container of larger diameter than the normal position of the jaws could also be gripped because the jaws could be manually flexed wider, the container moved in place between them, and they would resiliently close to grip the larger container.

Alternatively or in addition, the user could have an inventory of different sized clamps and, as indicated in FIGS. 40A-B, have structure to allow the clamp 40' to be removable so that any clamp in the inventory could be easily and quickly installed depending on type of bottle. In one non-limiting example, the structure for removable mounting of clamp 40' can be the same or similar to described earlier regarding FIG. 12B.

Note that FIGS. 40A-B also illustrate a flat-head screw could be turned into a threaded bore in the tip of working end 70' is desired, like the screw 115A described in earlier embodiments, to help working end 70' interface with whatever spray head or mechanism exists on a container.

E. Options and Alternatives

It can be appreciated a variety of options and alternatives are possible with the invention. Several non-limiting examples are included in the discussion above.

For example, the materials can vary. One embodiment could be mostly metal. It is necessarily limited thereto.

Variations obvious to those skilled in the art are, of course, possible.

What is claimed is:

1. A hand-operated container dispensing assistance tool comprising:

a. a frame;

b. a container mount attached to part of the frame;

c. a handle attached to a second part of the frame;

d. a lever pivotally mounted in the handle at a pivot axis, the lever having a free end on one side of the pivot axis movable along a curved motion path and having another side;

e. a linkage having one end attached to the lever on the other side of the pivot axis of the lever and an opposite end extending away from the pivot axis of the lever towards the container mount, wherein the linkage has at least two sections that are independent of one another and translatable relative to one another;

f. a working end mounted to the opposite end of the linkage;

g. wherein the working end moves along a curved motion path in proportion to the curved motion path of the lever to provide movement of the working end at the container mount relative to at least two axes to provide for different types of spray head actuation.

2. The tool of claim 1 further comprising an adjustment component at the handle to provide a mechanical stop to control range of throw of the lever relative the handle to, in turn, adjust range of curved path motion of the working end.

3. The tool of claim 1 further comprising an adjustment component at the container mount to receive and secure different shape and diameter containers.

4. The tool of claim 3 wherein the container mount is a band clamp and the adjustment component at the container is a worm gear.

5. The tool of claim 1 further comprising an adjustment component along the linkage, wherein the height adjustment component comprises a clamping member to fix the two translatable linkage sections relative to one another along a range of positions.

6. The tool of claim 1 wherein the at least two sections are stair-stepped up and away from the pivot axis to the working end.

7. The tool of claim 1 further comprising an add-on tip that can be removably mounted to the working end.

8. The tool of claim 7 wherein the add-in tip comprises a ring adapted to fit over a spray head.

9. A hand-operated container dispensing assistance tool comprising:

a. a frame;

b. a container mount attached to another end of the frame and having an adjustment component to receive and secure a variety of size and shape containers;

c. a handle attached to one end of the frame;

d. a lever pivotally mounted in the handle at a pivot axis, the lever having a free end on one side of the pivot axis movable along a curved motion path;

e. a linkage having one end attached to the lever on the other side of the pivot axis and an opposite end extending away from the pivot axis towards the container mount, the linkage having an adjustment component to change reach of a working end relative the container mount;

f. the working end mounted to the opposite end of the linkage, the working end having three different functionalities, wherein the functionalities comprise:

i. a shape that extends transverse of the longitudinal axis of the working end length;

ii. an aperture through the working end; and iii. a profile at one end of the working end;

g. wherein the working end moves along a curved motion path in proportion to the curved motion path of the lever to provide movement of the working end at the container mount relative to at least two axes to provide for different types of spray head actuation.

10. The tool of claim 9 wherein:

a. the shape is an L-shape;

b. the aperture allows passage of a screw; and c. the profile is concave.

11. The tool of claim 10 further comprising an add-on tip that can be removably mounted to the working end, wherein the add-on tip comprises a ring adapted to fit over a spray head.

12. A hand-operated container dispensing assistance tool comprising:

a. a frame;

b. a container mount attached to part of the frame;

c. a handle attached to a second part of the frame;

d. a lever pivotally mounted in the handle at a pivot axis, the lever having a free end on one side of the pivot axis movable along a curved motion path and having another side;

e. a linkage having one end attached to the lever on the other side of the pivot axis of the lever and an opposite end extending away from the pivot axis of the lever towards the container mount;

f. a working end mounted to the opposite end of the linkage, wherein the working end is independent of and translatable relative to the linkage;

g. further comprising a reach adjustment component along the working end, wherein the reach adjustment component comprises a clamping member to fix the translatable working end relative to the linkage along a range of positions.

13. The tool of claim 12 in combination with a container mounted along a container axis in the container mount, the container having a spray head that actuates a pumping stroke or spray action from the container upon a movement of either the spray head or a component of the spray head.

14. The combination of claim 13 wherein the spray container has contents under pressurization and the spray head movement to actuate spray action comprises one of:

a. a component of curved path motion of the working end of the tool to provide movement of the spray head along or parallel to the container axis;

b. a component of curved path motion of the working end of the tool to provide movement of or tilting of the spray head transverse to the container axis; and c. one or more components of curved path motion of the working end of the tool to provide movement of a component of the spray head transverse to the container axis.

15. The tool of claim 12 wherein the working end has a length along a longitudinal axis between first and second opposite ends, and the first and second opposite ends each have one or more functionalities relative to actuation of a spray head.

16. The tool of claim 15 wherein the functionalities comprise one of:

a. a shape that extends transverse of the longitudinal axis of the working end length;

b. an aperture through the working end; and c. a profile at one end of the working end.

17. The tool of claim 16 wherein:

a. the shape is an L-shape;

b. the aperture allows passage of a screw; and c. the profile is concave.

* * * * *